US007605830B2

(12) United States Patent
Date

(10) Patent No.: US 7,605,830 B2
(45) Date of Patent: Oct. 20, 2009

(54) GRAYSCALE VOLTAGE GENERATION DEVICE, DISPLAY PANEL DRIVER AND DISPLAY

(75) Inventor: Yoshito Date, Shiga (JP)

(73) Assignee: Panasonic Corporation, Osaka (JP)

( * ) Notice: Subject to any disclaimer, the term of this patent is extended or adjusted under 35 U.S.C. 154(b) by 723 days.

(21) Appl. No.: 11/193,537

(22) Filed: Aug. 1, 2005

(65) Prior Publication Data

US 2006/0066602 A1 Mar. 30, 2006

(30) Foreign Application Priority Data

Sep. 24, 2004 (JP) ..... 2004-278227

(51) Int. Cl.
*G09G 5/10* (2006.01)

(52) U.S. Cl. ..... 345/690; 345/204; 345/87; 345/90; 345/92; 345/98

(58) Field of Classification Search ..... 345/204, 345/87, 90, 92, 98
See application file for complete search history.

(56) References Cited

U.S. PATENT DOCUMENTS 6,674,420 B2 1/2004 Matsueda et al.
6,747,625 B1 * 6/2004 Han et al. ..... 345/98
7,145,540 B2 * 12/2006 Hector et al. ..... 345/98
2003/0043132 A1 * 3/2003 Nakamura ..... 345/204
2003/0156104 A1 8/2003 Morita
2003/0201959 A1 10/2003 Sakaguchi
2004/0150607 A1 8/2004 Nakajima et al.

FOREIGN PATENT DOCUMENTS

JP 11-272241 10/1999

OTHER PUBLICATIONS

McCartney et al., "30.1: Distinguished Paper: A Third Generation Timing Controller And Column Driver Architecture Using Point-to-Point Differential Signaling", SID 04 Digest, 2004, pp. 1556-1559.
Chinese Office Action issued in Patent Application No. 2005100855157 dated on Jul. 11, 2008 and an English translation thereof.

* cited by examiner

*Primary Examiner*—Richard Hjerpe
*Assistant Examiner*—Leonid Shapiro
(74) *Attorney, Agent, or Firm*—McDermott Will & Emery LLP

(57) ABSTRACT

The grayscale voltage generation device includes a first line, a second line and a plurality of serial digital analog converters (DACs). A first reference voltage having a first voltage value is supplied to the first line, and a second reference voltage having a second voltage value is supplied to the second line. Each of the plurality of serial DACs receives grayscale information representing a grayscale level and generates a grayscale voltage having a voltage value corresponding to the grayscale information using the reference voltages supplied to the first and second lines.

23 Claims, 23 Drawing Sheets

FIG. 17

| | t0 | t1 | t2 | t3 | t4 | t5 | t6 | t7 | t8 |
|---|---|---|---|---|---|---|---|---|---|
| 0H | 0 | N | 0 | N | 0 | N | 0 | N | |
| C1 | 0 | 0 | 0 | 0 | 0 | 0 | 0 | 0 | |
| C2 | 0 | | 0 | | 0 | | 0 | | |
| 1H | 1 | N | 0 | N | 0 | N | 0 | N | |
| C1 | 1 | 0.5 | 0 | 0.25 | 0 | 0.125 | 0 | 0.0625 | |
| C2 | 0 | | 0.5 | | 0.25 | | 0.125 | | |
| 2H | 0 | N | 1 | N | 0 | N | 0 | N | |
| C1 | 0 | 0 | 1 | 0.5 | 0 | 0.25 | 0 | 0.125 | |
| C2 | 0 | | 0 | | 0.5 | | 0.25 | | |
| 3H | 1 | N | 1 | N | 0 | N | 0 | N | |
| C1 | 1 | 0.5 | 1 | 0.75 | 0 | 0.375 | 0 | 0.1875 | |
| C2 | 0 | | 0.5 | | 0.75 | | 0.375 | | |
| 4H | 0 | N | 0 | N | 1 | N | 0 | N | |
| C1 | 0 | 0 | 0 | 0 | 1 | 0.5 | 0 | 0.25 | |
| C2 | 0 | | 0 | | 0 | | 0.5 | | |
| 5H | 1 | N | 0 | N | 1 | N | 0 | N | |
| C1 | 1 | 0.5 | 0 | 0.25 | 1 | 0.625 | 0 | 0.3125 | |
| C2 | 0 | | 0.5 | | 0.25 | | 0.625 | | |
| 6H | 0 | N | 1 | N | 1 | N | 0 | N | |
| C1 | 0 | 0 | 1 | 0.5 | 1 | 0.75 | 0 | 0.375 | |
| C2 | 0 | | 0 | | 0.5 | | 0.75 | | |
| 7H | 1 | N | 1 | N | 1 | N | 0 | N | |
| C1 | 1 | 0.5 | 1 | 0.75 | 1 | 0.875 | 0 | 0.4375 | |
| C2 | 0 | | 0.5 | | 0.75 | | 0.875 | | |
| 8H | 0 | N | 0 | N | 0 | N | 1 | N | |
| C1 | 0 | 0 | 0 | 0 | 0 | 0 | 1 | 0.5 | |
| C2 | 0 | | 0 | | 0 | | 0 | | |
| 9H | 1 | N | 0 | N | 0 | N | 1 | N | |
| C1 | 1 | 0.5 | 0 | 0.25 | 0 | 0.125 | 1 | 0.5625 | |
| C2 | 0 | | 0.5 | | 0.25 | | 0.125 | | |
| AH | 0 | N | 1 | N | 0 | N | 1 | N | |
| C1 | 0 | 0 | 1 | 0.5 | 0 | 0.25 | 1 | 0.625 | |
| C2 | 0 | | 0 | | 0.5 | | 0.25 | | |
| BH | 1 | N | 1 | N | 0 | N | 1 | N | |
| C1 | 1 | 0.5 | 1 | 0.75 | 0 | 0.375 | 1 | 0.6875 | |
| C2 | 0 | | 0.5 | | 0.75 | | 0.375 | | |
| CH | 0 | N | 0 | N | 1 | N | 1 | N | |
| C1 | 0 | 0 | 0 | 0 | 1 | 0.5 | 1 | 0.75 | |
| C2 | 0 | | 0 | | 0 | | 0.5 | | |
| DH | 1 | N | 0 | N | 1 | N | 1 | N | |
| C1 | 1 | 0.5 | 0 | 0.25 | 1 | 0.625 | 1 | 0.8125 | |
| C2 | 0 | | 0.5 | | 0.25 | | 0.625 | | |
| EH | 0 | N | 1 | N | 1 | N | 1 | N | |
| C1 | 0 | 0 | 1 | 0.5 | 1 | 0.75 | 1 | 0.875 | |
| C2 | 0 | | 0 | | 0.5 | | 0.75 | | |
| FH | 1 | N | 1 | N | 1 | N | 1 | N | |
| C1 | 1 | 0.5 | 1 | 0.75 | 1 | 0.875 | 1 | 0.9375 | |
| C2 | 0 | | 0.5 | | 0.75 | | 0.875 | | |

GRAYSCALE VOLTAGE GENERATION DEVICE, DISPLAY PANEL DRIVER AND DISPLAY

CROSS-REFERENCE TO RELATED APPLICATIONS

This application claims priority under 35 U.S.C. §119 on Patent application No. 2004-278227 filed in Japan on Sep. 24, 2004, the entire contents of which are hereby incorporated by reference.

BACKGROUND OF THE INVENTION

The present invention relates to a device for generating a grayscale voltage having a value corresponding to a given grayscale level, and more particularly to a device for generating a grayscale voltage using a serial digital analog converter (DAC).

In recent years, while flat panel displays have attained larger screen size and higher definition, they are also being made increasingly thinner, lighter in weight and lower in cost. In this situation, display drivers are requested to present high-definition display by increasing the number of grayscale levels and providing high-precision, high-resolution grayscale voltages.

FIG. 22A shows an entire configuration of a conventional grayscale voltage generation device 2000. The grayscale voltage generation device 2000 generates grayscale voltages Vlcd (a) to Vlcd(d) having values corresponding to 3-bit display data Data(a) to Data(d) output from latches and applies the generated grayscale voltages to liquid crystal elements (not shown) of a liquid crystal panel via downstream circuits (current drive amplifying circuits in many cases) to thereby drive the liquid crystal panel. The grayscale voltage generation device 2000 includes a voltage divider 20001 and selectors 20002*a* to 20002*d*. The voltage divider 20001 is connected to each of the selectors 20002*a* to 20002*d* via eight voltage supply lines. The voltage divider 20001 receives a reference voltage Vref, divides the received reference voltage Vref into divided voltages. For the 3-bit data, the voltage divider 20001 generates eight divided voltages for eight grayscale levels.

The voltage divider 20001 and the respective selectors 20002*a* to 20002*d* constitute "resistance digital analog converters (R-DACs)", to generate the grayscale voltages Vlcd (a) to Vlcd(d) corresponding to the display data Data(a) to Data(d).

FIG. 23 shows an internal configuration of the voltage divider 20001 and the selector 20002*a* shown in FIG. 22A. The voltage divider 20001 includes two resistances having a value of R/2 and eight resistances having a value of R connected like a ladder between the two R/2 resistances. Each of the voltage supply lines is connected at a point between every two adjacent resistances. The selector 20002*a* includes a switch controller SWC200021 and switches SWa to SWf. The switch controller SWC200021 turns ON/OFF the switches SWa to SWf according to the bit values of the display data Data(a) received from the latch. Specifically, in the selector 20002*a*, the switch controller SWC200021 selects or does not select the switches SWa to SWf according to the display data Data(a) for one pixel in a tournament manner, to thereby generate an output voltage Vout(a). Such output voltages Vout(a) to Vout(d) are output to the liquid crystal elements in the liquid crystal panel via respective output terminals as the grayscale voltages Vlcd(a) to Vlcd(d).

FIG. 24 shows the relationship between the bit values of the display data Data(a) input into the selector 20002*a* and the value of the output voltage Vout(a) output from the selector 20002*a*. As is shown in FIG. 24, by switching the connections of the switches SWa to SWf, it is possible to generate the output voltage Vout(a) having a value that varies with the bit values of the display data Data(a).

As described above, liquid crystal displays (LCDs) adopting the resistance dividing method have an advantage that the circuit configuration can be implemented comparatively easily. Therefore, such LCDs are currently in widespread use as LCDs for notebook PCs.

FIG. 22B shows a grayscale voltage generation device 2100 suited to 4-bit display data Data(a) to Data(d). A voltage divider 21001 of the grayscale voltage generation device 2100 receives the reference voltage Vref and divides the received reference voltage Vref into 16 divided voltages. The voltage divider 21001 therefore includes two resistances having a value of R/2 and 16 resistances having a value of R connected like a ladder between the two R/2 resistances. A total of 16 voltage supply lines are also provided.

As described above, as the number of levels of grayscale of the display data Data(a) to Data(d) is greater (as the number of bits is greater), the number of resistances included in the voltage divider 20001 and the number of voltage supply lines connecting the voltage divider 20001 to each of the selectors 20002*a* to 20002*d* must be greater. For example, in the case of 8-bit display data, voltages for 256 grayscale levels (256 voltage supply lines) are necessary. To implement this, an area four times as large as the area occupied by the voltage divider 20001 and the selectors 20002*a* to 20002*d* in the case of 3-bit display data is necessary. In the case of 10-bit display data, an area 16 times as large as the area occupied by the voltage divider 20001 and the selectors 20002*a* to 20002*d* in the case of 3-bit display data is necessary. This increases the area occupied by semiconductor chips, and thus increases the cost.

SUMMARY OF THE INVENTION

The grayscale voltage generation device of the present invention includes: a first line, a second line and a plurality of serial digital analog converters (DACs). A first reference voltage having a first voltage value is supplied to the first line, and a second reference voltage having a second voltage value is supplied to the second line. Each of the plurality of serial DACs receives grayscale information representing a grayscale level and generates a grayscale voltage having a voltage value corresponding to the grayscale information using the reference voltages supplied to the first and second lines.

The grayscale voltage generation device described above includes a plurality of serial DACs connected in parallel to a pair of lines (first and second lines). Therefore, by supplying two reference voltages to the two lines, a plurality of grayscale voltages can be generated. Using such serial DACs, the number of lines (the number of reference voltages) required for generating grayscale voltages can be small, compared with the case of using the conventional R-DACs. Hence, a grayscale voltage generation device smaller in the area occupied by the lines for supplying the reference voltages (smaller in circuit scale) than a grayscale voltage generation device using the conventional R-DACs can be provided.

Preferably, the grayscale voltage generation device further includes a first selector for receiving the first and second reference voltages and a third reference voltage having a third voltage value. The grayscale voltage generation device has first and second modes. In the first mode, the first selector supplies the first reference voltage to the first line and the second reference voltage to the second line. In the second mode, the first selector supplies the third reference voltage to the first line and the second reference voltage to the second line. The first reference voltage has negative polarity with respect to the second reference voltage, and the third reference voltage has positive polarity with respect to the second reference voltage.

In the grayscale voltage generation device described above, each of the plurality of serial DACs generates an output voltage of negative polarity using the first reference voltage (negative polarity) and the second reference voltage (common potential), and generates an output voltage of positive polarity using the third reference voltage (positive polarity) and the second reference voltage (common potential). Therefore, by cyclically switching the reference voltages supplied to the first and second lines, the polarity of grayscale voltages generated by the serial DACs can be inverted cyclically. Hence, in the case of LCDs, for example, horizontal line inversion driving can be attained, and thus flickering of display can be reduced.

Preferably, the grayscale voltage generation device further includes: third, fourth, fifth and sixth lines to which a voltage is supplied; a second selector, and a third selector. The second selector receives a fourth reference voltage having a fourth voltage value, a fifth reference voltage having a fifth voltage value and a sixth reference voltage having a sixth voltage value. The third selector receives a seventh reference voltage having a seventh voltage value, an eighth reference voltage having an eighth voltage value and a ninth reference voltage having a ninth voltage value. The plurality of serial DACs include first, second and third serial DACs. The first serial DAC receives first grayscale information representing a first grayscale level and generates a first grayscale voltage having a voltage value corresponding to the first grayscale information using the reference voltages supplied to the first and second lines. The second serial DAC receives second grayscale information representing a second grayscale level and generates a second grayscale voltage having a voltage value corresponding to the second grayscale information using the reference voltages supplied to the third and fourth lines. The third serial DAC receives third grayscale information representing a third grayscale level and generates a third grayscale voltage having a voltage value corresponding to the third grayscale information using the reference voltages supplied to the fifth and sixth lines. In the first mode, the first selector supplies the first reference voltage to the first line and the second reference voltage to the second line. The second selector supplies the fourth reference voltage to the third line and the fifth reference voltage to the fourth line. The third selector supplies the seventh reference voltage to the fifth line and the eighth reference voltage to the sixth line. In the second mode, the first selector supplies the third reference voltage to the first line and the second reference voltage to the second line. The second selector supplies the sixth reference voltage to the third line and the fifth reference voltage to the fourth line. The third selector supplies the ninth reference voltage to the fifth line and the eighth reference voltage to the sixth line. The fourth reference voltage has negative polarity with respect to the fifth reference voltage. The sixth reference voltage has positive polarity with respect to the fifth reference voltage. The seventh reference voltage has negative polarity with respect to the eighth reference voltage. The ninth reference voltage has positive polarity with respect to the eighth reference voltage.

In the grayscale voltage generation device described above, the value of the first grayscale voltage generated by the first serial DAC can be adjusted by adjusting the first to third reference voltages, the value of the second grayscale voltage generated by the second serial DAC can be adjusted by adjusting the fourth to sixth reference voltages, and the value of the third grayscale voltage generated by the third serial DAC can be adjusted by adjusting the seventh to ninth reference voltages. In this manner, the values of the first to third grayscale voltages can be individually set. Hence, in the case of LCDs, for example, individual gamma correction for RGB is permitted and thus high-quality display can be realized.

Preferably, the grayscale voltage generation device further includes: a first selector for receiving the first and second reference voltages, a third reference voltage having a third voltage value and a fourth reference voltage having a fourth voltage value. The grayscale voltage generation device has first and second modes. In the first mode, the first selector supplies the first reference voltage, among the first, second, third and fourth reference voltages, to the first line and the second reference voltage to the second line. In the second mode, the first selector supplies the third reference voltage, among the first, second, third and fourth reference voltages, to the first line and the fourth reference voltage to the second line. The first reference voltage has negative polarity with respect to the second reference voltage, and the third reference voltage has negative polarity with respect to the fourth reference voltage.

In the grayscale voltage generation device described above, each of the plurality of serial DACs generates an output voltage of the first polarity (for example, negative polarity) using the first and second reference voltages, and generates an output voltage of the second polarity (for example, positive polarity) using the third and fourth reference voltages. Therefore, by cyclically switching the reference voltages supplied to the first and second lines, the polarity of grayscale voltages generated by the serial DACs can be inverted cyclically. Hence, in the case of LCDs, for example, horizontal line inversion driving can be attained.

Preferably, the grayscale voltage generation device further includes: third, fourth, fifth and sixth lines to which a voltage is supplied; a second selector; and a third selector. The second selector receives a fifth reference voltage having a fifth voltage value, a sixth reference voltage having a sixth voltage value, a seventh reference voltage having a seventh voltage value, and an eighth reference voltage having an eighth voltage value. The third selector receives a ninth reference voltage having a ninth voltage value, a tenth reference voltage having a tenth voltage value, an eleventh reference voltage having an eleventh voltage value, and a twelfth reference voltage having a twelfth voltage value. The plurality of serial DACs include first, second and third serial DACs. The first serial DAC receives first grayscale information representing a first grayscale level and generates a first grayscale voltage having a voltage value corresponding to the first grayscale information using the reference voltages supplied to the first and second lines. The second serial DAC receives second grayscale information representing a second grayscale level and generates a second grayscale voltage having a voltage value corresponding to the second grayscale information using the reference voltages supplied to the third and fourth lines. The third serial DAC receives third grayscale information representing a third grayscale level and generates a third grayscale voltage having a voltage value corresponding to the third grayscale information using the reference voltages supplied to the fifth and sixth lines. In the first mode, the first selector supplies the first reference voltage to the first line and the second reference voltage to the second line. The second selector supplies the fifth reference voltage to the third line and the sixth reference voltage to the fourth line. The third selector supplies the ninth reference voltage to the fifth line and the tenth reference voltage to the sixth line. In the second mode, the first selector supplies the third reference voltage to the first line and the fourth reference voltage to the second line. The second selector supplies the seventh reference voltage to the third line and the eighth reference voltage to the fourth line. The third selector supplies the eleventh reference voltage to the fifth line and the twelfth reference voltage to the sixth line. The fifth reference voltage has negative polarity with respect to the sixth reference voltage. The seventh reference voltage has negative polarity with respect to the eighth reference voltage. The ninth reference voltage has negative polarity with respect to the tenth reference voltage. The eleventh reference voltage has negative polarity with respect to the twelfth reference voltage.

Preferably, the grayscale voltage generation section further includes: a third line to which a third reference voltage having a third reference value is supplied. The plurality of serial DACs include first and second serial DACs. The first serial DAC receives first grayscale information representing a first grayscale level and generates a first grayscale voltage having a voltage value corresponding to the first grayscale information using the reference voltages supplied to the first and second lines. The second serial DAC receives second grayscale information representing a second grayscale level and generates a second grayscale voltage having a voltage value corresponding to the second grayscale information using the reference voltages supplied to the second and third lines. The first reference voltage has negative polarity with respect to the second reference voltage, and the third reference voltage has positive polarity with respect to the second reference voltage.

In the grayscale voltage generation device described above, two types of grayscale voltages, a grayscale voltage of negative polarity and a grayscale voltage of positive polarity, can be generated by supplying three reference voltages to three lines. Hence, a grayscale voltage generation device smaller in the area occupied by lines for supplying reference voltages (smaller in circuit scale) than a grayscale voltage generation device using the conventional R-DACs can be provided.

Preferably, the grayscale voltage generation device further includes a first selector for receiving the first, second and third reference voltages. The grayscale voltage generation device has first and second modes. In the first mode, the first selector supplies the first reference voltage to the first line, the second reference voltage to the second line, and the third reference voltage to the third line. In the second mode, the first selector supplies the third reference voltage to the first line, the second reference voltage to the second line, and the first reference voltage to the third line.

In the grayscale voltage generation device described above, in the first mode, the first serial DAC generates the first grayscale voltage of negative polarity while the second serial DAC generates the second grayscale voltage of positive polarity. In the second mode, the first serial DAC generates the first grayscale voltage of positive polarity while the second serial DAC generates the second grayscale voltage of negative polarity. In this manner, by cyclically switching the reference voltages supplied to the first and third lines, the polarity of the first and second grayscale voltages can be inverted cyclically. Hence, in the case of LCDs, for example, vertical line inversion driving and dot inversion driving can be attained.

Preferably, the grayscale voltage generation device further includes: fourth, fifth, sixth, seventh, eighth and ninth lines to which a voltage is supplied; a second selector; and a third selector. The second selector receives a fourth reference voltage having a fourth voltage value, a fifth reference voltage having a fifth voltage value, and a sixth reference voltage having a sixth voltage value. The third selector receives a seventh reference voltage having a seventh voltage value, an eighth reference voltage having an eighth voltage value, and a ninth reference voltage having a ninth voltage value. The plurality of serial DACs further include third, fourth, fifth and sixth serial DACs. The third serial DAC receives third grayscale information representing a third grayscale level and generates a third grayscale voltage having a voltage value corresponding to the third grayscale information using the reference voltages supplied to the fifth and sixth lines. The fourth serial DAC receives fourth grayscale information representing a fourth grayscale level and generates a fourth grayscale voltage having a voltage value corresponding to the fourth grayscale information using the reference voltages supplied to the fourth and fifth lines. The fifth serial DAC receives fifth grayscale information representing a fifth grayscale level and generates a fifth grayscale voltage having a voltage value corresponding to the fifth grayscale information using the reference voltages supplied to the seventh and eighth lines. The sixth serial DAC receives sixth grayscale information representing a sixth grayscale level and generates a sixth grayscale voltage having a voltage value corresponding to the sixth grayscale information using the reference voltages supplied to the eighth and ninth lines. In the first mode, the first selector supplies the first reference voltage to the first line, the second reference voltage to the second line and the third reference voltage to the third line. The second selector supplies the fourth reference voltage to the fourth line, the fifth reference voltage to the fifth line and the sixth reference voltage to the sixth line. The third selector supplies the seventh reference voltage to the seventh line, the eighth reference voltage to the eighth line and the ninth reference voltage to the ninth line. In the second mode, the first selector supplies the third reference voltage to the first line, the second reference voltage to the second line and the first reference voltage to the third line. The second selector supplies the sixth reference voltage to the fourth line, the fifth reference voltage to the fifth line and the fourth reference voltage to the sixth line. The third selector supplies the ninth reference voltage to the seventh line, the eighth reference voltage to the eighth line and the seventh reference voltage to the ninth line. The fourth reference voltage has negative polarity with respect to the fifth reference voltage. The sixth reference voltage has positive polarity with respect to the fifth reference voltage. The seventh reference voltage has negative polarity with respect to the eighth reference voltage. The ninth reference voltage has positive polarity with respect to the eighth reference voltage.

In the grayscale voltage generation device described above, in the first mode, the first, fourth and fifth grayscale voltages have negative polarity while the second, third and sixth grayscale voltages have positive polarity. In the second mode, the first, fourth and fifth grayscale voltages have positive polarity while the second, third and sixth grayscale voltages have negative polarity. The values of the first, fourth and fifth grayscale voltages can be individually adjusted by individually adjusting the first, fourth and seventh reference voltages, and the values of the second, third and sixth grayscale voltages can be individually adjusted by individually adjusting the third, sixth and ninth reference voltages. In this manner, for three grayscale voltages having the same polarity, the voltage values can be individually set. Hence, in the case of LCDs, for example, individual gamma correction for RGB is permitted and thus high-quality display can be realized.

Preferably, the grayscale voltage generation device further includes a first selector for receiving the first and second grayscale voltages. The grayscale voltage generation device has first and second modes. In the first mode, the first selector outputs the first grayscale voltage to a first node and the second grayscale voltage to a second node. In the second mode, the first selector outputs the first grayscale voltage to the second node and the second grayscale voltage to the first node.

In the grayscale voltage generation device described above, in the first mode, the first grayscale voltage of negative polarity is output to the first node while the second grayscale voltage of positive polarity is output to the second node. In the second mode, the second grayscale voltage of positive polarity is output to the first node while the first grayscale voltage of negative polarity is output to the second node. In this manner, the polarity of the grayscale voltages output to the first and second nodes can be inverted cyclically. Hence, in the case of LCDs, for example, vertical line inversion driving and dot inversion driving can be attained.

Preferably, the grayscale voltage generation device further includes fourth, fifth, sixth, seventh, eighth and ninth lines to which a voltage is supplied. The plurality of serial DACs further include third, fourth, fifth and sixth serial DACs. The third serial DAC receives third grayscale information representing a third grayscale level and generates a third grayscale voltage having a voltage value corresponding to the third grayscale information using the reference voltages supplied to the fifth and sixth lines. The fourth serial DAC receives fourth grayscale information representing a fourth grayscale level and generates a fourth grayscale voltage having a voltage value corresponding to the fourth grayscale information using the reference voltages supplied to the fourth and fifth lines. The fifth serial DAC receives fifth grayscale information representing a fifth grayscale level and generates a fifth grayscale voltage having a voltage value corresponding to the fifth grayscale information using the reference voltages supplied to the seventh and eighth lines. The sixth serial DAC receives sixth grayscale information representing a sixth grayscale level and generates a sixth grayscale voltage having a voltage value corresponding to the sixth grayscale information using the reference voltages supplied to the eighth and ninth lines. The grayscale voltage generation device further includes: a second selector for receiving the third and fourth grayscale voltages; and a third selector for receiving the fifth and sixth grayscale voltages. In the first mode, the first selector outputs the first grayscale voltage to the first node and the second grayscale voltage to the second node. The second selector outputs the third grayscale voltage to a third node and the fourth grayscale voltage to a fourth node. The third selector outputs the fifth grayscale voltage to a fifth node and the sixth grayscale voltage to a sixth node. In the second mode, the first selector outputs the first grayscale voltage to the second node and the second grayscale voltage to the first node. The second selector outputs the third grayscale voltage to the fourth node and the fourth grayscale voltage to the third node. The third selector outputs the fifth grayscale voltage to the sixth node and the sixth grayscale voltage to the fifth node. The fourth reference voltage has negative polarity with respect to the fifth reference voltage. The sixth reference voltage has positive polarity with respect to the fifth reference voltage. The seventh reference voltage has negative polarity with respect to the eighth reference voltage. The ninth reference voltage has positive polarity with respect to the eighth reference voltage.

Preferably, the grayscale voltage generation device further includes: a third line to which a third reference voltage having a third reference value is supplied; and a fourth line to which a fourth reference voltage having a fourth reference value is supplied. The plurality of serial DACs include first and second serial DACs. The first serial DAC receives first grayscale information representing a first grayscale level and generates a first grayscale voltage having a voltage value corresponding to the first grayscale information using the reference voltages supplied to the first and second lines. The second serial DAC receives second grayscale information representing a second grayscale level and generates a second grayscale voltage having a voltage value corresponding to the second grayscale information using the reference voltages supplied to the third and fourth lines. The first reference voltage has negative polarity with respect to the second reference voltage, and the third reference voltage has negative polarity with respect to the fourth reference voltage.

In the grayscale voltage generation device described above, two types of grayscale voltages, a grayscale voltage of negative polarity and a grayscale voltage of positive polarity, can be generated by supplying four reference voltages to four lines. Hence, a grayscale voltage generation device smaller in the area occupied by lines for supplying reference voltages (smaller in circuit scale) than a grayscale voltage generation device using the conventional R-DACs can be provided.

Preferably, the grayscale voltage generation device further includes a first selector for receiving the first, second, third and fourth reference voltages. The grayscale voltage generation device has first and second modes. In the first mode, the first selector supplies the first reference voltage to the first line, the second reference voltage to the second line, the third reference voltage to the third line, and the fourth reference voltage to the fourth line. In the second mode, the first selector supplies the third reference voltage to the first line, the fourth reference voltage to the second line, the first reference voltage to the third line, and the second reference voltage to the fourth line.

In the grayscale voltage generation device described above, in the first mode, the first serial DAC generates the first grayscale voltage of the first polarity (for example, negative polarity) while the second serial DAC generates the second grayscale voltage of the second polarity (for example, positive polarity). In the second mode, the first serial DAC generates the first grayscale voltage of the second polarity while the second serial DAC generates the second grayscale voltage of the first polarity. In this manner, by cyclically switching the reference voltages supplied to the first and third lines, the polarity of the first and second grayscale voltages can be inverted cyclically. Hence, in the case of LCDs, for example, vertical line inversion driving and dot inversion driving can be attained.

Preferably, the grayscale voltage generation device further includes: fifth, sixth, seventh, eighth, ninth, tenth, eleventh and twelfth lines to which a voltage is supplied; a second selector; and a third selector. The second selector receives a fifth reference voltage having a fifth voltage value, a sixth reference voltage having a sixth voltage value, a seventh reference voltage having a seventh voltage value and an eighth reference voltage having an eighth voltage value. The third selector receives a ninth reference voltage having a ninth voltage value, a tenth reference voltage having a tenth voltage value, an eleventh reference voltage having an eleventh voltage value and a twelfth reference voltage having a twelfth voltage value. The plurality of serial DACs further includes third, fourth, fifth and sixth serial DACs. The third serial DAC receives third grayscale information representing a third grayscale level and generates a third grayscale voltage having a voltage value corresponding to the third grayscale information using the reference voltages supplied to the seventh and eighth lines. The fourth serial DAC receives fourth grayscale information representing a fourth grayscale level and generates a fourth grayscale voltage having a voltage value corresponding to the fourth grayscale information using the reference voltages supplied to the fifth and sixth lines. The fifth serial DAC receives fifth grayscale information representing a fifth grayscale level and generates a fifth grayscale voltage having a voltage value corresponding to the fifth grayscale information using the reference voltages supplied to the ninth and tenth lines. The sixth serial DAC receives sixth grayscale information representing a sixth grayscale level and generates a sixth grayscale voltage having a voltage value corresponding to the sixth grayscale information using the reference voltages supplied to the eleventh and twelfth lines. In the first mode, the first selector supplies the first reference voltage to the first line, the second reference voltage to the second line, the third reference voltage to the third line and the fourth reference voltage to the fourth line. The second selector supplies the fifth reference voltage to the fifth line, the sixth reference voltage to the sixth line, the seventh reference voltage to the seventh line and the eighth reference voltage to the eighth line. The third selector supplies the ninth reference voltage to the ninth line, the tenth reference voltage to the tenth line, the eleventh reference voltage to the eleventh line and the twelfth reference voltage to the twelfth line. In the second mode, the first selector supplies the third reference voltage to the first line, the fourth reference voltage to the second line, the first reference voltage to the third line and the second reference voltage to the fourth line. The second selector supplies the seventh reference voltage to the fifth line, the eighth reference voltage to the sixth line, the fifth reference voltage to the seventh line and the sixth reference voltage to the eighth line. The third selector supplies the eleventh reference voltage to the ninth line, the twelfth reference voltage to the tenth line, the ninth reference voltage to the eleventh line and the tenth reference voltage to the twelfth line. The fifth reference voltage has negative polarity with respect to the sixth reference voltage. The seventh reference voltage has negative polarity with respect to the eighth reference voltage. The ninth reference voltage has negative polarity with respect to the tenth reference voltage. The eleventh reference voltage has negative polarity with respect to the twelfth reference voltage.

Preferably, the grayscale voltage generation device further includes a first selector for receiving the first and second grayscale voltages. The grayscale voltage generation device has first and second modes. In the first mode, the first selector outputs the first grayscale voltage to a first node and the second grayscale voltage to a second node. In the second mode, the first selector outputs the first grayscale voltage to the second node and the second grayscale voltage to the first node.

Preferably, the grayscale voltage generation device further includes fifth, sixth, seventh, eighth, ninth, tenth, eleventh and twelfth lines to which a voltage is supplied. The plurality of serial DACs further include third, fourth, fifth and sixth serial DACs. The third serial DAC receives third grayscale information representing a third grayscale level and generates a third grayscale voltage having a voltage value corresponding to the third grayscale information using the reference voltages supplied to the seventh and eighth lines. The fourth serial DAC receives fourth grayscale information representing a fourth grayscale level and generates a fourth grayscale voltage having a voltage value corresponding to the fourth grayscale information using the reference voltages supplied to the fifth and sixth lines. The fifth serial DAC receives fifth grayscale information representing a fifth grayscale level and generates a fifth grayscale voltage having a voltage value corresponding to the fifth grayscale information using the reference voltages supplied to the ninth and tenth lines. The sixth serial DAC receives sixth grayscale information representing a sixth grayscale level and generates a sixth grayscale voltage having a voltage value corresponding to the sixth grayscale information using the reference voltages supplied to the eleventh and twelfth lines. The grayscale voltage generation device further includes: a second selector for receiving the third and fourth grayscale voltages; and a third selector for receiving the fifth and sixth grayscale voltages. In the first mode, the first selector outputs the first grayscale voltage to the first node and the second grayscale voltage to the second node. The second selector outputs the third grayscale voltage to a third node and the fourth grayscale voltage to a fourth node. The third selector outputs the fifth grayscale voltage to a fifth node and the sixth grayscale voltage to a sixth node. In the second mode, the first selector outputs the first grayscale voltage to the second node and the second grayscale voltage to the first node. The second selector outputs the third grayscale voltage to the fourth node and the fourth grayscale voltage to the third node. The third selector outputs the fifth grayscale voltage to the sixth node and the sixth grayscale voltage to the fifth node. The fifth reference voltage has negative polarity with respect to the sixth reference voltage. The seventh reference voltage has negative polarity with respect to the eighth reference voltage. The ninth reference voltage has negative polarity with respect to the tenth reference voltage. The eleventh reference voltage has negative polarity with respect to the twelfth reference voltage.

Preferably, each of the serial DACs includes a first input terminal, a second input terminal, a first switch, a first capacitor, a second switch and a second capacitor. The first input terminal receives the first reference voltage. The second input terminal receives the second reference voltage. The first switch connects the first input terminal with a first node or connects the second input terminal with the first node. The first capacitor is connected between the first node and the second input terminal. The second switch connects/disconnects the first node with/from a second node. The second capacitor is connected between the second node and the second input terminal.

In the grayscale voltage generation device described above, the grayscale level is represented by binary data like bit values. The first switch connects the first input terminal with the first node if the bit value is "1", for example, and connects the second input terminal with the first node if the bit value is "0". When the first input terminal is connected with the first node via the first switch, a voltage equivalent to the potential difference between the first and second reference voltages (for example, VREF) is applied across the first capacitor, permitting charge of an amount corresponding to the potential difference to be stored in the first capacitor. Once the operation related to the first switch is finished, the first node and the second node are connected with each other via the second switch. This puts the first capacitor and the second capacitor in parallel connection, and as a result, both the charges stored in the first and second capacitors become "0.5VREF". When the second input terminal is connected with the first node via the first switch, the charge stored in the first capacitor is released. In this way, charge is sampled and averaged repeatedly with use of the first and second switches, and as a result, a voltage corresponding to the charge stored in the second capacitor (voltage at the second capacitor) is output from the serial DAC as the grayscale voltage. For releasing the charge stored in the second capacitor, the first node and the second node are connected via the second switch, and then the second input terminal and the first node are connected via the first switch. In this way, the charge stored in the second capacitor can be released with the operation of the first and second switches without the necessity of providing a switch for discharging the second capacitor. Hence, the area occupied by switches can be reduced compared with the case of providing a switch for discharging the second capacitor.

Preferably, the serial DAC further includes a third switch for connecting/disconnecting the second node to/from the second input terminal.

In the grayscale voltage generation device described above, the charge stored in the second capacitor can be released by connecting the second node with the second input terminal via the third switch. Hence, the operation of the first and second switches can be reduced by one step compared with the case of providing no switch for discharging the second capacitor. Further, by connecting the second node with the second input terminal via the third switch while connecting the first input terminal with the first node via the first switch, the charge stored in the second capacitor can be released simultaneously with the sampling of charge into the first capacitor.

Preferably, the serial DAC further includes an operational amplifier and a third capacitor. The operational amplifier is connected with a third node at one of its input terminals and receives a ground voltage at the other input terminal. The third capacitor is connected between the third node and an output terminal of the operational amplifier. The first switch connects the first input terminal with the first node or connects the first node with the third node according to the grayscale information.

In the grayscale voltage generation device described above, the charge stored in the first capacitor is not discarded but shifts to a third capacitor. Hence, the unnecessary charge can be recovered.

Preferably, the serial DAC further includes a third switch, a fourth switch and a discharge section. The third switch is provided between the third node and the third capacitor. The fourth switch is provided between the third capacitor and the output terminal of the operational amplifier. The discharge section connects the third capacitor to the outside.

In the grayscale voltage generation device described above, the charge stored in the third capacitor is supplied to power supply and the like, to effectively use the unnecessary charge and thus enable low power.

Preferably, the serial DAC further includes an operational amplifier. The operational amplifier is connected with the second node at one of its input terminals and connected with its output terminal at the other input terminal.

The grayscale voltage generation device described above, which generates grayscale voltages using so-called voltage-following current amplifiers, can drive a liquid crystal panel having large load capacitance satisfactorily. Hence, an LCD provided with a large screen liquid crystal panel can be implemented.

Preferably, the serial DAC further includes a third capacitor, an operational amplifier and a connection switching section. The operational amplifier is connected with the second node via a third node at one of its input terminals and connected with the second input terminal via a fourth node at the other input terminal. The connection switching section performs first processing and second processing. In the first processing, the connection switching section connects one terminal of the third capacitor with the fourth node and connects the other terminal of the third capacitor with the third node and with the output terminal of the operational amplifier. In the second processing, the connection switching section connects one terminal of the third capacitor with the third node and connects the other terminal of the third capacitor with the output terminal of the operational amplifier.

In the grayscale voltage generation device described above, in the first processing, charge corresponding to an offset voltage is stored in the third capacitor. In the second processing, the charged third capacitor and the operational amplifier constitute a capacitance feedback amplifier. Hence, the amount of the voltage at the second capacitor is increased/decreased with the charge amount stored in the third capacitor before the voltage is output as the grayscale voltage. In other words, the value of the voltage at the second capacitor is increased/decreased with the offset voltage value before the voltage at the second capacitor is output as the grayscale voltage. In this way, an offset at the operational amplifier can be cancelled.

Preferably, the serial DAC further includes a third capacitor and an operational amplifier. The third capacitor has a capacitance value smaller than the capacitance value of the second capacitor. The operational amplifier is connected with the second node at one of its input terminals and connected with its output terminal via the third capacitor at the other input terminal.

In the grayscale voltage generation device described above, the grayscale voltage value can be increased/decreased by adjusting the capacitance value of the third capacitor. This makes it possible to raise the amplitude of a driving voltage, which has failed to reach the reference voltage amplitude level, to a desired level without the necessity of increasing the process resistance. Hence, the dynamic range can be widened, and thus a high-quality liquid crystal panel can be implemented.

Preferably, the serial DAC includes a first capacitor and a second capacitor. The first capacitor stores therein a charge corresponding to the potential difference between the first reference voltage and the second reference voltage according to the grayscale information. The second capacitor is connected in parallel with the first capacitor at predetermined timing.

According to another aspect of the invention, a display panel driver for driving a display panel is provided. The display panel driver includes a first line, a second line, a plurality of serial DACs and a plurality of output terminals. A first reference voltage having a first voltage value is supplied to the first line. A second reference voltage having a second voltage value is supplied to the second line. Each of the plurality of serial DACs receives grayscale information representing a grayscale level and generates a grayscale voltage having a voltage value corresponding to the grayscale information using the reference voltages supplied to the first and second lines. Each of the plurality of output terminals outputs either one of the grayscale voltages generated by the plurality of serial DACs.

According to yet another aspect of the invention, a display is provided. The display includes a first line, a second line, a plurality of serial DACs and a display panel. A reference voltage having a first voltage value is supplied to the first line. A second reference voltage having a second voltage value is supplied to the second line. Each of the plurality of serial DACs receives grayscale information representing a grayscale level and generates a grayscale voltage having a voltage value corresponding to the grayscale information using the reference voltages supplied to the first and second lines. The display panel receives the grayscale voltages generated by the plurality of serial DACs.

BRIEF DESCRIPTION OF THE DRAWINGS

FIG. 17 is a table showing the relationship between display data and the values of voltages at capacitors C1 and C2.

DESCRIPTION OF THE PREFERRED EMBODIMENTS

Figure 1:
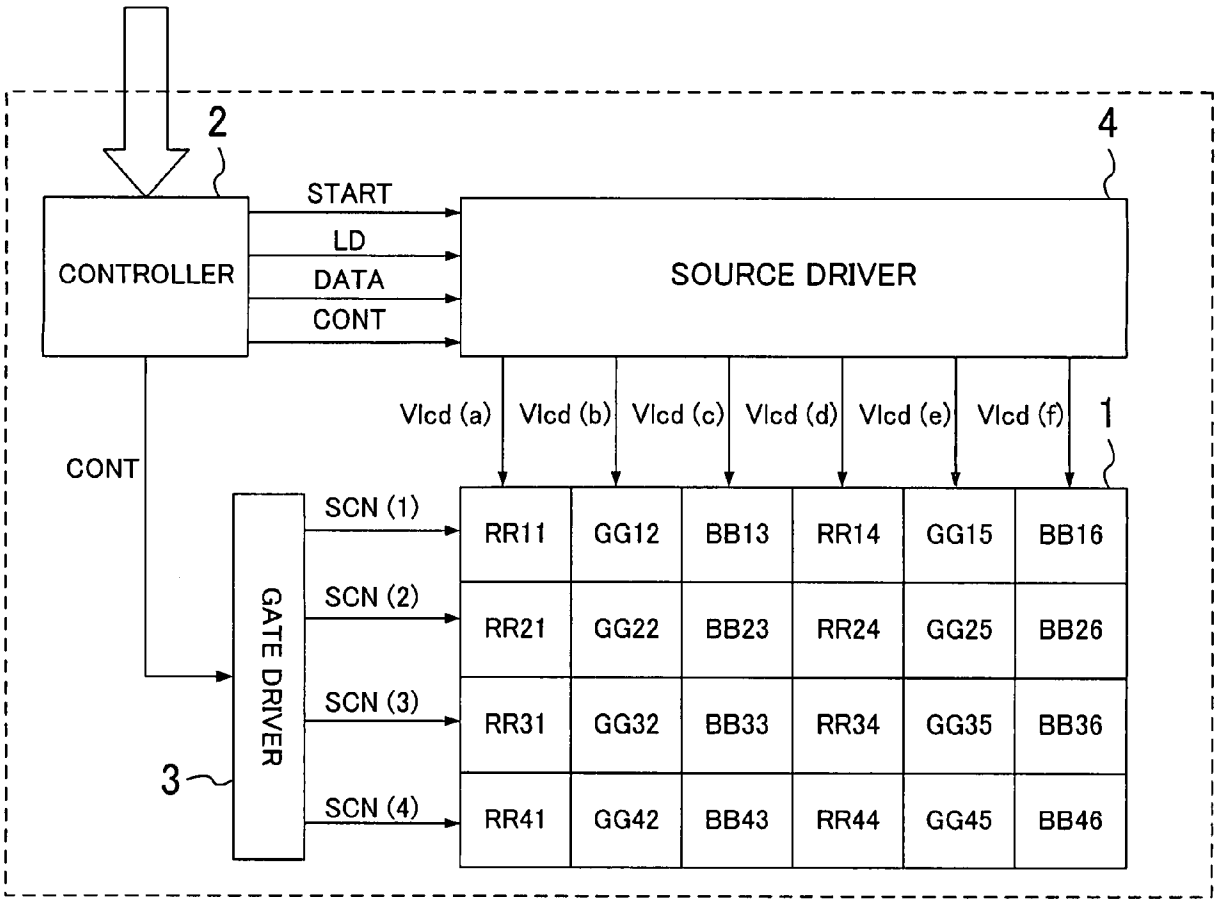
FIG. 1 is a block diagram of an LCD of Embodiment 1 of the present invention.

Hereinafter, preferred embodiments of the present invention will be described in detail with reference to the accompanying drawings. The same or equivalent components are denoted by the same reference numerals throughout the figures, and the description thereof is not repeated.

Embodiment 1

<Entire Configuration>

FIG. 1 shows an entire configuration of an LCD of Embodiment 1 of the present invention. The LCD includes a liquid crystal panel 1, a controller 2, a gate driver 3 and a source driver (liquid crystal driver) 4. The liquid crystal panel 1 is driven by dot inversion driving according to various external signals.

The liquid crystal panel 1 has liquid crystal (LC) elements arranged in a matrix. The LC elements transmit light of grayscale levels corresponding to the values of grayscale voltages Vlcd(a) to Vlcd(f) applied from the source driver 4. The LC elements include LC elements responsible for the red component (LC elements RR), LC elements responsible for the green component (LC elements GG) and LC elements responsible for the blue component (LC elements BB) arranged in a matrix. One LC element RR, one LC element GG and one LC element BB constitute one pixel. In this embodiment, assume that 4 (vertical)×6 (horizontal) LC elements are arranged in the liquid crystal panel.

The controller 2 receives various signals (display data DATA, frame information, display timing information and the like) externally, and outputs a control signal CONT to the gate driver 3 and the display data DATA, the control signal CONT, a start signal START and a load signal LD to the source driver 4.

The gate driver 3 outputs scanning signals SCN(1) to SCN (4) to the liquid crystal panel 1 according to the control signal CONT output from the controller 2, to activate the LC elements in the liquid crystal panel 1 every horizontal line of LC elements. For example, when the scanning signal SCN(1) is input, LC elements RR 11, GG12, BB13, RR14, GG15 and BB16 in the liquid crystal panel 1 are activated.

The source driver 4 outputs grayscale voltages Vlcd(a) to Vlcd(f) according to the display data DATA output from the controller 2. The grayscale voltages Vlcd(a) to Vlcd(f) are applied to the LC elements in the liquid crystal panel 1 that are active at the time of application.

<Drive Method>

The LC elements in the liquid crystal panel 1 change their transmission/shading amounts with the potential difference. Therefore, the LC elements are driven as long as there is a potential difference with respect to the common potential, irrespective of whether the polarity of the grayscale voltage applied is positive or negative. However, if voltages of the same polarity are continuously applied to an LC element, the LC element may keep transmitting light for a while even after the voltage application is stopped (this phenomenon is called "image persistence").

As drive methods that can prevent the above phenomenon, known are horizontal line inversion driving in which the polarity of grayscale voltages applied to LC elements is inverted every horizontal line, vertical line inversion driving in which the polarity is inverted every vertical line, and dot inversion driving in which the polarity is inverted every pixel. It is known that by driving the LC elements by any of the above drive methods, reduction in flickering and other effects for improvement of display quality can be obtained.

<Source Driver>

Figure 2:
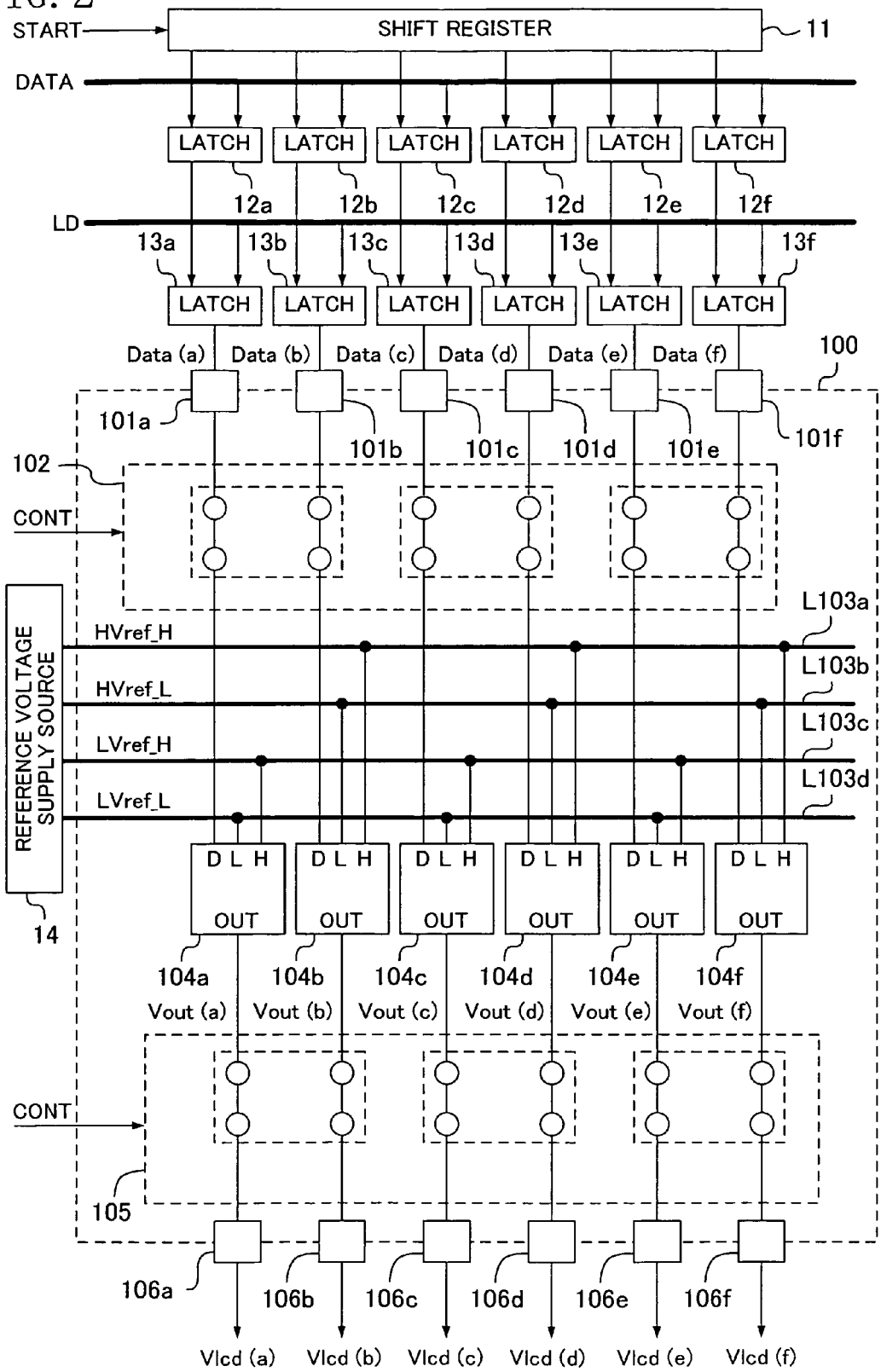
FIG. 2 is a view showing a configuration of a source driver in FIG. 1.

FIG. 2 shows an internal configuration of the source driver 4 in FIG. 1. The source driver 4 includes a shift register 11, latches 12*a* to 12*f* and 13*a* to 13*f*, a reference voltage supply source 14 and a grayscale voltage generation section 100. The shift register 11 sequentially shifts the start signal START received from the controller 2 in synchronization with a predetermined clock, to output latch timing signals to the latches 12*a* to 12*f*. The latches 12*a* to 12*f* capture and hold display data Data(a) to Data(f), out of the display data DATA from the controller 2, in synchronization with the latch timing signals from the shift register 11. Each of the display data Data(a) to Data(f) is bit data representing the grayscale level of each of three components (R, G and B components) constituting one pixel. The latches 13*a* to 13*f* capture and hold the display data Data(a) to Data(f) held by the latches 12*a* to 12*f* and outputs the captured display data Data(a) to Data(f) to the grayscale voltage generation section 100, in synchronization with the load signal LD from the controller 2. The reference voltage supply source 14 generates reference voltages HVref_H, HVref_L, LVref_H and LVref_L from a voltage received from an internal voltage source (not shown), and supplies the generated reference voltages to the grayscale voltage generation section 100. The reference voltages HVref_H and HVref_L are used for generation of grayscale voltages of positive polarity, while the reference voltages LVref_H and LVref_L are used for generation of grayscale voltages of negative polarity. Assume in this embodiment that the reference voltage HVref_H is about 10 V, HVref_L is about 5 V, LVref_H is about 5 V, and LVref_L is about 0 V. The grayscale voltage generation section 100 generates output voltages Vout (a) to Vout(f) having values corresponding to the grayscale levels (bit values) of the display data Data(a) to Data(f) received from the latches 13*a* to 13*f*, using the reference voltages HVref_H, HVref_L, LVref_H and LVref_L supplied from the reference voltage supply source 14, and outputs the generated output voltages to the liquid crystal panel 1 as grayscale voltages Vlcd(a) to Vlcd(f).

<Internal Configuration of Grayscale Voltage Generation Section 100>

The grayscale voltage generation section 100 includes input terminals 101*a* to 101*f*, selectors 102 and 105, voltage supply lines L103*a* to L103*d*, serial digital analog converters (DACs) 104*a* to 104*f* and output terminals 106*a* to 106*f*.

The input terminals 101*a* to 101*f* receive the display data Data(a) to Data(f) output from the latches 13*a* to 13*f*. Each of the display data Data(a) to Data(f) is composed of bit values representing a grayscale level.

The selector 102 switches the connections between the input terminals 101*a* to 101*f* and the serial DACs 104*a* to 104*f* according to the control signal CONT.

The voltage supply lines L103*a* to L103*d* are provided to supply the reference voltages HVref_H, HVref_L, LVref_H and LVref_L from the reference voltage supply source 14 to the serial DACs 104*a* to 104*f*.

In each of the serial DACs 104*a*, 104*c* and 104*e*, terminal D is connected to the selector 102, terminal H to the voltage supply line L103*c*, and terminal L to the voltage supply line L103*d*. In each of the serial DACs 104*b*, 104*d* and 104*f*, terminal D is connected to the selector 102, terminal H to the voltage supply line L103*a*, and terminal L to the voltage supply line L103*b*.

The serial DACs 104*a* to 104*f* receive the display data Data(a) to Data(f) from the latches 13*a* to 13*f* connected thereto via the selector 102, and outputs the output voltages Vout(a) to Vout(f) having values corresponding to the grayscale levels (bit values) of the received display data Data(a) to Data(f) using the reference voltages LVref_H and LVref_L supplied to the voltage supply lines L103*c* and L103*d* (or the reference voltages HVref_H and HVref_L supplied to the voltage supply lines L103*a* and L103*b*).

The selector 105 switches the connections between the serial DACs 104*a* to 104*f* and the output terminals 106*a* to 106*f* according to the control signal CONT.

The output terminals 106*a* to 106*f* receive the output voltages Vout(a) to Vout(f) from the serial DACs connected thereto via the selector 105, and output the received output voltages to the liquid crystal panel as the grayscale voltages Vlcd(a) to Vlcd(f).

The output terminals 106*a* to 106*f* have one-to-one correspondence with the vertical lines of the liquid crystal panel 1. For example, the output terminal 106*a* corresponds to the vertical line of LC elements starting from RR11 (RR11, RR21, RR31 and RR41). The grayscale voltages Vlcd(a) to Vlcd(f) output from the output terminals 106*a* to 106*f* are applied to any LC elements in the corresponding vertical lines that are in the activated state. For example, the grayscale voltage Vlcd(a) output from the output terminal 106*a* is applied to any LC element in the vertical line of LC elements starting from RR11 (RR11, RR21, RR31 and RR41) that is in the activated state.

<Internal Configuration of Serial DAC>

The serial DACs 104*a* to 104*f* shown in FIG. 2 will be described. Since the serial DACs 104*a* to 104*f* are substantially identical in configuration to one another, the serial DAC 104*a* will be described representatively with reference to FIG. 3A.

The serial DAC 104*a* includes a switch controller SWC101, switches SW1 to SW5, and capacitors C1 and C2. In the serial DAC 104*a*, a voltage corresponding to the potential difference between the reference voltage input at the terminal H and the reference voltage input at the terminal L is applied to the capacitor C1 to thereby sample a charge corresponding to the applied voltage in the capacitor C1. The sampled charge is then averaged with the capacitors C1 and C2. Such sampling and averaging are repeated to generate the output voltage Vout(a).

The switch controller SWC101 turns ON/OFF the switches SW1 to SW5 according to the bit values of the display data Data(a) input at the terminal D from the latch 13*a*. The capacitors C1 and C2 have a capacitance value identical to each other. The capacitor C1 is provided to sample a charge corresponding to the potential difference between the reference voltage input at the terminal H and the reference voltage input at the terminal L. The capacitor C2 is provided to distribute the charge stored in the capacitor C1. The switch SW1 is provided to connect the terminal H to node N1 that is connected with one terminal of the capacitor C1. The switch SW2 is provided to connect the node N1 and node N2 that is connected with one terminal of the capacitor C2. The switch SW3 is provided to release charge Q(C1) stored in the capacitor C1. The switch SW4 is provided to output voltage V(C2) at the capacitor C2 as the output voltage Vout(a). The switch SW5 is provided to release charge Q(C2) stored in the capacitor C2.

<Operation of Serial DAC>

The operation of the serial DAC 104*a* shown in FIG. 3A will be described with reference to FIGS. 4A and 4B. In this description, assume that display data Data(a) having bit values of "1101" is supplied to the terminal D, reference voltage VREF (voltage value VREF) is supplied to the terminal H, and reference voltage GND (voltage value 0) is i s supplied to the terminal L. Assume also that the charges stored in the capacitors C1 and C2 are both zero (initial state).

Figure 3A:
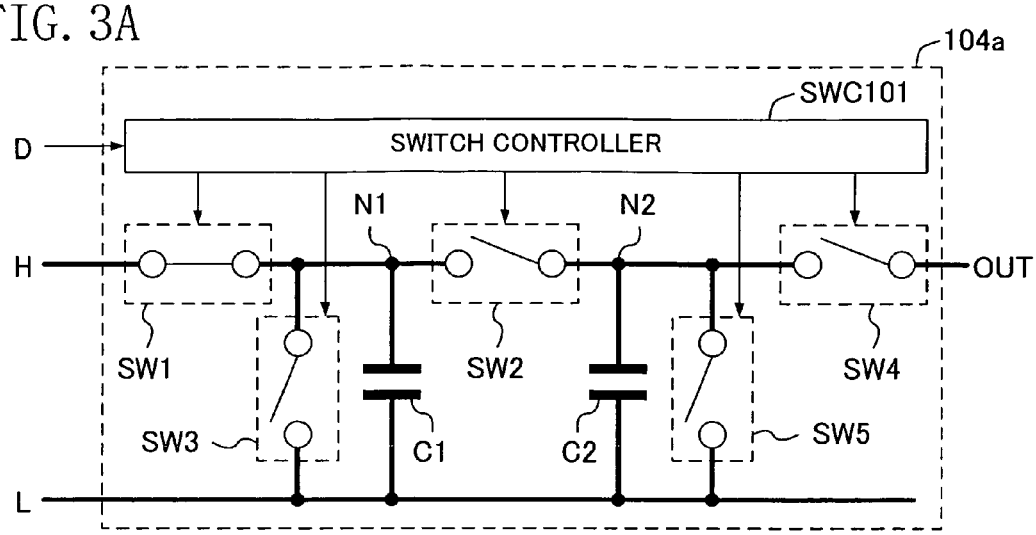
FIGS. 3A to 3C are views for demonstrating a serial DAC in FIG. 2.
Figure 4A:
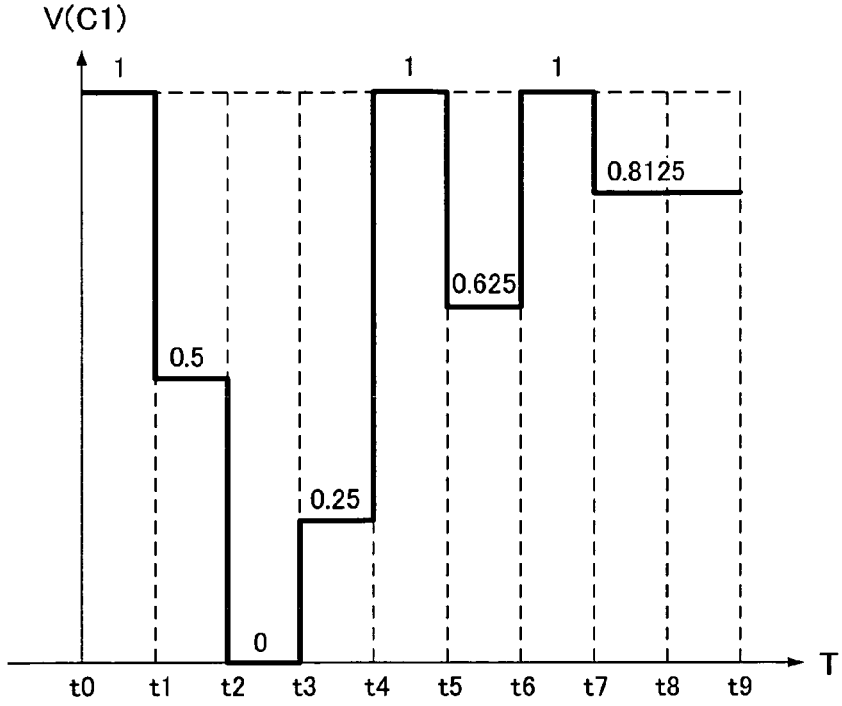
FIGS. 4A and 4B are views for demonstrating an operation of the serial DAC in FIG. 2.
Figure 4B:
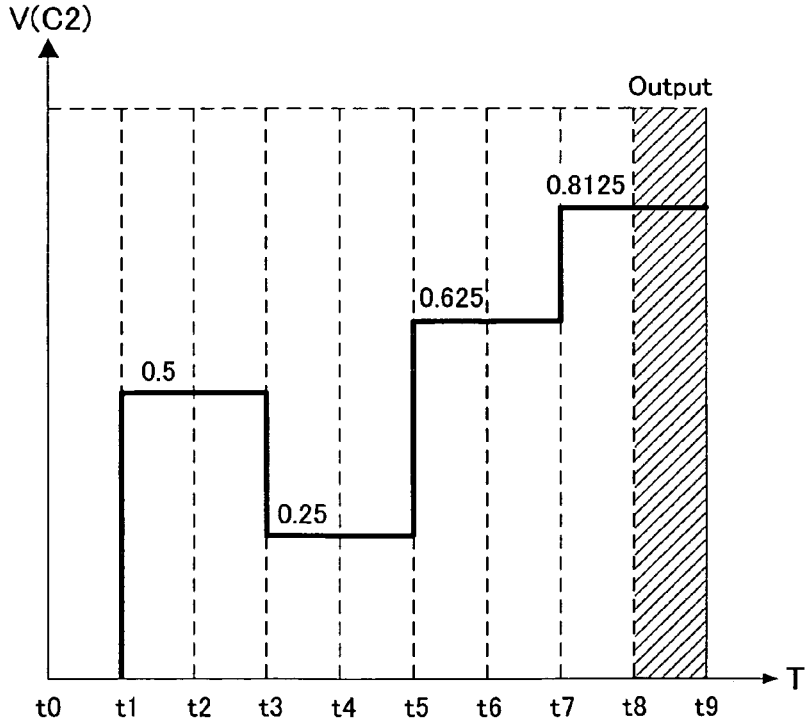

In time t0 to t1, the switch controller SWC101 turns ON the switch SW1 and turns OFF the other switches SW2 to SW5 because the least significant bit of the input display data Data(a) is "1" (see FIG. 3A). In this state, voltage V(C1)

corresponding to the potential difference between the reference voltage VREF supplied to the terminal H and the reference voltage GND supplied to the terminal L is applied across the capacitor C1, causing charge Q(C1) having an amount (Q=C1×VREF) corresponding to the value of the voltage V(C1) to be stored in the capacitor C1.

Figure 3B:
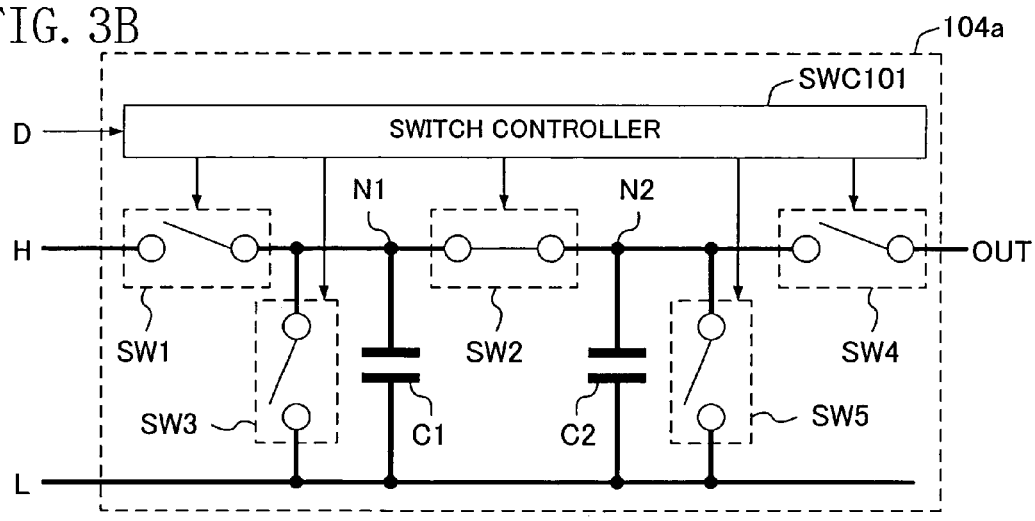

In time t1 to t2, the switch controller SWC101 turns OFF the switch SW1 and turns ON the switch SW2 while keeping OFF the other switches (see FIG. 3B). In this state, in which the capacitors C1 and C2 are connected in parallel, the charge Q(C1) stored in the capacitor C1 is distributed to the capacitor C2. The value of the voltage applied across the capacitors C1 and C2 is V=Q/(C1+C2). The capacitors C1 and C2 have the same capacitance value, that is, C1=C2. Hence, the voltage V(C1) at the capacitor C1 and the voltage V(C2) at the capacitor C2 are both a half of VREF (0.5VREF).

Figure 3C:
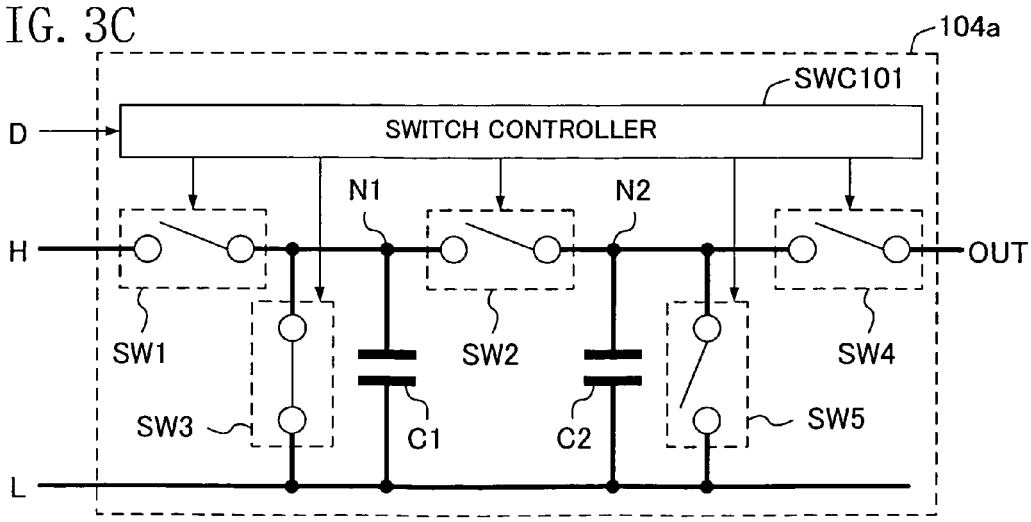

In time t2 to t3, the switch controller SWC101 turns ON the switch SW3 and turns OFF the other switches SW1, SW2, SW4 and SW5 because the second least significant bit of the input display data Data(a) is "0" (see FIG. 3C). This permits the charge Q(C1) stored in the capacitor C1 to flow toward the terminal L, and thus the voltage V(C1) at the capacitor C1 becomes "0".

In time t3 to t4, the switch controller SWC101 turns OFF the switch SW3 and turns ON the switch SW2 while keeping OFF the other switches (see FIG. 3B). In this state, in which the capacitors C1 and C2 are connected in parallel, the charge Q(C2) stored in the capacitor C2 is distributed to the capacitor C1. Hence, the voltage V(C1) at the capacitor C1 and the voltage V(C2) at the capacitor C2 are both a half of 0.5VREF (0.25VREF).

In time t4 to t5, the switch controller SWC101 turns ON the switch SW1 and turns OFF the other switches SW2 to SW5 because the third least significant bit of the input display data Data(a) is "1". Hence, the charge Q(C1) having an amount (Q=C1×VREF) corresponding to the value of the voltage V(C1) is stored in the capacitor C1.

In time t5 to t6, in which the switch controller SWC101 turns OFF the switch SW1 and turns ON the switch SW2, the charge Q(C1) stored in the capacitor C1 is distributed to the capacitor C2, and as a result, the amount of the charge Q(C1) stored in the capacitor C1 and the amount of the charge Q(C2) stored in the capacitor C2 are both Q=(1+0.25) ×VREF/2. Hence, the voltage V(C1) at the capacitor C1 and the voltage V(C2) at the capacitor C2 are both 0.625VREF.

In time t6 to t7, the switch controller SWC101 turns ON the switch SW1 and turns OFF the other switches SW2 to SW5 because the fourth least significant bit of the input display data Data(a) is "1". Hence, the charge Q(C1) having an amount (Q=C1×VREF) corresponding to the value of the voltage V(C1) is stored in the capacitor C1.

In time t7 to t8, the switch controller SWC101 turns OFF the switch SW1 and turns ON the switch SW2. As a result, both the amount of the charge Q(C1) stored in the capacitor C1 and the amount of the charge Q(C2) stored in the capacitor C2 become Q=(1+0.625)×VREF/2. Hence, the voltage V(C1) at the capacitor C1 and the voltage V(C2) at the capacitor C2 are both 0.8125VREF.

In time t8 to t9, the switch controller SWC101 turns OFF the switch SW2 and turns ON the switch SW4. Hence, the voltage V(C2) at the capacitor C2 is output to a downstream device as the output voltage Vout(a).

In the manner described above, the output voltage Vout(a) having a value corresponding to the display data Data(a) is output from the serial DAC 104*a*.

<Case of Outputting Same Data in Succession>

Next, the case that display data of "1101" is processed twice in succession will be described with reference to FIGS. 5A and 5B.

In time t1 to t9, processing substantially the same as that described above with reference to FIGS. 4A and 4B is performed, to output the voltage V(C2) at the capacitor C2 as the output voltage Vout(a) (time t8 to t9).

In time t9 to t10, the switch controller SWC101 turns ON the switch SW5 while turning OFF the switches SW2 and SW4. This permits the charge Q(C2) stored in the capacitor C2 to flow toward the terminal L, and thus the voltage V(C2) at the capacitor C2 becomes "0". Simultaneously, the switch controller SWC101 turns ON the switch SW1 because the least significant bit of the display data Data(a) is "1". Hence, the voltage V(C1) corresponding to the potential difference between the reference voltage VREF and the reference voltage GND is applied across the capacitor C1.

In time t10 to t18, processing substantially the same as that performed in time t2 to t9 described above is performed. As a result, in time t17 to t18, the voltage V(C2) at the capacitor C2 is output to a downstream device as the output voltage Vout (a).

As described above, in time t9 to t10, the charge Q(C2) stored in the capacitor C2 is released along with the sampling of charge in the capacitor C1.

<Operation of Grayscale Voltage Generation Section>

The operation of the grayscale voltage generation section 100 shown in FIG. 2 will be described. Assume that the selector 102 initially connects the input terminals 101*a*, 101*c* and 10*l*e to the serial DACs 104*a*, 104*c* and 104*e*, respectively, and connects the input terminals 101*b*, 101*d* and 101*f* to the serial DACs 104*b*, 104*d* and 104*f*, respectively. Assume also that the selector 105 initially connects the serial DACs 104*a*, 104*c* and 104*e* to the output terminals 106*a*, 106*c* and 106*e*, respectively, and connects the serial DACs 104*b*, 104*d* and 104*f* to the output terminals 106*b*, 106*d* and 106*f*, respectively.

[Before Switching of Connection]p The input terminals 101*a* to 101*f* receive the display data Data(a) to Data(f) from the latches 13*a* to 13*f* and output the received display data Data(a) to Data(f).

Since the input terminal 101*a* is connected to the serial DAC 104*a* via the selector 102, the serial DAC 104*a* receives the display data Data(a) output from the input terminal 101*a* at its terminal D.

The serial DAC 104*a* generates the output voltage Vout(a) having a value corresponding to the bit values of the received display data Data(a) using the reference voltage LVref_H supplied to the voltage supply line L103*c* and the reference voltage LVref_L supplied to the voltage supply line L103*d*.

Since the serial DAC 104*a* is connected to the output terminal 106*a* via the selector 105, the output terminal 106*a* receives the output voltage Vout(a) generated by the serial DAC 104*a* and outputs the received output voltage Vout(a) to the liquid crystal panel 1 as the grayscale voltage Vlcd(a).

Like the serial DAC 104*a*, the serial DACs 104*c* and 104*e* also receive the display data Data(c) and Data(e) from the input terminals 101*c* and 10*l*e at their terminals D, and generate the output voltages Vout(c) and Vout(e) having values corresponding to the bit values of the received display data Data(c) and Data(e) using the reference voltage LVref_H supplied to the voltage supply line L103*c* and the reference voltage LVref_L supplied to the voltage supply line L103*d*. Like the output terminal 106*a*, the output terminals 106*c* and 106*e* output the output voltages Vout(c) and Vout(e) generated by the serial DACs 104*c* and 104*e* to the liquid crystal panel 1 as the grayscale voltages Vlcd(c) and Vlcd(e).

Likewise, the serial DACs 104*b*, 104*d* and 104*f* generate the output voltages Vout(b), Vout(d) and Vout(f) having values corresponding to the bit values of the display data Data (b), Data(d) and Data(f) received from the input terminals 101*b*, 101*d* and 101*f*, using the reference voltage HVref_H supplied to the voltage supply line L103*a* and the reference voltage HVref_L supplied to the voltage supply line L103*b*. The output terminals 106*b*, 106*d* and 106*f* output the output voltages Vout(b), Vout(d) and Vout(f) generated by the serial DACs 104*b*, 104*d* and 104*f* to the liquid crystal panel 1 as the grayscale voltages Vlcd(b), Vlcd(d) and Vlcd(f).

In the manner described above, the grayscale voltages Vlcd (a), Vlcd(c) and Vlcd(e) of negative polarity and the grayscale voltages Vlcd(b), Vlcd(d) and Vlcd(f) of positive polarity are output to the liquid crystal panel 1 alternately every vertical line.

[After Switching of Connection]

Once the display data DATA of one horizontal line has been processed, the controller 2 outputs the control signal CONT. The selector 102 switches the connection between the input terminals 101*a* to 101*f* and the serial DACs 104*a* to 104*f* in response to the control signal CONT output from the controller 2, so that the input terminals 101*a*, 101*c* and 10*l*e are connected to the serial DACs 104*b*, 104*d* and 104*f*, respectively, and the input terminals 101*b*, 101*d* and 101*f* are connected to the serial DACs 104*a*, 104*c* and 104*e*, respectively. Likewise, the selector 105 switches the connection between the serial DACs 104*a* to 104*f* and the output terminals 106*a* to 106*f* in response to the control signal CONT, so that the serial DACs 104*a*, 104*c* and 104*e* are connected to the output terminals 106*b*, 106*d* and 106*f*, respectively, and the serial DACs 104*b*, 104*d* and 104*f* are connected to the output terminals 106*a*, 106*c* and 106*e*, respectively.

The input terminals 101*a* to 101*f* then receive the display data Data(a) to Data(f) from the latches 13*a* to 13*f*, as was done before the switching of connection.

The serial DACs 104*b*, 104*d* and 104*f* generate the output voltages Vout(b), Vout(d) and Vout(f) having values corresponding to the bit values of the display data Data(a), Data(c) and Data(e) received from the input terminals 101*a*, 101*c* and 101*e*. The output terminals 106*a*, 106*c* and 106*e* output the output voltages Vout(b), Vout(d) and Vout(f) generated by the serial DACs 104*b*, 104*d* and 104*f* to the liquid crystal panel 1 as the grayscale voltages Vlcd(a), Vlcd(c) and Vlcd(e).

Likewise, the serial DACs 104*a*, 104*c* and 104*e* generate the output voltages Vout(a), Vout(c) and Vout(e) having values corresponding to the bit values of the display data Data (b), Data(d) and Data(f) received from the input terminals 101*b*, 101*d* and 101*f*. The output terminals 106*b*, 106*d* and 106*f* output the output voltages Vout(a), Vout(c) and Vout(e) generated by the serial DACs 104*a*, 104*c* and 104*e* to the liquid crystal panel 1 as the grayscale voltages Vlcd(b), Vlcd (d) and Vlcd(f).

As described above, the grayscale voltages Vlcd(a), Vlcd (c) and Vlcd(e) of positive polarity and the grayscale voltages Vlcd(b), Vlcd(d) and Vlcd(f) of negative polarity are output to the liquid crystal panel 1 alternately every vertical line.

<Output to Liquid Crystal Panel>

Figure 6A:
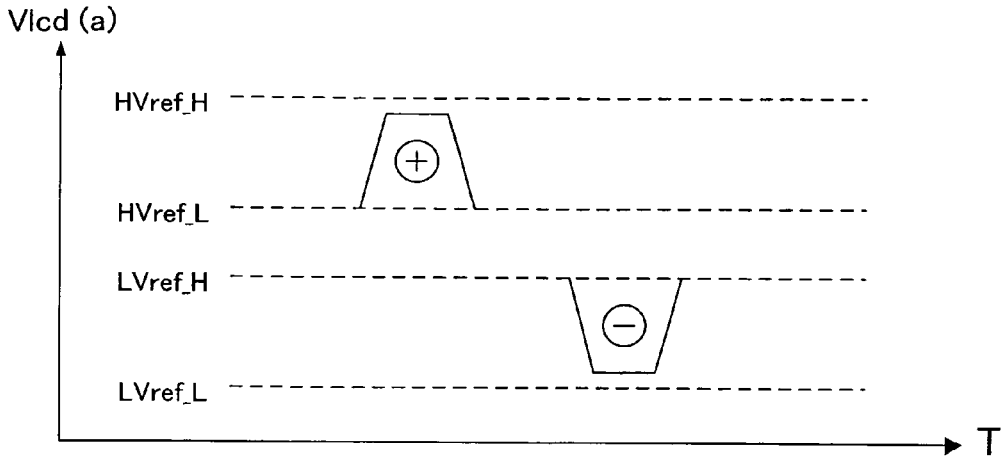
FIGS. 6A to 6C are views illustrating examples of dot inversion driving performed by the LCD of FIG. 1.
Figure 6B:
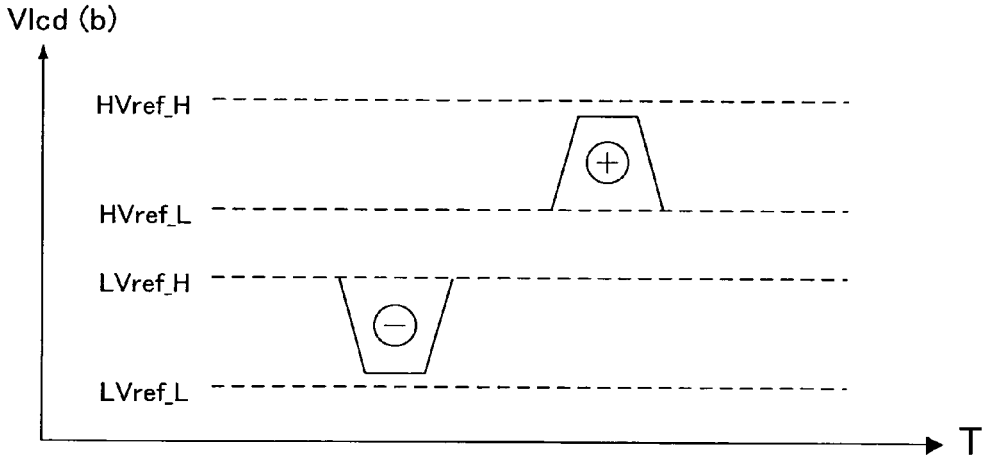

FIGS. 6A and 6B show output waveforms of the grayscale voltages Vlcd(a) and Vlcd(b) output from the output terminals 106*a* and 106*b*, respectively. The polarity of the grayscale voltage Vlcd(a) changes cyclically in the order of "+", "−", . . . while the polarity of the grayscale voltage Vlcd(b) changes cyclically in the order of "−", "+", . . . in reverse to the grayscale voltage Vlcd(a).

Figure 6C:
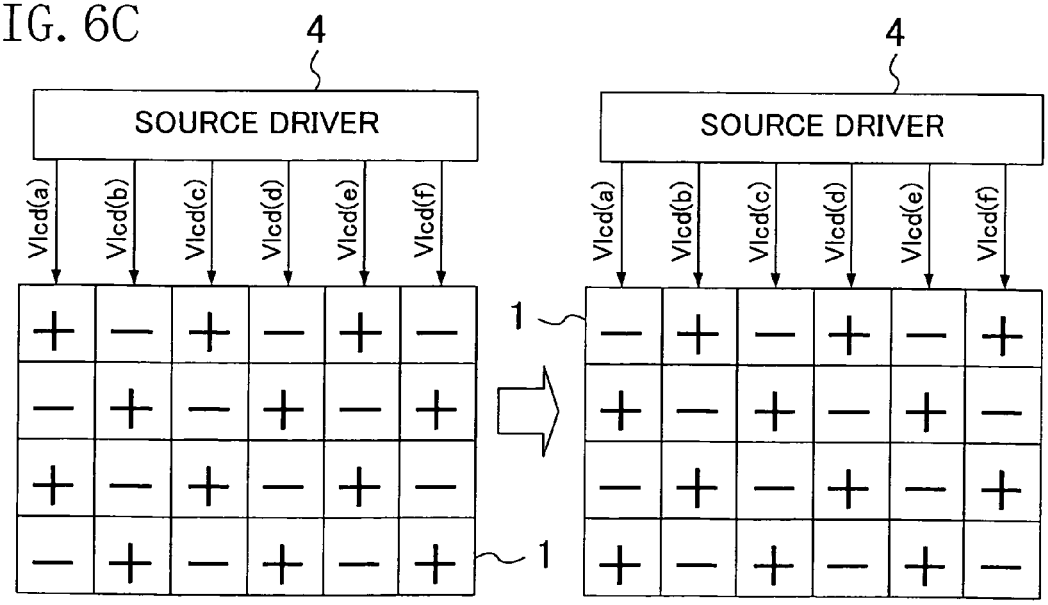

As described above, each of the serial DACs 104*a* to 104*f* is connected to voltage supply lines different from the voltage supply lines to which any serial DAC adjacent thereto is connected. Accordingly, each of the serial DACs 104*a* to 104*f* can generate an output voltage different in polarity from the output voltage generated by any serial DAC adjacent thereto. In other words, each of the LC elements in the liquid crystal panel 1 can receive a grayscale voltage different in polarity from the grayscale voltage applied to any LC element adjacent thereto. Furthermore, with the selectors 102 and 105 switching the connection of input terminal—serial DAC—output terminal every horizontal line (every scanning timing), the polarity of the grayscale voltages Vlcd(a) to Vlcd(f) output to the liquid crystal panel 1 can be switched every horizontal line. As a result, as shown in FIG. 6C, grayscale voltages different in polarity from each other are applied to every two adjacent LC elements in the liquid crystal panel 1. In this way, dot inversion driving is attained.

<Effect>

As described above, in the grayscale voltage generation section 100, a plurality of serial DACs are connected in parallel to a pair of voltage supply lines. Therefore, the number of voltage supply lines (the number of reference voltages) required for the serial DAC 104*a*, for example to generate the output voltage Vout(a) can be small compared with the case of the conventional R-DAC. Hence, in a grayscale voltage generation device and an LCD using such serial DACs, the area occupied by the voltage supply lines (the circuit scale) can be smaller than in a grayscale voltage generation device and an LCD using the conventional R-DACs.

The switches SW1 to SW5 in the serial DACs 104*b*, 104*d* and 104*f* (positive serial DACs) must have a breakdown voltage of 10V or higher. Accordingly, highly voltage-resistant transistors are preferably used for the switches SW1 to SW5. On the contrary, the switches SW1 to SW5 in the serial DACs 104*a*, 104*c* and 104*e* (negative serial DACs) are only required to be resistant to a voltage of about 5 V. Accordingly, general transistors which have a breakdown voltage of 5 V may be used for the switches SW1 to SW5.

In the LCD of this embodiment, the liquid crystal panel 1 is driven by dot inversion driving. Alternatively, the liquid crystal panel 1 can be driven by vertical line inversion driving. In this case, the controller 2 should output the control signal CONT every frame, not every horizontal line.

The number of serial DACs is not limited to six, but may be larger or smaller depending on the number of LC elements included in the liquid crystal panel 1.

The internal configuration of the serial DACs 104*a* to 104*f* is not limited to that shown in FIGS. 3A to 3C. Any other configuration may be adopted as long as it includes a first capacitor that stores a charge corresponding to the potential difference between two reference voltages according to display data DATA and a second capacitor connected in parallel with the first capacitor at predetermined timing.

The source driver 4 may be composed as one LSI, or may be integrated with the liquid crystal panel 1.

In the dot inversion liquid crystal driving, generally, the amplitude of a positive voltage and that of a negative voltage are both set at about 5V. Accordingly, in generation of positive and negative grayscale voltages at a time, the grayscale voltage generation section 100 must give an amplitude of 10V.

Embodiment 2

When the positive serial DACs 104*b*, 104*d* and 104*f* and the negative serial DACs 104*a*, 104*c* and 104*e* are composed of different transistor devices from each other, two different processes are necessary for formation of the positive serial DACs and the negative serial DACs. In addition, the areas of the positive serial DACs and the negative serial DACs fail to be uniform.

<Entire Configuration>

Figure 7:
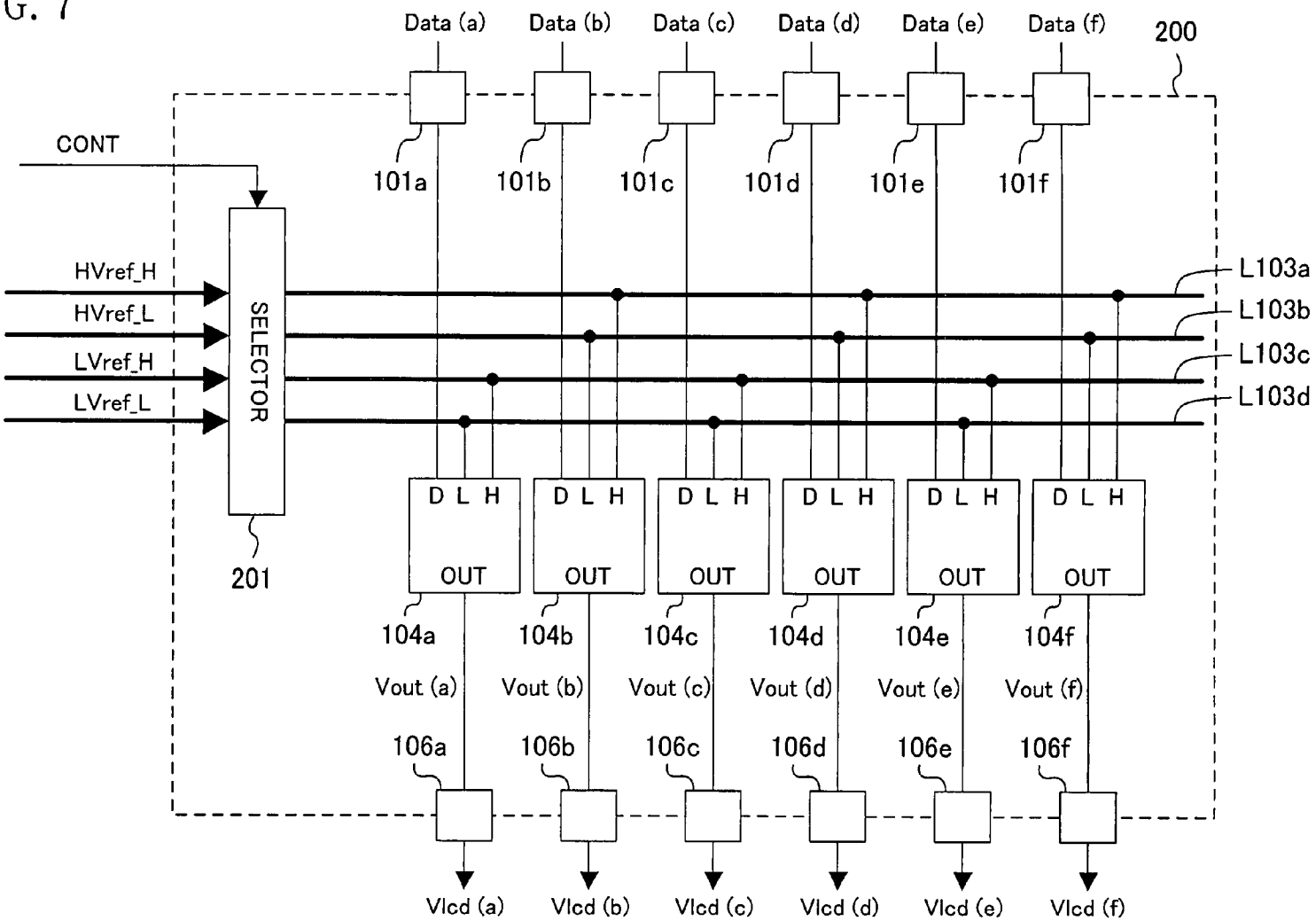
FIG. 7 is a view showing a configuration of a grayscale voltage generation section in Embodiment 2 of the present invention.

An LCD of Embodiment 2 of the present invention includes a grayscale voltage generation section 200 shown in FIG. 7 in place of the grayscale voltage generation section 100 shown in FIG. 2. The other configuration is substantially the same as that shown in FIGS. 1 and 2.

<Internal Configuration of Grayscale Voltage Generation Section 200>

The grayscale voltage generation section 200 of FIG. 7 includes a selector 201 in place of the selectors 102 and 105 shown in FIG. 2. The other configuration is substantially the same as that shown in FIG. 2.

The selector 201 supplies the reference voltages HVref_H, HVref_L, LVref_H and LVref_L received from the reference voltage supply source to the voltage supply lines L103*a* to L103*d* according to the control signal CONT output from the controller 2.

In the serial DACs 104*a*, 104*c* and 104*e*, the terminal D is connected to the input terminals 101*a*, 101*c* and 10*l*e, the terminal H to the voltage supply line L103*c*, the terminal L to the voltage supply line L103*d*, and the terminal OUT to the output terminals 106*a*, 106*c* and 106*e*. In the serial DACs 104*b*, 104*d* and 104*f*, the terminal D is connected to the input terminals 101*b*, 101*d* and 101*f*, the terminal H to the voltage supply line L103*a*, the terminal L to the voltage supply line L103*b*, and the terminal OUT to the output terminals 106*b*, 106*d* and 106*f*.

<Operation>

The operation of the grayscale voltage generation section 200 of FIG. 7 will be described. Assume that the selector 201 initially supplies the reference voltage HVref_H to the voltage supply line L103*a*, the reference voltage HVref_L to the voltage supply line L103*b*, the reference voltage LVref_H to the voltage supply line L103*c*, and the reference voltage LVref_L to the voltage supply line L103*d*.

[Before Switching of Connection]

Using the reference voltages LVref_H and LVref_L supplied to the voltage supply lines L103*c* and L103*d*, the serial DACs 104*a*, 104*c* and 104*e* generate the output voltages Vout(a), Vout(c) and Vout(e) having values corresponding to the bit values of the display data Data(a), Data(c) and Data(e) received from the input terminals 101*a*, 101*c* and 101*e*, and output the generated output voltages to the output terminals 106*a*, 106*c* and 106*e*.

Likewise, using the reference voltages HVref_H and HVref_L supplied to the voltage supply lines L103*a* and L103*b*, the serial DACs 104*b*, 104*d* and 104*f* generate the output voltages Vout(b), Vout(d) and Vout(f) having values corresponding to the bit values of the display data Data(b), Data(d) and Data(f) received from the input terminals 101*b*, 101*d* and 101*f*, and output the generated output voltages to the output terminals 106*b*, 106*d* and 106*f*.

The output terminals 106*a* to 106*f* output the output voltages Vout(a) to Vout(f) received from the serial DACs 104*a* to 104*f* as the grayscale voltages Vlcd(a) to Vlcd(f).

Thus, the grayscale voltages Vlcd(a), Vlcd(c) and Vlcd(e) of negative polarity and the grayscale voltages Vlcd(b), Vlcd (d) and Vlcd(f) of positive polarity are output to the liquid crystal panel 1 alternately every vertical line.

[After Switching of Connection]

Once the display data DATA of one horizontal line has been processed, the controller 2 outputs the control signal CONT. The selector 201 switches the correspondence between the reference voltages HVref_H, HVref_L, LVref_H and LVref_L and the voltage supply lines L103*a* to L103*d* in response to the control signal CONT. Specifically, the selector 201 supplies the reference voltage LVref_H to the voltage supply line L103*a*, LVref_L to the voltage supply line L103*b*, HVref_H to the voltage supply line L103*c*, and HVref_L to the voltage supply line L103*d*.

Using the reference voltages HVref_H and HVref_L supplied to the voltage supply lines L103*c* and L103*d*, the serial DACs 104*a*, 104*c* and 104*e* generate the output voltages Vout(a), Vout(c) and Vout(e) having values corresponding to the bit values of the display data Data(a), Data(c) and Data(e) received from the input terminals 101*a*, 101*c* and 10*l*e, and output the generated output voltages to the output terminals 106*a*, 106*c* and 106*e*.

Likewise, using the reference voltages LVref_H and LVref_L supplied to the voltage supply lines L103*a* and L103*b*, the serial DACs 104*b*, 104*d* and 104*f* generate the output voltages Vout(b), Vout(d) and Vout(f) having values corresponding to the bit values of the display data Data(b), Data(d) and Data(f) received from the input terminals 101*b*, 101*d* and 101*f*, and output the generated output voltages to the output terminals 106*b*, 106*d* and 106*f*.

The output terminals 106*a* to 106*f* output the output voltages Vout(a) to Vout(f) received from the serial DACs 104*a* to 104*f* as the grayscale voltages Vlcd(a) to Vlcd(f).

Thus, the grayscale voltages Vlcd(a), Vlcd(c) and Vlcd(e) of positive polarity and the grayscale voltages Vlcd(b), Vlcd (d) and Vlcd(f) of negative polarity are output to the liquid crystal panel 1 alternately every vertical line.

As described above, by switching the supply of the reference voltages HVref_H, HVref_L, LVref_H and LVref_L to the voltage supply lines L103*a* to L103*d* every horizontal line, the polarity of the grayscale voltages Vlcd(a) to Vlcd(d) output to the liquid crystal panel 1 can be changed every horizontal line, and thus dot inversion driving is attained.

<Effect>

As described above, since all of the serial DACs 104*a* to 104*f* are composed of transistor devices having the same voltage-resistant characteristic, the circuit scales of the serial DACs 104*a* to 104*f* can be made uniform. This enables uniform placement of the serial DACs 104*a* to 104*f* and thus the layout work can be done efficiently.

In the switching of the supply of the reference voltages HVref_H, HVref_L, LVref_H and LVref_L to the voltage supply lines L103*a* to L103*d*, it takes some time until the values of the reference voltages are stabilized. Therefore, the switching of the reference voltages is preferably performed during blanking times in the scanning periods. Also, the time taken until the reference voltages are stabilized can be shortened by matching the voltage supply lines L103*a* to L103*d* with each other. For example, by connecting a load resistance to each end of the voltage supply lines L103*a* to L103*d*, smooth rise/drop of the potential at the voltage supply lines L103*a* to L103*d* is attained.

Embodiment 3

With achievement of higher-definition liquid crystal panels, color reproducibility of the liquid crystal panels is increasingly recognized as an important factor. In view of this, in LCDs, it is required to adjust the grayscale characteristics for the three principle colors (RGB) individually in consideration of the characteristics of color filters and the human visibility characteristics.

<Entire configuration>

Figure 8:
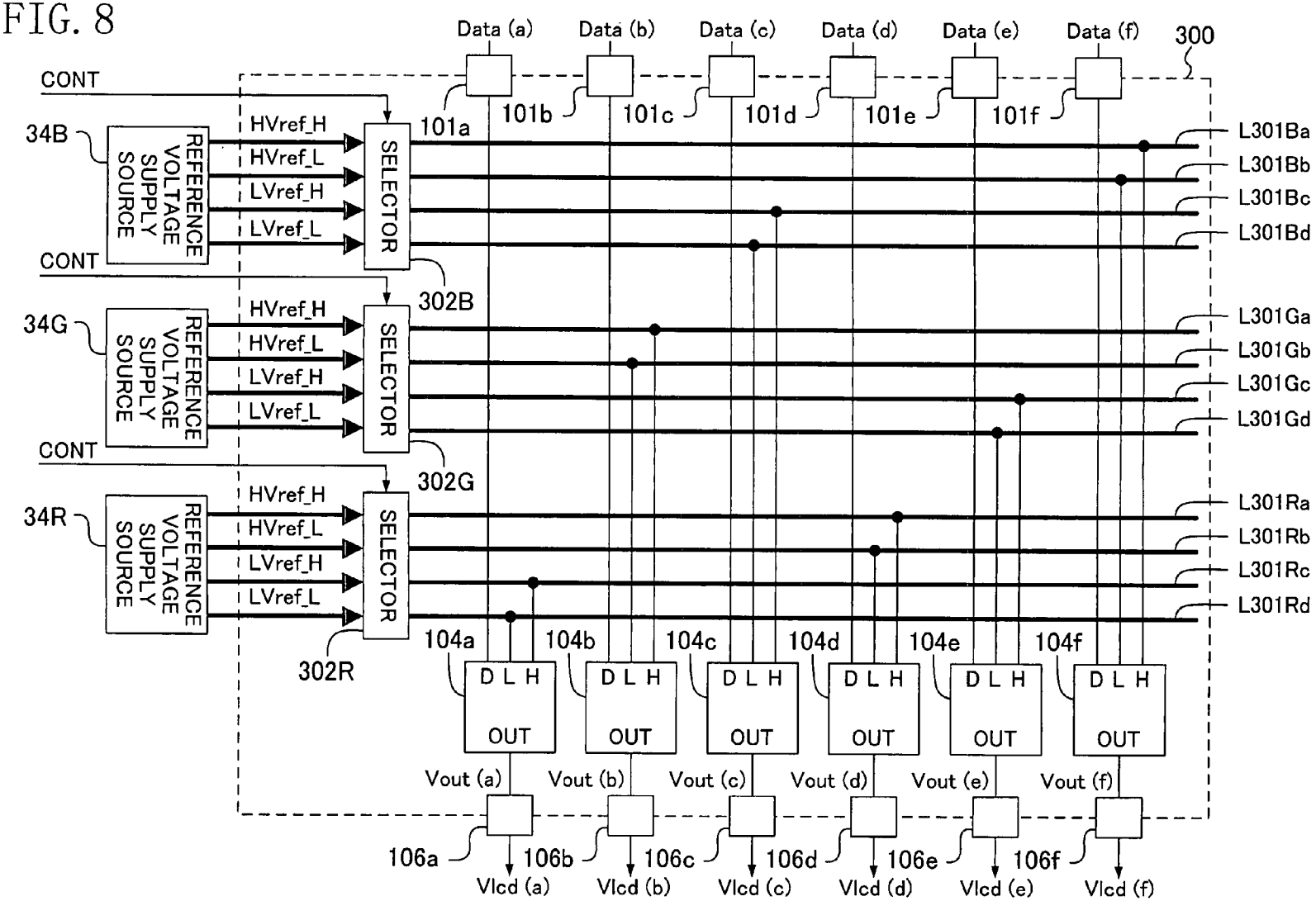
FIG. 8 is a view showing a configuration of a grayscale voltage generation section in Embodiment 3 of the present invention.

An LCD of Embodiment 3 of the present invention includes reference voltage supply sources 34R, 34G and 34B and a grayscale voltage generation section 300 shown in FIG. 8, in place of the reference voltage supply source 14 and the grayscale voltage generation section 100 shown in FIG. 2. The other configuration is substantially the same as that shown in FIGS. 1 and 2.

<Reference Voltage Supply Sources 34R, 34G and 34B>

The reference voltage supply source 34R shown in FIG. 8 supplies the reference voltages HVref_H, HVref_L, LVref_H and LVref_L used for generation of grayscale voltages for LC elements responsible for the red (R) component among the LC elements of the liquid crystal panel 1. The reference voltage supply source 34G supplies the reference voltages HVref_H, HVref_L, LVref_H and LVref_L used for generation of grayscale voltages for LC elements responsible for the green (G) component among the LC elements of the liquid crystal panel 1. The reference voltage supply source 34B supplies the reference voltages HVref_H, HVref_L, LVref_H and LVref_L used for generation of grayscale voltages for LC elements responsible for the blue (B) component among the LC elements of the liquid crystal panel 1.

The values of the reference voltages HVref_H, HVref_L, LVref_H and LVref_L supplied from the reference voltage supply sources 34R, 34G and 34B can be set individually. For example, the values of the reference voltages HVref_H, HVref_L, LVref_H and LVref_L supplied from the reference voltage supply source 34R are set so that the grayscale characteristics of the grayscale voltages Vlcd(a) and Vlcd(d) applied to LC elements RR (LC elements responsible for the red component) of the liquid crystal panel conform to the characteristics of the color filters.

<Internal Configuration of Grayscale Voltage Generation Section 300>

The grayscale voltage generation section 300 shown in FIG. 8 includes voltage supply lines L301Ra to L301Rd, L301Ga to L301Gd and L301Ba to L301Bd and selectors 302R, 302G and 302B, in place of the voltage supply lines L103*a* to L103*d* and the selectors 102 and 105 shown in FIG. 2. The other configuration is substantially the same as that shown in FIG. 2.

The voltage supply lines L301Ra to L301Rd are provided to supply the reference voltages HVref_H, HVref_L, LVref_H and LVref_L from the reference voltage supply source 34R. The voltage supply lines L301Ga to L301Gd are provided to supply the reference voltages HVref_H, HVref_L, LVref_H and LVref_L from the reference voltage supply source 34G. The voltage supply lines L301Ba to L301Bd are provided to supply the reference voltages HVref_H, HVref_L, LVref_H and LVref_L from the reference voltage supply source 34B.

The selector 302R supplies the reference voltages HVref_H, HVref_L, LVref_H and LVref_L received from the reference voltage supply source 34R to the voltage supply lines L301Ra to L301Rd according to the control signal CONT from the controller 2. The selector 302G supplies the reference voltages HVref_H, HVref_L, LVref_H and LVref_L received from the reference voltage supply source 34G to the voltage supply lines L301Ga to L301Gd according to the control signal CONT from the controller 2. The selector 302B supplies the reference voltages HVref_H, HVref_L, LVref_H and LVref_L received from the reference voltage supply source 34B to the voltage supply lines L301Ba to L301Bd according to the control signal CONT from the controller 2.

In the serial DAC 104*a*, the terminal D is connected to the input terminals 101*a*, the terminal L to the voltage supply line L301Rd, the terminal H to the voltage supply line L301Rc, and the terminal OUT to the output terminal 106*a*. In the serial DAC 104*b*, the terminal D is connected to the input terminals 101*b*, the terminal L to the voltage supply line L301Gb, the terminal H to the voltage supply line L301Ga, and the terminal OUT to the output terminal 106*b*. In the serial DAC 104*c*, the terminal D is connected to the input terminals 101*c*, the terminal L to the voltage supply line L301Bd, the terminal H to the voltage supply line L301Bc, and the terminal OUT to the output terminal 106*c*. In the serial DAC 104*d*, the terminal D is connected to the input terminals 101*d*, the terminal L to the voltage supply line L301Rb, the terminal H to the voltage supply line L301Ra, and the terminal OUT to the output terminal 106*d*. In the serial DAC 104*e*, the terminal D is connected to the input terminals 101*l*e, the terminal L to the voltage supply line L301Gd, the terminal H to the voltage supply line L301Gc, and the terminal OUT to the output terminal 106*e*. In the serial DAC 104*f*, the terminal D is connected to the input terminals 101*f*, the terminal L to the voltage supply line L301Bb, the terminal H to the voltage supply line L301Ba, and the terminal OUT to the output terminal 106*f*.

<Operation>

The operation of the grayscale voltage generation section 300 shown in FIG. 8 will be described.

[Before Switching of Connection]

The selector 302R first supplies the reference voltages HVref_H, HVref_L, LVref_H and LVref_L to the voltage supply lines L301Ra, L301Rb, L301Rc and L301Rd, respectively. Likewise, the selector 302G supplies the reference voltages HVref_H, HVref_L, LVref_H and LVref_L to the voltage supply lines L301Ga, L301Gb, L301Gc and L301Gd, respectively, and the selector 302B supplies the reference voltages HVref_H, HVref_L, LVref_H and LVref_L to the voltage supply lines L301Ba, L301Bb, L301Bc and L301Bd, respectively.

The serial DAC 104*a* generates the output voltage Vout(a) having a value corresponding to the bit values of the display data Data(a) using the reference voltages LVref_H and LVref_L supplied from the reference voltage supply source 34R to its terminals H and L (reference voltages having values adjusted to be used for the LC elements RR). The serial DAC 104*d* generates the output voltage Vout(d) having a value corresponding to the bit values of the display data Data(d) using the reference voltages HVref_H and HVref_L supplied from the reference voltage supply source 34R to its terminals H and L (reference voltages having values adjusted to be used for the LC elements RR). Likewise, the serial DACs 104*b* and 104*e* generate the output voltages Vout(b) and Vout(e) using the reference voltages HVref_H and HVref_L (or LVref_H and LVref_L) supplied from the reference voltage supply source 34G (reference voltages having values adjusted to be used for the LC elements GG). The serial DACs 104*c* and 104*f* generate the output voltages Vout(c) and Vout(f) using the reference voltages LVref_H and LVref_L (or HVref_H and HVref_L) supplied from the reference voltage supply source 34B (reference voltages having values adjusted to be used for the LC elements BB).

The output terminals 106*a* to 106*f* output the output voltages Vout(a) to Vout(f) received from the serial DACs 104*a* to 104*f* to the liquid crystal panel 1 as the grayscale voltages Vlcd(a) to Vlcd(f).

[After Switching of Connection]

Once the display data DATA of one horizontal line has been processed, the controller 2 outputs the control signal CONT to the selectors 302R, 302G and 302B.

Each of the selectors 302R, 302G and 302B switches the lines to which the reference voltages HVref_H, HVref_L, LVref_H and LVref_L are supplied in response to the control signal CONT from the controller 2. Specifically, the selector 302R supplies the reference voltage LVref_H to the voltage supply line L301Ra, LVref_L to the voltage supply line L301Rb, HVref_H to the voltage supply line L301Rc, and HVref_L to the voltage supply line L301Rd. Likewise, the selectors 302G and 302B respectively supply the reference voltage LVref_H to the voltage supply lines L301Ga and L301Ba, LVref_L to the voltage supply lines L301Gb and L301Bb, HVref_H to the voltage supply lines L301Gc and L301Bc, and HVref_L to the voltage supply lines L301Gd and L301Bd.

Thereafter, as in before the switching of connection, the serial DACs 104*a*to 104*f* respectively generate the output voltages Vout(a) to Vout(f) having values corresponding to the bit values of the display data Data(a) to Data(f) using the reference voltage HVref_H (or LVref_H) received at their terminals H and the reference voltage HVref_L (or LVref_L) received at their terminals L.

The output terminals 106*a* to 106*f* output the output voltages Vout(a) to Vout(f) received from the serial DACs 104*a* to 104*f* to the liquid crystal panel 1 as the grayscale voltages Vlcd(a) to Vlcd(f).

In the manner described above, the serial DACs 104*a* and 104*d* receive the reference voltages from the reference voltage supply source 34R (reference voltages having values adjusted to be used for the LC elements RR), the serial DACs 104*b* and 104*e* receive the reference voltages from the reference voltage supply source 34G (reference voltages having values adjusted to be used for the LC elements GG), and the serial DACs 104*c* and 104*f* receive the reference voltages from the reference voltage supply source 34B (reference voltages having values adjusted to be used for the LC elements BB).

<Effect>

As described above, with individual setting of the values of the reference voltages HVref_H, HVref_L, LVref_H and LVref_L in the reference voltage supply sources 34R, 34G and 34B, the grayscale characteristics can be corrected for the RGB colors individually. This permits individual gamma correction for RGB and thus enables high-quality display compared with the case in Embodiment 1.

To permit individual adjustment of the reference voltages for the RGB colors, 96 (32×3) voltage supply lines will be necessary for 4-bit data in conventional grayscale voltage generation devices and LCDs using R-DACs. In the grayscale voltage generation section in this embodiment, however, only 12 voltage supply lines are necessary. Therefore, in this embodiment, the area occupied by the voltage supply lines can be greatly reduced compared with the conventional grayscale voltage generation devices using R-DACs.

Embodiment 4

In the grayscale voltage generation section 100 shown in FIG. 2, the four reference voltages HVref_H, HVref_L, LVref_H and LVref_L are used for generation of the output voltages Vout(a) to Vout(f). However, the output voltages Vout(a) to Vout(f) can also be generated using three reference voltages, that is, the reference voltage GND as the common potential, a reference voltage Vref_H positive in polarity with reference to the reference voltage GND, and a reference voltage Vref_L negative in polarity with reference to the reference voltage GND.

<Entire Configuration>

Figure 9:
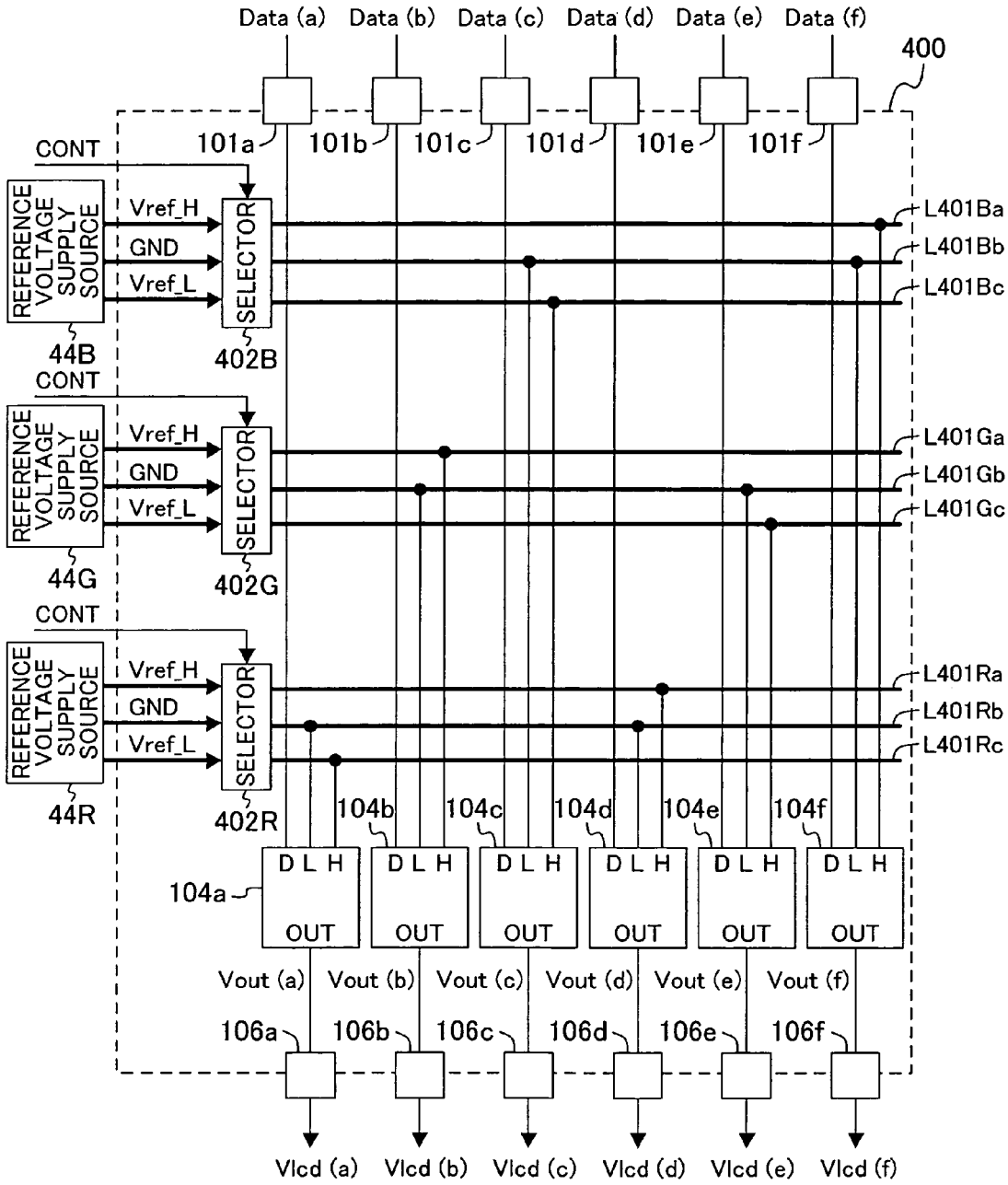
FIG. 9 is a view showing a configuration of a grayscale voltage generation section in Embodiment 4 of the present invention.

An LCD of Embodiment 4 includes reference voltage supply sources 44R, 44G and 44B and a grayscale voltage generation section 400 shown in FIG. 9, in place of the reference voltage supply source 14 and the grayscale voltage generation section 100 shown in FIG. 2. The other configuration is substantially the same as that in FIGS. 1 and 2.

<Reference Voltage Supply Sources 44R, 44G and 44B>

The reference voltage supply source 44R shown in FIG. 9 supplies the reference voltages Vref_H, GND and Vref_L used for generation of grayscale voltages for LC elements responsible for the red (R) component among the LC elements of the liquid crystal panel 1. The reference voltage supply source 44G supplies the reference voltages Vref_H, GND and Vref_L used for generation of grayscale voltages for LC elements responsible for the green (G) component among the LC elements of the liquid crystal panel 1. The reference voltage supply source 44B supplies the reference voltages Vref_H, GND and Vref_L used for generation of grayscale voltages for LC elements responsible for the blue (B) component among the LC elements of the liquid crystal panel 1.

The reference voltage Vref_H . which is positive in polarity with respect to the reference voltage GND, is used for generating a grayscale voltage of positive polarity. The reference voltage Vref_L, which is negative in polarity with respect to the reference voltage GND, is used for generating a grayscale voltage of negative polarity. Assume in this embodiment that the reference voltage GND is about 0 V, Vref_H is about 5 V, and Vref_L is about −5 V.

<Internal Configuration of Grayscale Voltage Generation Section 400>

The grayscale voltage generation section 400 shown in FIG. 9 includes voltage supply lines L401Ra to L401Rc, L401Ga to L401Gc and L401Ba to L401Bc and selectors 402R, 402G and 402B, in place of the voltage supply lines L301Ra to L301Rd, L301Ga to L301Gd and L301Ba to L301Bd and the selectors 302R, 302G and 302B shown in FIG. 8. The other configuration is substantially the same as that shown in FIG. 8.

The voltage supply lines L401Ra to L401Rc are provided to supply the reference voltages Vref_H, GND and Vref_L from the reference voltage supply source 44R. The voltage supply lines L401Ga to L401Gc are provided to supply the reference voltages Vref_H, GND and Vref_L from the reference voltage supply source 44G. The voltage supply lines L401Ba to L401Bc are provided to supply the reference voltages Vref_H, GND and Vref_L from the reference voltage supply source 44B.

The selector 402R supplies the reference voltages Vref_H, GND and Vref_L received from the reference voltage supply source 44R to the voltage supply lines L401Ra to L401Rc according to the control signal CONT from the controller 2. The selector 402G supplies the reference voltages Vref_H, GND and Vref_L received from the reference voltage supply source 44G to the voltage supply lines L401Ga to L401Gc according to the control signal CONT from the controller 2. The selector 402B supplies the reference voltages Vref_H, GND and Vref_L received from the reference voltage supply source 44B to the voltage supply lines L401Ba to L401Bc according to the control signal CONT from the controller 2.

In the serial DAC 104*a*, the terminal L is connected to the voltage supply line L401Rb, and the terminal H to the voltage supply line L401Rc. In the serial DAC 104*b*, the terminal L is connected to the voltage supply line L401Gb, and the terminal H to the voltage supply line L401Ga. In the serial DAC 104*c*, the terminal L is connected to the voltage supply line L401Bb, and the terminal H to the voltage supply line L401Bc. In the serial DAC 104*d*, the terminal L is connected to the voltage supply line L401Rb, and the terminal H to the voltage supply line L401Ra. In the serial DAC 104*e*, the terminal L is connected to the voltage supply line L401Gb, and the terminal H to the voltage supply line L401Gc. In the serial DAC 104*f*, the terminal L is connected to the voltage supply line L401Bb, and the terminal H to the voltage supply line L401Ba.

<Operation>

The operation of the LCD shown in FIG. 9 will be described.

[Before Switching of Connection]

The selector 402R first supplies the reference voltages Vref_H, GND and Vref_L to the voltage supply lines L401Ra, L401Rb and L401Rc, respectively. Likewise, the selector 402G supplies the reference voltages Vref_H, GND and Vref_L to the voltage supply lines L401Ga, L401Gb and L401Gc, respectively. The selector 402B supplies the reference voltages Vref_H, GND and Vref_L to the voltage supply lines L401Ba, L401Bb and L401Bc, respectively.

The serial DAC 104*a* generates the output voltage Vout(a) having a value corresponding to the bit values of the display data Data(a) using the reference voltages Vref_L and GND supplied from the reference voltage supply source 44R to its terminals H and L (reference voltages having values adjusted to be used for the LC elements RR). The serial DAC 104*d* generates the output voltage Vout(d) having a value corresponding to the bit values of the display data Data(d) using the reference voltages Vref_H and GND supplied from the reference voltage supply source 44R to its terminals H and L (reference voltages having values adjusted to be used for the LC elements RR). Likewise, the serial DACs 104*b* and 104*e* generate the output voltages Vout(b) and Vout(e) using the reference voltages Vref_H and GND (or Vref_L and GND) supplied from the reference voltage supply source 44G (reference voltages having values adjusted to be used for the LC elements GG). The serial DACs 104*c* and 104*f* generate the output voltages Vout(c) and Vout(f) using the reference voltages Vref_L and GND (or Vref_H and GND) supplied from the reference voltage supply source 44B (reference voltages having values adjusted to be used for the LC elements BB).

The output terminals 106*a* to 106*f* output the output voltages Vout(a) to Vout(f) received from the serial DACs 104*a* to 104*f* to the liquid crystal panel 1 as the grayscale voltages Vlcd(a) to Vlcd(f).

[After Switching of Connection]

Once the display data DATA of one horizontal line has been processed, the controller 2 outputs the control signal CONT.

Each of the selectors 402R, 402G and 402B switches the lines to which the reference voltages Vref_H and Vref_L are supplied in response to the control signal CONT from the controller 2. Specifically, the selector 402R supplies the reference voltage Vref_H to the voltage supply line L401Rc, GND to the voltage supply line L401Rb, and Vref_L to the voltage supply line L401Ra. Likewise, the selectors 402G and 402B respectively supply the reference voltage Vref_H to the voltage supply lines L401Gc and L401Bc, GND to the voltage supply lines L401Gb and L401Bb, and Vref_L to the voltage supply lines L401Ga and L401Ba.

Thereafter, as in before the switching of connection, the serial DACs 104*a* to 104*f* respectively generate the output voltages Vout(a) to Vout(f) having values corresponding to the bit values of the display data Data(a) to Data(f) using the reference voltage Vref_H (or Vref_L) received at their terminals H and the reference voltage GND received at their terminals L.

The output terminals 106*a* to 106*f* output the output voltages Vout(a) to Vout(f) received from the serial DACs 104*a* to 104*f* to the liquid crystal panel 1 as the grayscale voltages Vlcd(a) to Vlcd(f).

In the manner described above, the selectors 402R, 402G and 402B switch the lines to which the reference voltages Vref_H and Vref_L are supplied while keeping the supply line for the reference voltage GND unchanged.

<Effect>

As described above, in this embodiment, the area occupied by the voltage supply lines can be further reduced compared with the case of the grayscale voltage generation section 300 shown in FIG. 8.

Embodiment 5

With achievement of higher definition display, the amount of the display data DATA to be transmitted every fixed frame period (60 to 70 Hz) increases. Therefore, the transmission rate of the display data DATA must be increased. In this relation, to suppress the increase of the data transmission rate even slightly, it is necessary to utilize the scanning periods effectively while minimizing the blanking times. Hence, the time available for stabilizing the switching of reference voltages becomes shorter as the display definition is higher.

<Entire Configuration>

Figure 10:
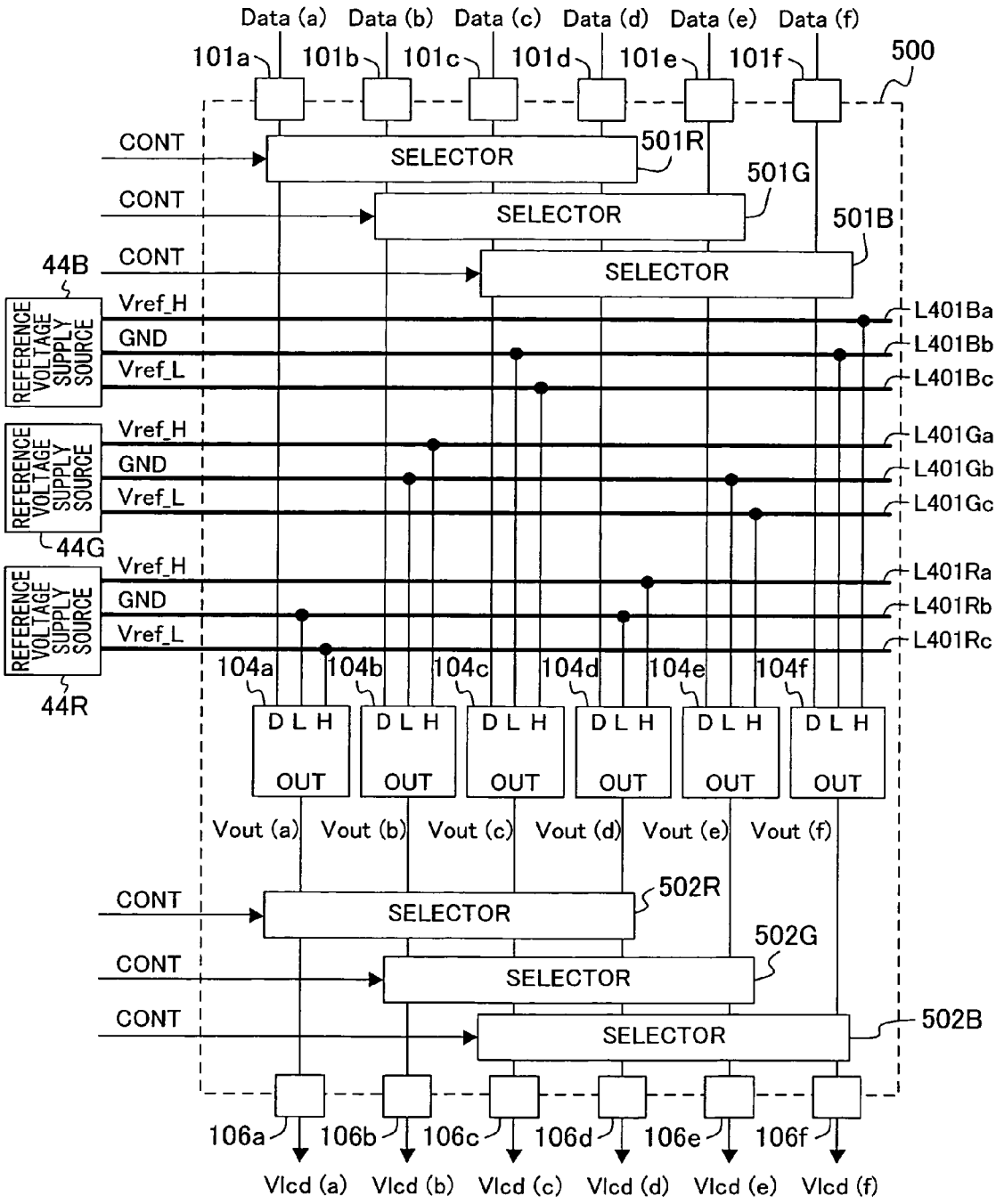
FIG. 10 is a view showing a configuration of a grayscale voltage generation section in Embodiment 5 of the present invention.

An LCD of Embodiment 5 of the present invention includes reference voltage supply sources 44R, 44G and 44B and a grayscale voltage generation section 500 shown in FIG. 10, in place of the reference voltage supply source 14 and the grayscale voltage generation section 100 shown in FIG. 2. The other configuration is substantially the same as that in FIGS. 1 and 2.

<Internal Configuration of Grayscale Voltage Generation Section 500>

The grayscale voltage generation section 500 shown in FIG. 10 includes selectors 501R, 501G, 501B, 502R, 502G and 502B, in place of the selectors 402R, 402G and 402B shown in FIG. 9. The other configuration is substantially the same as that in FIG. 9.

The selector 501R switches the connection between the input terminals 101*a* and 101*d* and the serial DACs 104*a* and 104*d* according to the control signal CONT from the controller 2. The selector 501G switches the connection between the input terminals 101*b* and 101*l*e and the serial DACs 104*b* and 104*e* according to the control signal CONT from the controller 2. The selector 501B switches the connection between the input terminals 101*c* and 101*f* and the serial DACs 104*c* and 104*f* according to the control signal CONT from the controller 2.

The selector 502R switches the connection between the serial DACs 104*a* and 104*d* and the output terminals 106*a* and 106*d* according to the control signal CONT from the controller 2. The selector 502G switches the connection between the serial DACs 104*b* and 104*e* and the output terminals 106*b* and 106*e* according to the control signal CONT from the controller 2. The selector 502B switches the connection between the serial DACs 104*c* and 104*f* and the output terminals 106*c* and 106*f* according to the control signal CONT from the controller 2.

<Operation>

The operation of the grayscale voltage generation section 500 shown in FIG. 10 will be described. The selectors 501R, 501G and 501B operate in substantially the same way, and the selectors 502R, 502G and 502B operate in substantially the same way. Herein, therefore, the operations of the selectors 501R and 502R will be described representatively.

First, the selector 501R connects the input terminal 101*a* to the serial DAC 104*a* and connects the input terminal 101*d* to the serial DAC 104*d*. The selector 502R connects the serial DAC 104*a* to the output terminal 106*a* and connects the serial DAC 104*d* to the output terminal 106*d*. As a result, the output terminal 106*a* receives the output voltage Vout(a) of negative polarity, and the output terminal 106*d* receives the output voltage Vout(d) of positive polarity. Accordingly, the grayscale voltage Vlcd(a) of negative polarity is output from the output terminal 106*a*, and the grayscale voltage Vlcd(d) of positive polarity is output from the output terminal 106*d*.

Once the display data DATA of one horizontal line has been processed, the controller 2 outputs the control signal CONT. In response to the control signal CONT, the selector 501R connects the input terminal 101*a* to the serial DAC 104*d* and connects the input terminal 101*d* to the serial DAC 104*a*. Also, in response to the control signal CONT, the selector 502R connects the serial DAC 104*d* to the output terminal 106*a* and connects the serial DAC 104*a* to the output terminal 106*d*. As a result, the output terminal 106*a* receives the output voltage Vout(d) of positive polarity, and the output terminal 106*d* receives the output voltage Vout(a) of negative polarity.

In the manner described above, the grayscale voltages Vlcd (a) and Vlcd(d) are inverted in polarity, not by switching the reference voltages Vref_H and Vref_L, but by switching the destinations of the output voltage Vout(a) of negative polarity output from the serial DAC 104*a* and the output voltage Vout(d) of positive polarity output from the serial DAC 104*d*.

<Effect>

As described above, since the polarity of the grayscale voltages Vlcd is controlled without switching the reference voltages, the serial DACs 104*a* to 104*f* can generate the output voltages Vout(a) to Vout(f) using stable reference voltages. Hence, with no time for stabilizing the reference voltages being necessary, the data transmission rate can be increased.

Embodiment 6

<Configuration>

An LCD of Embodiment 6 of the present invention includes serial DACs 600*a* to 600*f* in place of the serial DACs 104*a* to 104*f* shown in FIG. 2. The other configuration is substantially the same as that in FIGS. 1 and 2. Since the serial DACs 600*a* to 600*f* are substantially identical in configuration to one another, the serial DAC 600*a* will be described representatively with reference to FIG. 11A. The serial DAC 600*a* of FIG. 11A includes a switch controller SWC101, switches SW1 to SW4 and capacitors C1 and C2.

<Operation>

Figure 11A:
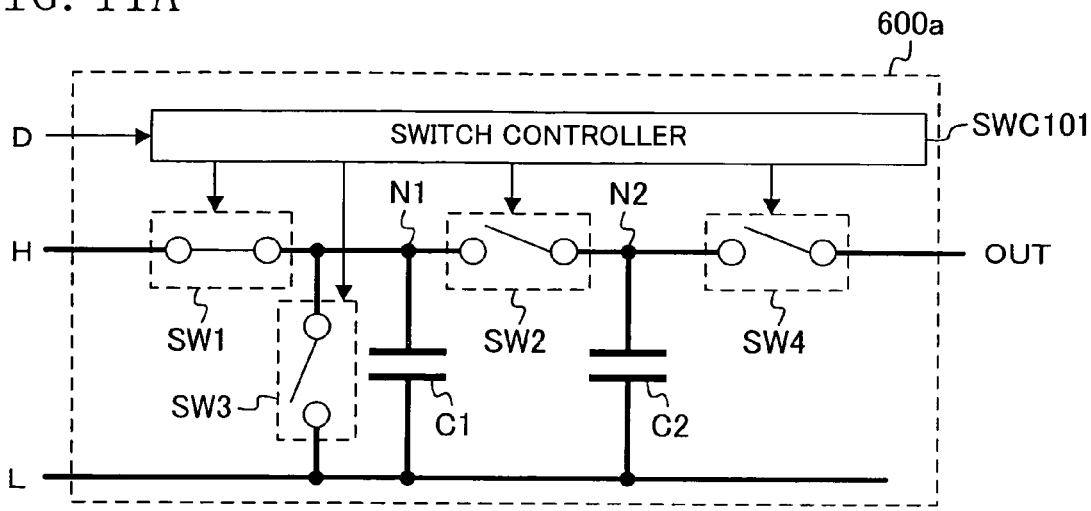
FIGS. 11A and 11B are views for demonstrating a serial DAC in Embodiment 6 of the present invention.
Figure 12A:
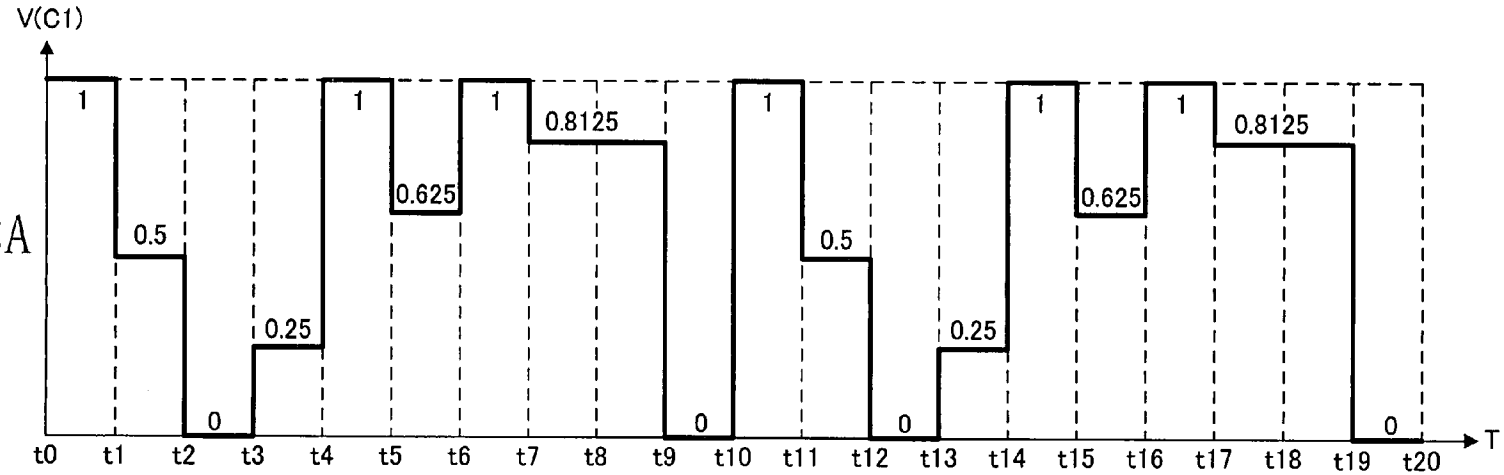
FIGS. 12A and 12B are views for demonstrating an operation of the serial DAC of FIG. 11A.
Figure 12B:
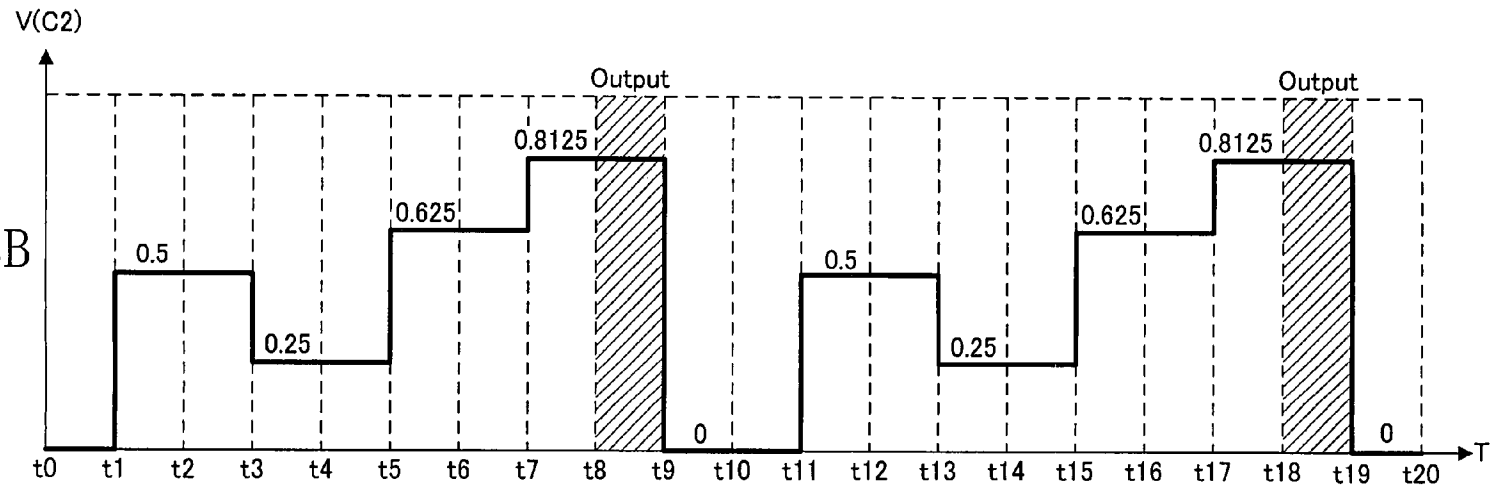

The operation of the serial DAC 600*a* shown in FIG. 11A will be described with reference to FIGS. 12A and 12B.

Figure 5A:
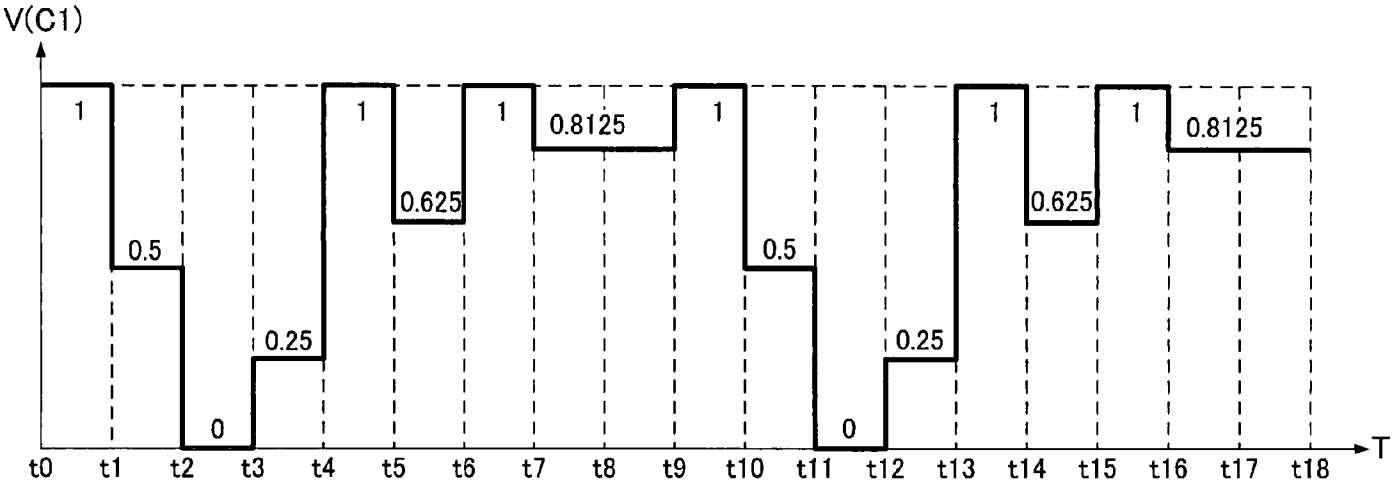
FIGS. 5A and 5B are views for demonstrating an operation of the serial DAC in FIG. 2.
Figure 5B:
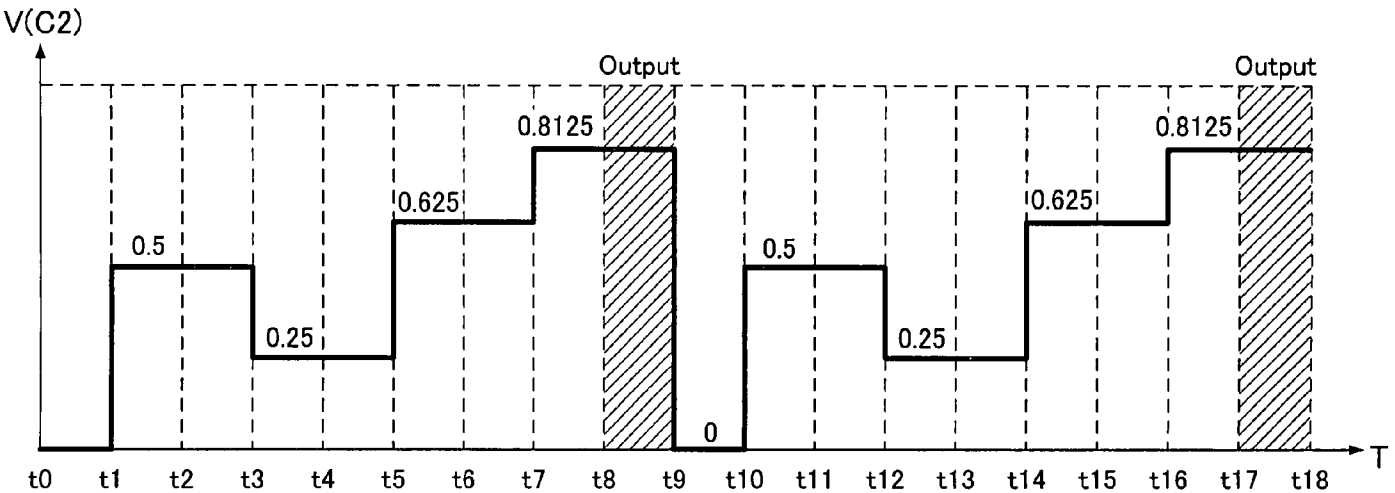

In time t0 to t9, substantially the same processing as that in the serial DAC 104*a* shown in FIGS. 5A and 5B is performed, and resultantly the voltage V(C2) at the capacitor C2 is output to a downstream device as the output voltage Vout(a).

Figure 11B:
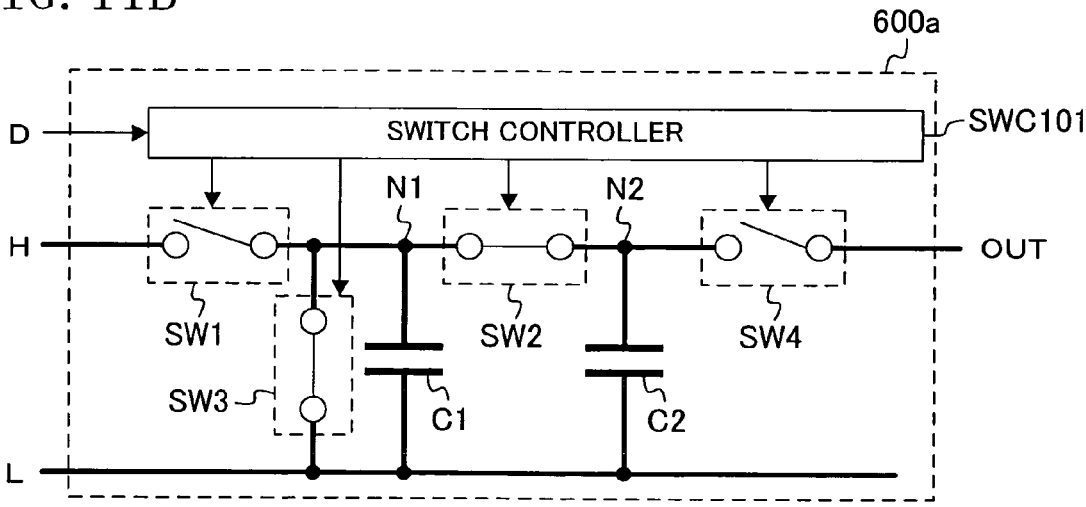

In time t9 to t10, the switch controller SWC101 turns ON the switches SW2 and SW3 while turning OFF the switch SW4 (see FIG. 11B). This allows the charge Q(C1) stored in the capacitor C1 and the charge Q(C2) stored in the capacitor C2 to flow toward the terminal L, and thus both the voltage V(C1) at the capacitor C1 and the voltage V(C2) at the capacitor C2 become "0".

In time t10 to t11, the switch controller SWC101 turns ON the switch SW1 and turns OFF the other switches SW2 to SW4 (see FIG. 11A) because the least significant bit of the input display data Data(a) is "1". Hence, the charge Q(C1) having an amount (Q=C1×VREF) corresponding to the value of the voltage V(C1) is stored in the capacitor C1.

In time t11 to t20, substantially the same processing as that in time t1 to t10 is performed.

As described above, the processing cycle increases by one step in the serial DAC 600*a* shown in FIG. 11A compared with the serial DAC 104*a* shown in FIG. 3A.

<Effect>

As described above, by providing a step for releasing the charge stored in the capacitor C2 (step dedicated to resetting) in the processing cycle for the serial DAC 600*a*, the switch SW5 in the serial DAC 104*a* can be omitted. This reduces the area occupied by the switches and also reduces the number of control signal lines for controlling the switches. In this way, a low-cost LCD can be implemented.

In the grayscale voltage generation sections shown in FIGS. 7, 8, 9 and 10, the serial DACs 600*a* to 600*f* in this embodiment can be used in place of the serial DACs 104*a* to 104*f*.

Embodiment 7

In the DACs 104*a* to 104*f* shown in FIG. 2, the switch SW3 is turned ON when a bit value of the display data Data is "0" to release the charge Q(C1) stored in the capacitor C1 (time t2 to t3 in FIG. 5A).

<Entire Configuration>

An LCD of Embodiment 7 of the present invention includes serial DACs 700*a* to 700*f* in place of the serial DACs 104*a* to 104*f* shown in FIG. 2. The other configuration is substantially the same as that shown in FIGS. 1 and 2. Since the serial DACs 700*a* to 700*f* are substantially identical in configuration to one another, the serial DAC 700*a* will be described representatively with reference to FIG. 13.

<Internal Configuration of Serial DAC 700*a*>

Figure 13:
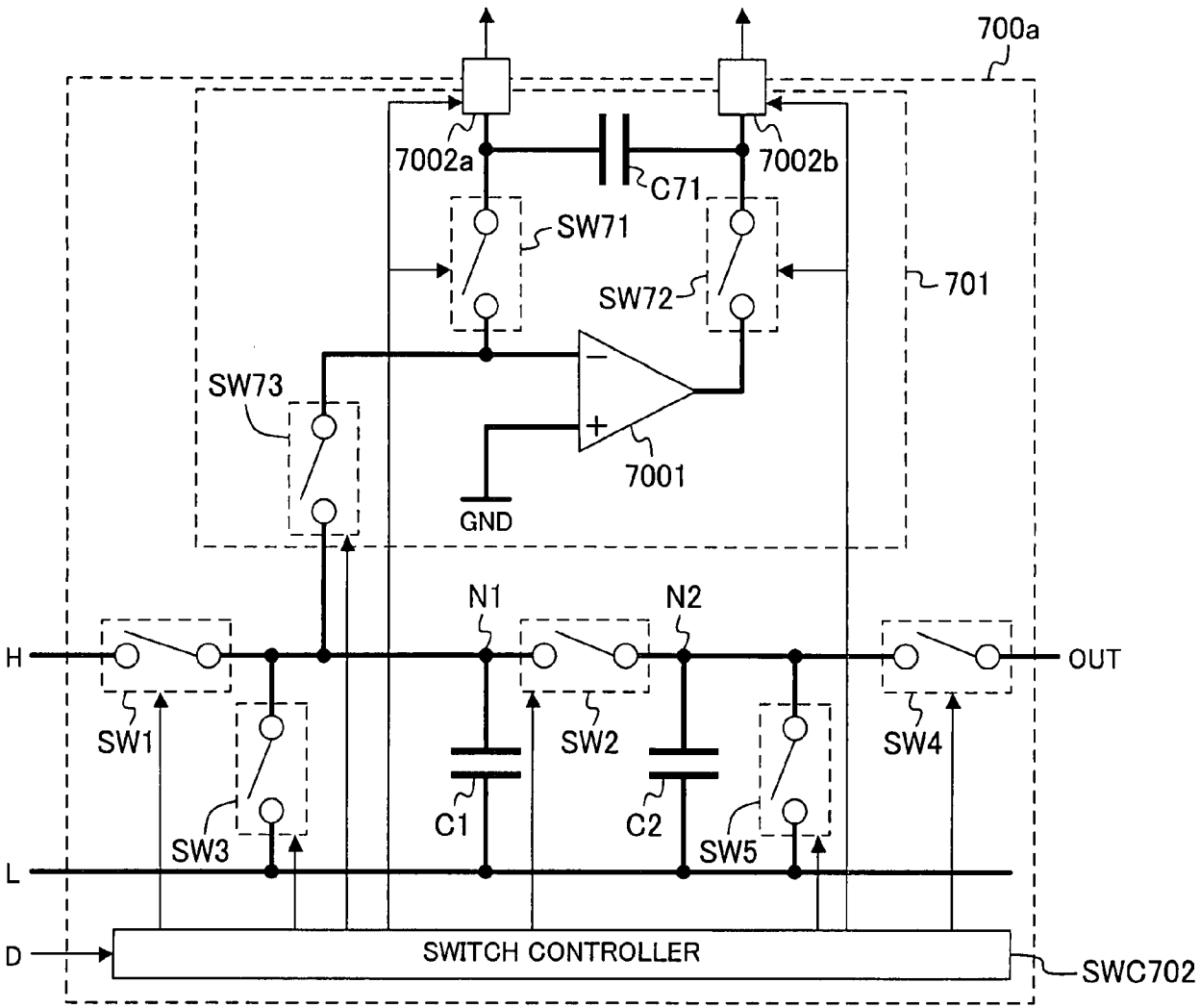
FIG. 13 is a view showing a configuration of a serial DAC in Embodiment 7 of the present invention.

The serial DAC 700*a* of FIG. 13 includes a charge recovery section 701 and a switch controller SWC702, in place of the switch controller SWC101 shown in FIG. 3A. The charge recovery section 701 includes switches SW71 to SW73, a capacitor C71, an operational amplifier 7001 and charge output terminals 7002*a* and 7002*b*. The charge recovery section 701 recovers the charge Q(C1) stored in the capacitor C1 and supplies the recovered charge to the outside.

The switch controller SWC702 turns ON/OFF the switches SW1 to SW5 and SW71 to SW73 according to the display data Data(a) input via the terminal D. Also, the switch controller SWC702 puts the charge output terminals 7002*a* and 7002*b* in a connection or disconnection state. The switch SW73 is provided to connect the capacitor C1 to the inverted input terminal of the operational amplifier 7001. The non-inverted input terminal of the operational amplifier 7001 is connected to the ground. The operational amplifier 7001 is also connected at the inverted input terminal to its output terminal via the switch SW71, the capacitor C71 and the switch SW72 (that is, the operational amplifier 7001 has feedback connection between its output terminal and its inverted input terminal via the capacitor C71). Therefore, the potential at the differential input terminal is GND (because the non-inverted input is grounded and the inverted input constitutes a negative feedback circuit). The charge output terminals 7002*a* and 7002*b*, provided to supply the charge stored in the capacitor C71 to the outside (for example, to internal power supply), connect/disconnect the charge recovery section 701 to/from the outside.

<Operation>

The operation of the charge recovery section 701 shown in FIG. 13 will be described with reference to FIGS. 5A and 5B. The operation of the charge recovery section 701 includes charge recovery processing of recovering unnecessary charge and charge supply processing of supplying the recovered charge to the outside.

[Charge Recovery Processing]

First, the charge recovery processing will be described. Note that initially the switches SW71 and SW72 are ON.

In time t0 to t2, the switch controller SWC702 performs the same operation as the switch controller SWC101 described above, and resultantly the charge Q(C1) corresponding to the voltage 0.5VREF at the node N1 is stored in the capacitor C1.

In time t2 to t3, the switch controller SWC702 turns OFF the switches SW1, SW2, SW4 and SW5 because the second least significant bit of the display data Data(a) is "0". Also, the switch controller SWC702 turns ON the switch SW73, to allow the charge Q(C1) stored in the capacitor C1 to shift to the capacitor C71.

In time t3 to t4, the switch controller SWC702 turns OFF the switch SW73 and turns ON the switch SW2 while keeping the other switches SW1, SW4 and SW5 OFF.

In time t4 to t18 except for time t11 to t13, the switch controller SWC702 performs the same operation as the switch controller SWC101. In time t11 to t12, as in time t2 to t3, the switch controller SWC702 turns OFF the switches SW1, SW2, SW4 and SW5 and turns ON the switch SW73. In time t12 to t13, as in time t3 to t4, the switch controller SWC702 turns OFF the switch SW73 and turns ON the switch SW2.

In the manner described above, the charge Q(C1) stored in the capacitor C1 shifts to the capacitor C71 when a bit value of the display data Data(a) is "0".

[Charge Supply Processing]

The charge supply processing will be described. Assume that the charge output terminals 7002*a* and 7002*b* are connectable to power supply.

The switch controller SWC702 first turns OFF the switches SW71 and SW72, and then connects the charge output terminals 7002*a* and 7002*b* to the power supply. Accordingly, the capacitor C71 is connected with the power supply, to permit the charge stored in the capacitor C71 to shift to the power supply.

<Effect>

As described above, the charge Q(C1) stored in the capacitor C1 is not discarded but shifts to another capacitor C71 to thereby enable recovery of unnecessary charge. Moreover, since the charge stored in the capacitor C71 is supplied to power supply and the like, effective use of unnecessary charge and thus low power are attained.

In this embodiment, the switch SW3 is unused and thus can be omitted.

One terminal of the switch SW73 may be connected somewhere between the node N2 and the switch SW4. In this case, the charge recovery section 701 can recover the charge Q(C2) stored in the capacitor C2. Specifically, in time t9 to t10in FIG. 5B, the switch controller SWC702 turns ON the switch SW73 to allow the charge Q(C2) stored in the capacitor C2 to shift to the capacitor C71, in place of turning ON the switch SW5 to discard the charge Q(C2) stored in the capacitor C2. In this case, the switch SW5 can be omitted.

The charge recovery section 701 shown in FIG. 13 may be provided in the serial DAC 600*a* of FIG. 11A. In this case, in time t9 to t10 in FIGS. 12A and 12B, the switch SW73 in the charge recovery section 701 may be turned ON, in place of turning ON the switch SW3, to allow the charge Q(C1) stored in the capacitor C1 and the charge Q(C2) stored in the capacitor C2 to be recovered simultaneously.

Embodiment 8

The LC elements in the liquid crystal panel have their respective load capacitances. In general, as the liquid crystal panel is larger in screen and higher in definition, the value of the load capacitances of the LC elements is greater and often becomes considerably influential. If the capacitance value of the capacitor C2 in the serial DAC 104*a* is smaller than the value of the capacitances of the LC elements, it is necessary to provide an operational amplifier for driving such load capacitances.

<Entire Configuration>

An LCD of Embodiment 8 of the present invention includes serial DACs 800*a* to 800*f* in place of the serial DACs 104*a* to 104*f* shown in FIG. 2. The other configuration is substantially the same as that shown in FIGS. 1 and 2. Since the serial DACs 800*a* to 800*f* are substantially identical in configuration to one another, the serial DAC 800*a* will be described representatively with reference to FIG. 14.

<Internal Configuration of Serial DAC 800*a*>

Figure 14:
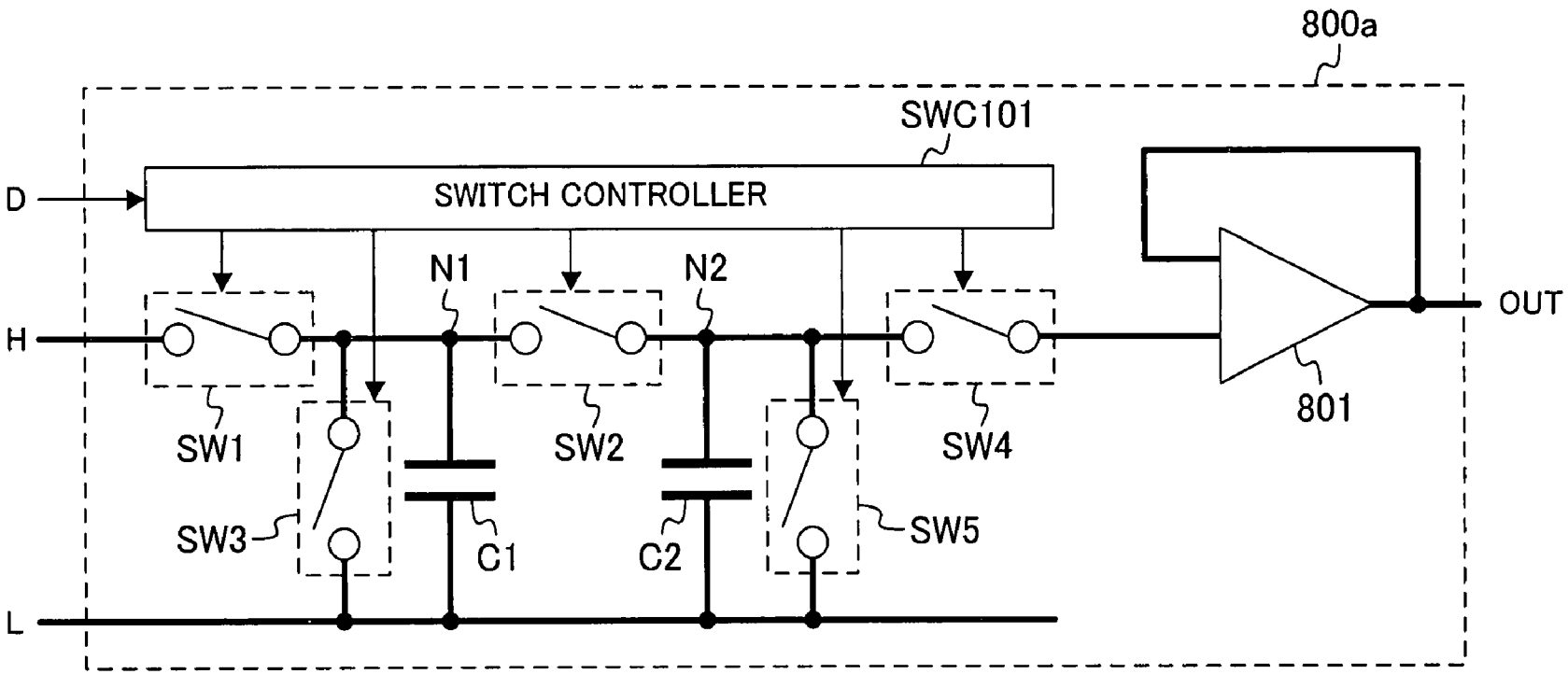
FIG. 14 is a view showing a configuration of a serial DAC in Embodiment 8 of the present invention.

The serial DAC 800*a* of FIG. 14 includes an operational amplifier 801 in addition to the components of the serial DAC 104*a* of FIG. 3A.

The operational amplifier 801 is connected with one terminal of the switch SW4 at one of its input terminals and connected to its own output terminal at the other input terminal. In other words, the serial DAC 800*a* includes a voltage-following current amplifier in addition to the components of the serial DAC 104*a* of FIG. 3A. With this amplifier, occurrence of reverse flow of charge from the terminal OUT toward the switch SW4 is prevented.

<Effect>

As described above, with use of the voltage-following current amplifier to generate the output voltage Vout, a liquid crystal panel large in load capacitance can be driven satisfactorily. Hence, an LCD provided with a large screen liquid crystal panel can be implemented.

Embodiment 9

<Entire Configuration>

An LCD of Embodiment 9 of the present invention includes serial DACs 900*a* to 900*f* in place of the serial DACs 104*a* to 104*f* shown in FIG. 2. The other configuration is substantially the same as that shown in FIGS. 1 and 2. Since the serial DACs 900*a* to 900*f* are substantially identical in configuration to one another, the serial DAC 900*a* will be described representatively with reference to FIG. 15.

Figure 15:
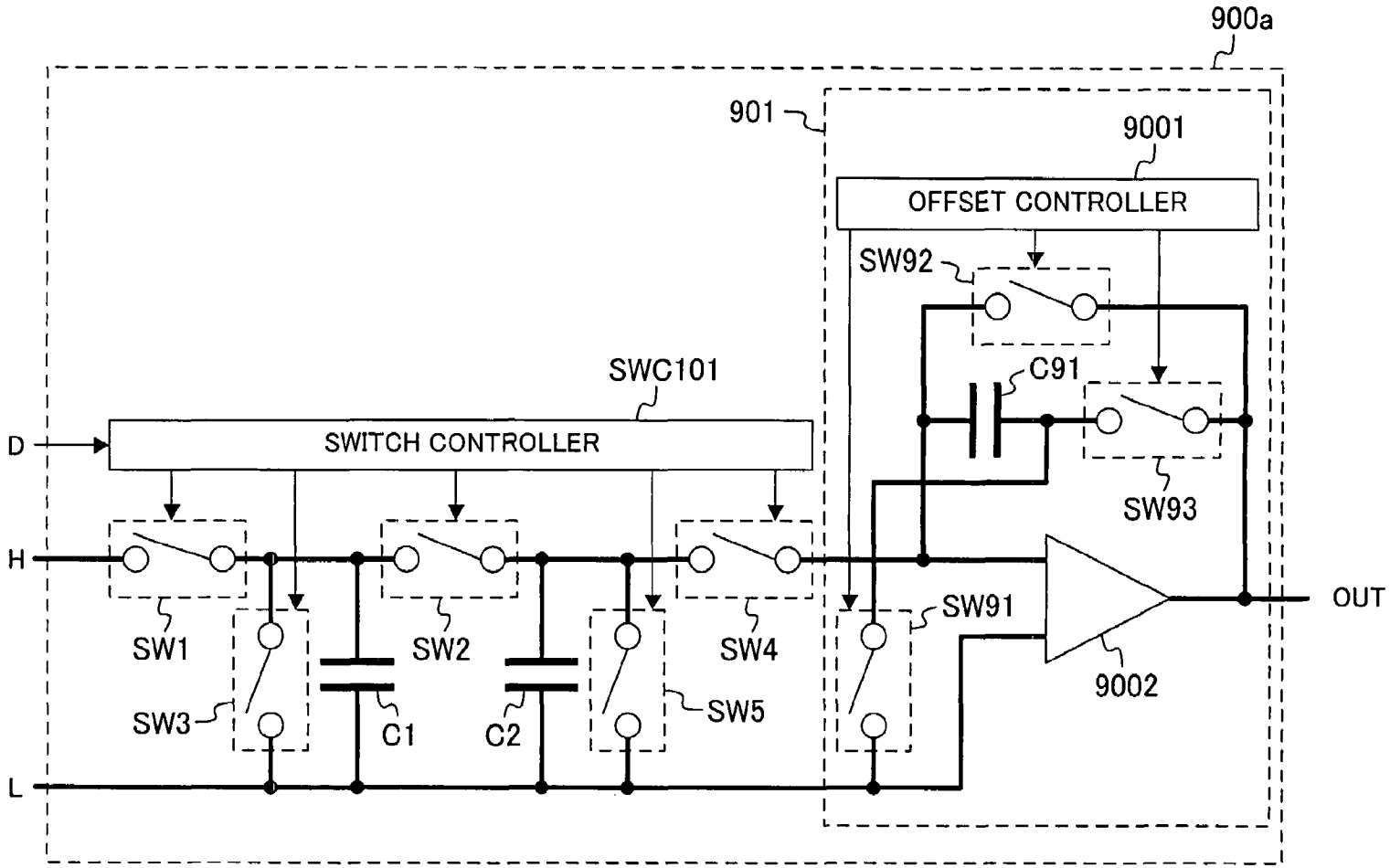
FIG. 15 is a view showing a configuration of a serial DAC in Embodiment 9 of the present invention.

The serial DAC 900*a* of FIG. 15 includes an output voltage amplification section 901 in addition to the components of the serial DAC of FIG. 3A.

<Internal Configuration of Output Voltage Amplification Section 901>

The output voltage amplification section 901 shown in FIG. 15 includes an offset controller 9001, switches SW91 to SW93, a capacitor C91 and an operational amplifier 9002.

The offset controller 9001 controls ON/OFF of the switches SW91 to SW93. The operational amplifier 9002 is connected to the terminal L at one of its two input terminals and connected to the switch SW4 at the other input terminal. The operational amplifier 9002 is also connected, at the input terminal that is connected to the switch SW4, to its own output terminal via the capacitor C91 and the switch SW93 (or via the switch SW92). Further, the operational amplifier 9002 is connected, at the input terminal that is connected to the terminal L, to its own output terminal via the switch SW91, the capacitor C91 and the switch SW92.

<Operation>

The operation of the output voltage amplification section 901 shown in FIG. 15 will be described with reference to FIGS. 16A and 16B. Assume that the operational amplifier 9002 has an offset voltage Vos.

Figure 16B:
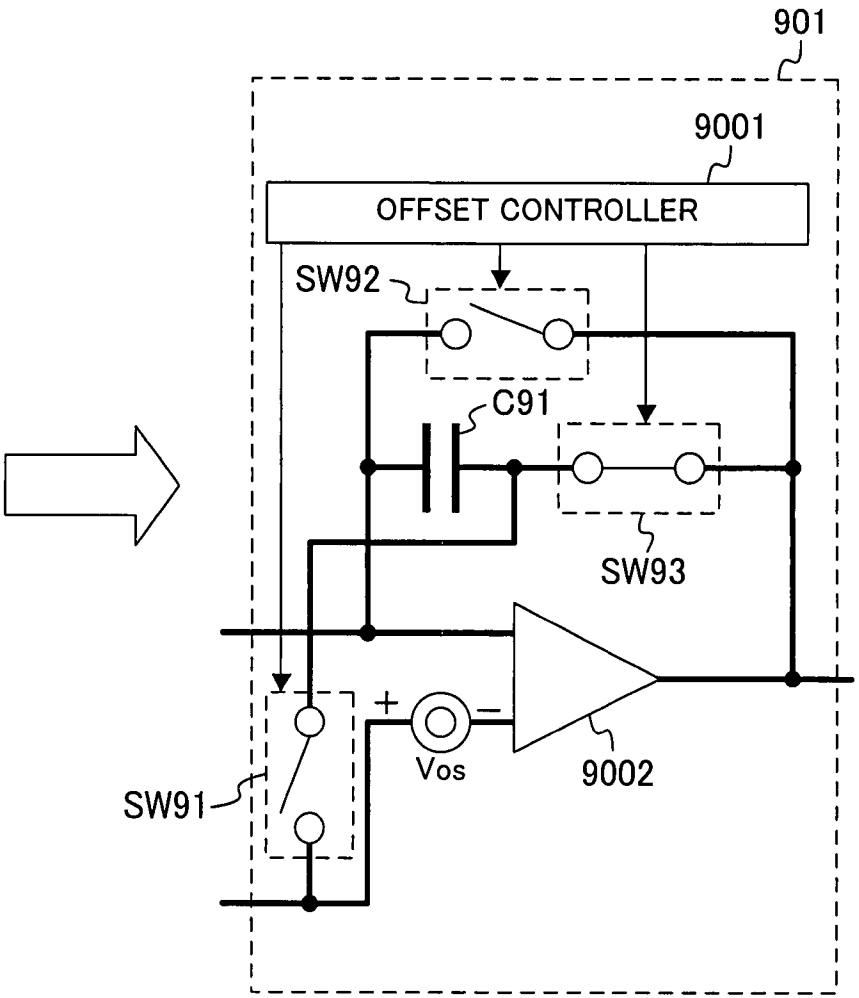
FIGS. 16A and 16B are views for demonstrating an operation of the serial DAC of FIG. 15.
Figure 16A:
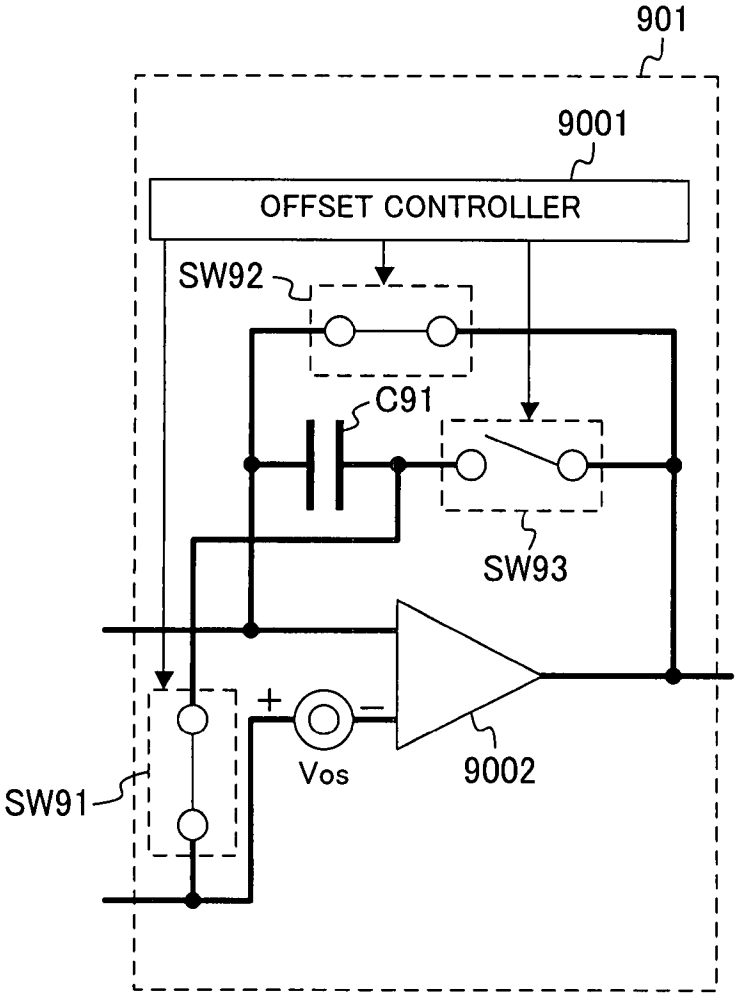

First, as shown in FIG. 16A, the offset controller 9001 turns ON the switches SW91 and SW92. This allows the offset voltage Vos to be applied to the capacitor C91, and thus the capacitor C91 has charge Q(C91) corresponding to the value of the offset voltage Vos.

Thereafter, as shown in FIG. 16B, the offset controller 9001 turns OFF the switches SW91 and SW92 and turns ON the switch SW93, so that the operational amplifier 9002 and the capacitor C91 constitute a capacitance feedback amplifier.

<Effect>

As described above, a charge corresponding to the offset voltage Vos is stored in the capacitor C91, and then the capacitor C91 having this charge and the operational amplifier 9002 form a capacitance feedback amplifier. Hence, the value of the voltage V(C2) at the node N2 is increased/decreased with the amount of the charge stored in the capacitor C91 before the voltage V(C2) is output as the output voltage Vout(a). In other words, the voltage V(C2) is output as the output voltage Vout(a) only after the value of the voltage V(C2) is increased/decreased with the value of the offset voltage Vos. In this way, the offset at the operational amplifier 9002 can be cancelled.

Embodiment 10

FIG. 17 shows the correspondence between the 4-bit display data Data and the voltages V(C1) and V(C2) at the capacitors C1 and C2. In FIG. 17, when the display data Data is "1111", the value of the voltage V(C2) output as the output voltage Vout is "0.9375VREF", which is short of the full-amplitude voltage (Vref) by about 6%. The reason is that in the distribution of charge, the charge fails to be transferred to the capacitor C2 by the maximum amount. To solve this voltage shortage, the reference voltage may be set at a higher value than that giving the desired maximum amplitude. However, to set the reference voltage at a higher value, the relevant transistors must be resistant to such a higher voltage, and the process must be resistant to a voltage width larger than that actually output. This results in reduction of the economic merit.

<Configuration>

An LCD of Embodiment 10 of the present invention includes serial DACs 1000*a* to 1000*f* in place of the serial DACs 104*a* to 104*f* shown in FIG. 2. The other configuration is substantially the same as that shown in FIGS. 1 and 2. Since the serial DACs 1000*a* to 1000*f* are substantially identical in configuration to one another, the serial DAC 1000*a* will be described representatively with reference to FIG. 18.

Figure 18:
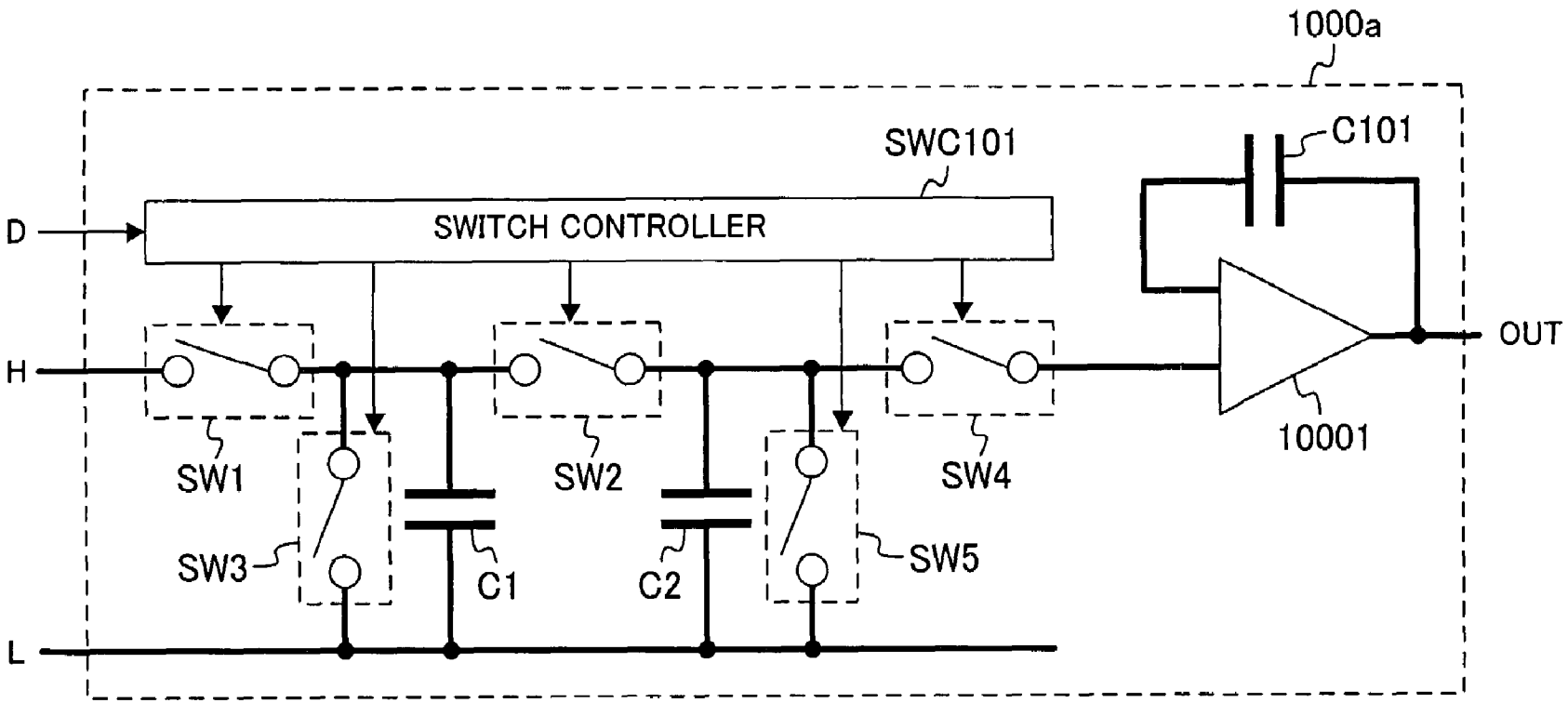
FIG. 18 is a view showing a configuration of a serial DAC in Embodiment 10 of the present invention.

The serial DAC 1000*a* of FIG. 18 includes an operational amplifier 10001 and a capacitor C101 in addition to the components of the serial DAC 104*a* of FIG. 3A.

The operational amplifier 10001 is connected to the switch SW4 at one of its two input terminals and is connected to its own output terminal at the other input terminal via the capacitor C101. In other words, the operational amplifier 10001 forms a capacitance feedback operational amplifier.

<Setting of Capacitance Value>

The capacitance value of the capacitor C101 in FIG. 18 is set smaller than that of the capacitor C2, to thereby increase the voltage generated at the capacitor C101. In this way, the output voltage Vout(a) output from the terminal OUT of the serial DAC 1000*a* is made greater than the voltage input into the operational amplifier 10001.

<Effect>

As described above, the value of the output voltage Vout can be increased/decreased by adjusting the capacitance value of the capacitor C101. This makes it possible to amplify the drive voltage, which has failed to reach the reference voltage amplitude level, up to a predetermined level without increasing the process resistance. Hence, the dynamic range can be widened, and thus high-quality display can be attained.

The charge stored in the capacitor C101 can be recovered as in the serial DAC 600*a* of FIG. 13, to implement a low-cost, low-power LCD.

Embodiment 11

<Entire Configuration>

Figure 19:
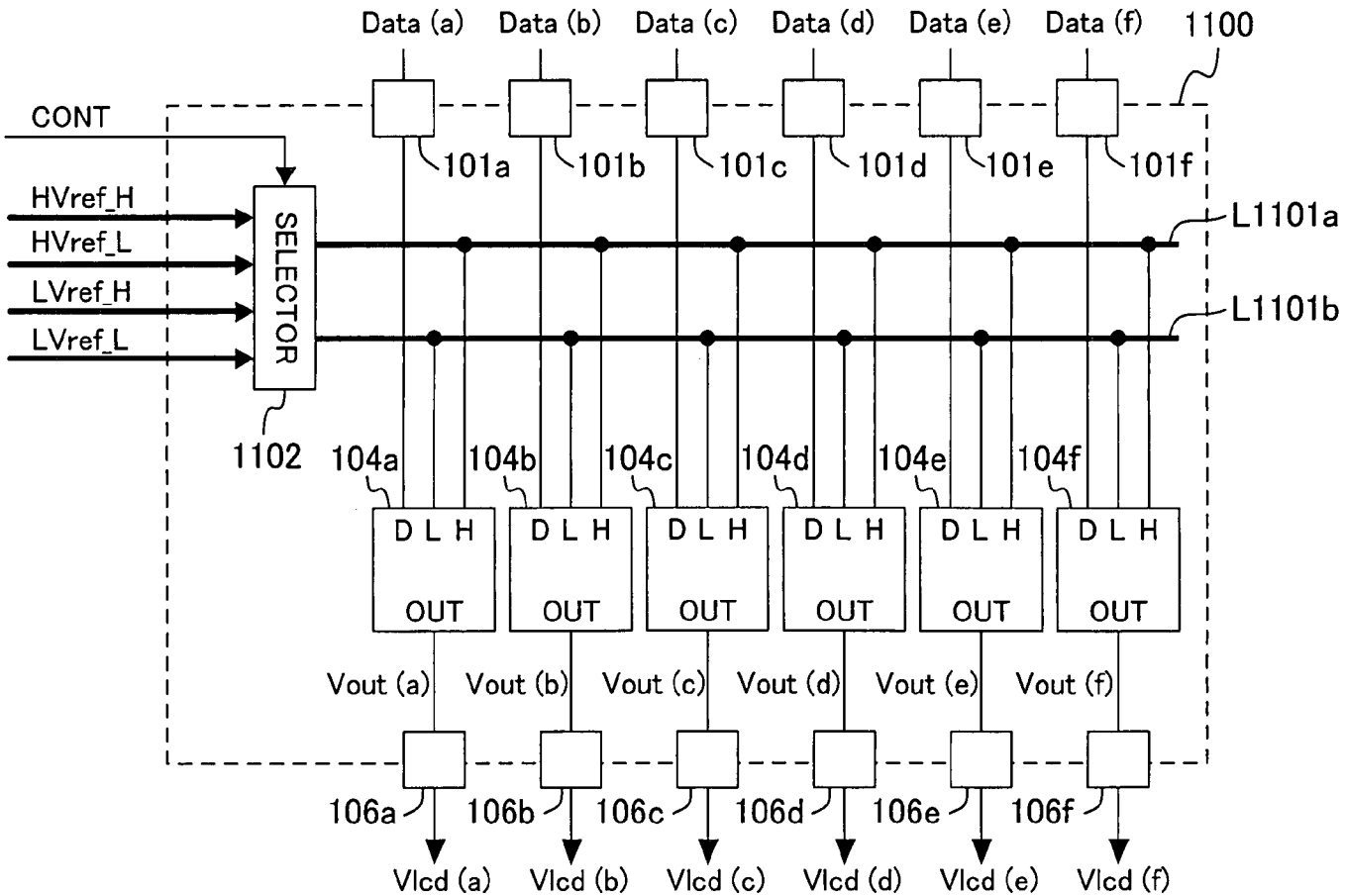
FIG. 19 is a view showing a configuration of a grayscale voltage generation section in Embodiment 11 of the present invention.

An LCD of Embodiment 11 of the present invention includes a grayscale voltage generation section 1100 shown in FIG. 19 in place of the grayscale voltage generation section 100 shown in FIG. 2. The other configuration is substantially the same as that shown in FIGS. 1 and 2. The LCD of this embodiment drives the liquid crystal panel by horizontal line inversion driving according to various external signals.

<Grayscale Voltage Generation Section 1100>

The grayscale voltage generation section 1100 of FIG. 19 includes voltage supply lines L1101*a* and L1101*b* and a selector 1102, in place of the voltage supply lines L103*a* to L103*d* and the selectors 102 and 105 shown in FIG. 2.

The voltage supply lines L1101*a* and 1101*b* are provided to supply the reference voltages HVref_H, HVref_L, LVref_H and LVref_L from the reference voltage supply source 14 to the serial DACs 104*a* to 104*f*.

The selector 1102 supplies the reference voltages HVref_H, HVref_L, LVref_H and LVref_L from the reference voltage supply source 14 to the voltage supply lines L1101*a* and L1101*b* according to the control signal CONT from the controller 2.

The serial DACs 104*a* to 104*f* are respectively connected to the input terminals 101*a* to 101*f* at their terminals D, connected to the voltage supply line L1101*a* at their terminals H, connected to the voltage supply line L1101*b* at their terminals L, and connected to the output terminals 106*a* to 106*f* at their terminals OUT.

<Operation>

The operation of the grayscale voltage generation section 1100 of FIG. 19 will be described.

[Before Switching of Connection]

The selector 1102 first supplies the reference voltages HVref_H and HVref_L to the voltage supply lines L1101*a* and L1101*b*, respectively. At this time, therefore, all of the output voltages Vout(a) to Vout(f) generated by the serial DACs 104*a* to 104*f* have positive polarity.

[After Switching of Connection]

Once the display data DATA of one line has been processed, the controller 2 outputs the control signal CONT. In response to the control signal CONT, the selector 1102 supplies the reference voltages LVref_H and LVref_L to the voltage supply lines L1101*a* and L1101*b*, respectively. Hence, all of the output voltages Vout(a) to Vout(f) generated by the serial DACs 104*a* to 104*f* have negative polarity.

In the manner described above, by switching the reference voltages supplied to the voltage supply lines L1101*a* and L1101*b* every horizontal line, the polarity of the grayscale voltages Vlcd(a) to Vlcd(f) output to the liquid crystal panel 1 can be inverted every horizontal line. In this way, the horizontal line inversion driving is attained.

<Effect>

As described above, the grayscale voltage generation section 1100 includes a plurality of serial DACs connected in parallel to a pair of voltage supply lines. Therefore, in the serial DAC 104*a*, for example, the number of voltage supply lines (the number of reference voltages) required for generating the output voltage Vout(a) can be small, compared with in the conventional R-DAC. Thus, in the resultant grayscale voltage generation device and LCD, the area occupied by the voltage supply lines (the circuit scale) can be smaller than in the case of using the conventional R-DACs.

Embodiment 12

<Entire Configuration>

Figure 20:
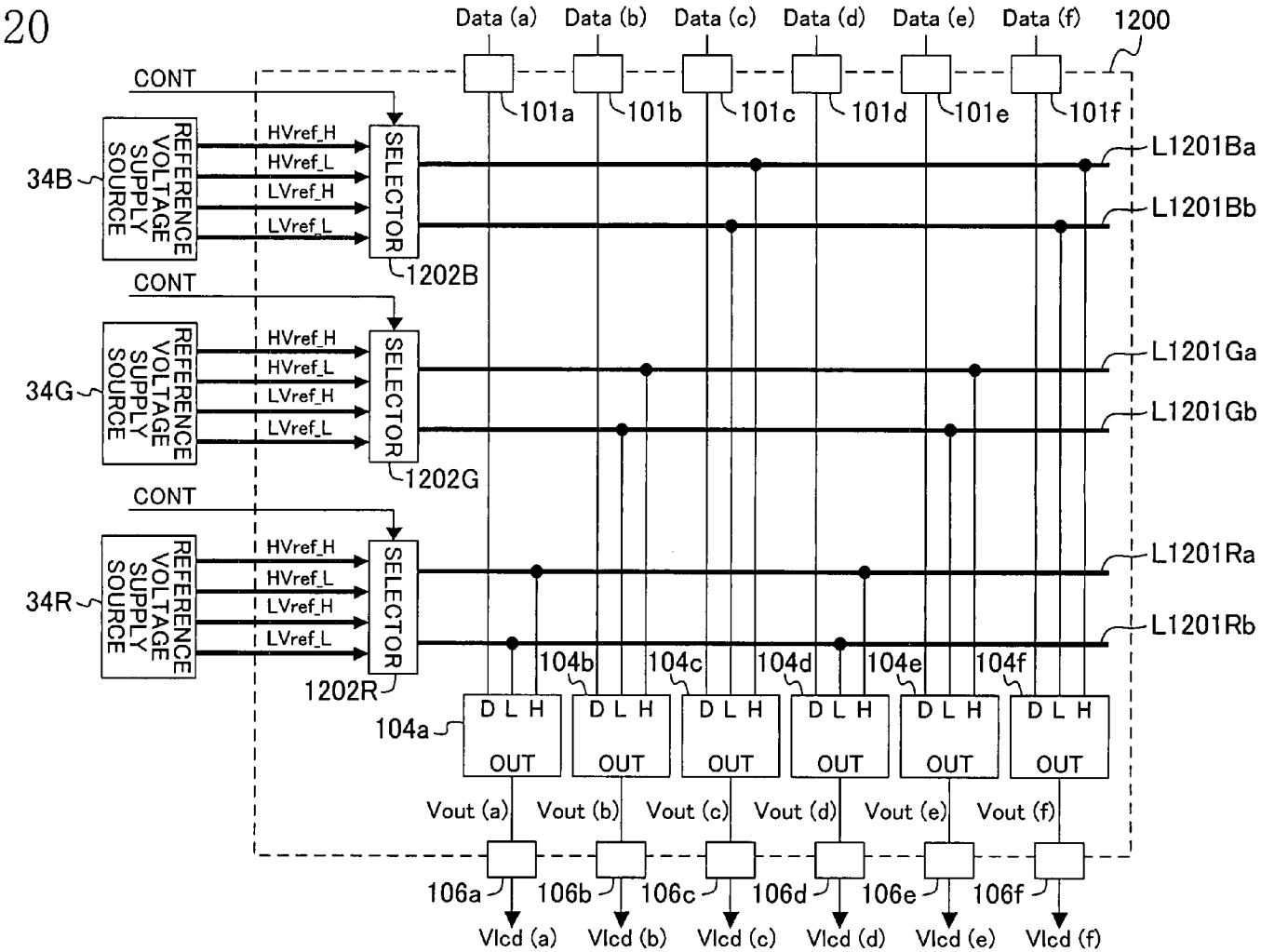
FIG. 20 is a view showing a configuration of a grayscale voltage generation section in Embodiment 12 of the present invention.

An LCD of Embodiment 12 of the present invention includes reference voltage supply sources 34R, 34G and 34B and a grayscale voltage generation section 1200 shown in FIG. 20, in place of the reference voltage supply source 14 and the grayscale voltage generation section 100 shown in FIG. 2. The other configuration is substantially the same as that shown in FIGS. 1 and 2.

<Internal Configuration of Grayscale Voltage Generation Section 1200>

The grayscale voltage generation section 1200 shown in FIG. 20 includes voltage supply lines L1201Ra, L1201Rb, L1201Ga, L1201Gb, L1201Ba and L1201Bb and selectors 1202R, 1202G and 1202B, in place of the voltage supply lines L1101*a* and L1101*b* and the selector 1102 shown in FIG. 19. The other configuration is substantially the same as that shown in FIG. 19.

The voltage supply lines L1201Ra and L1201Rb are provided to supply the reference voltages HVref_H, HVref_L, LVref_H and LVref_L from the reference voltage supply source 34R. The voltage supply lines L1201Ga and L1201Gb are provided to supply the reference voltages HVref_H, HVref_L, LVref_H and LVref_L from the reference voltage supply source 34G. The voltage supply lines L1201Ba and L1201Bb are provided to supply the reference voltages HVref_H, HVref_L, LVref_H and LVref_L from the reference voltage supply source 34B.

The selector 1202R supplies the reference voltages HVref_H, HVref_L, LVref_H and LVref_L received from the reference voltage supply source 34R to the voltage supply lines L1201Ra and L1201Rb according to the control signal CONT from the controller 2. The selector 1202G supplies the reference voltages HVref_H, HVref_L, LVref_H and LVref_L received from the reference voltage supply source 34G to the voltage supply lines L1201Ga and L1201Gb according to the control signal CONT from the controller 2. The selector 1202B supplies the reference voltages HVref_H, HVref_L, LVref_H and LVref_L received from the reference voltage supply source 34B to the voltage supply lines L1201Ba and L1201Bb according to the control signal CONT from the controller 2.

In the serial DACs 104*a* and 104*d*, the terminal H is connected to the voltage supply line L1201Ra, and the terminal L to the voltage supply line L1201Rb. In the serial DACs 104*b* and 104*e*, the terminal H is connected to the voltage supply line L1201Ga, and the terminal L to the voltage supply line L1201Gb. In the serial DACs 104*c* and 104*f*, the terminal H is connected to the voltage supply line L1201Ba, and the terminal L to the voltage supply line L1201Bb.

<Operation>

The operation of the grayscale voltage generation section 1200 shown in FIG. 20 will be described. The selectors 1202R, 1202G and 1202B operate substantially the same. Hereinafter, therefore, the operation of the selector 1202R will be described representatively.

[Before Switching of Connection]

The selector 1202R first supplies the reference voltages HVref_H and HVref_L to the voltage supply lines L1201Ra and L1201Rb, respectively. Therefore, the output voltages Vout(a) and Vout(d) generated by the serial DACs 104*a* and 104*d* have positive polarity.

[After Switching of Connection]

Once receiving the control signal CONT from the controller 2, the selector 1202R supplies the reference voltages LVref_H and LVref_L to the voltage supply lines L1201Ra and L1201Rb, respectively. Hence, the output voltages Vout (a) and Vout(d) generated by the serial DACs 104*a* and 104*d* have negative polarity.

<Effect>

As described above, by setting the values of the reference voltages HVref_H, HVref_L, LVref_H and LVref_L individually in the reference voltage supply sources 34R, 34G and 34B, the grayscale characteristics can be corrected for each of the RGB colors. This permits individual gamma correction for RGB and thus enables high-quality display compared with in Embodiment 11.

Embodiment 13

<Entire Cconfiguration>

Figure 21:
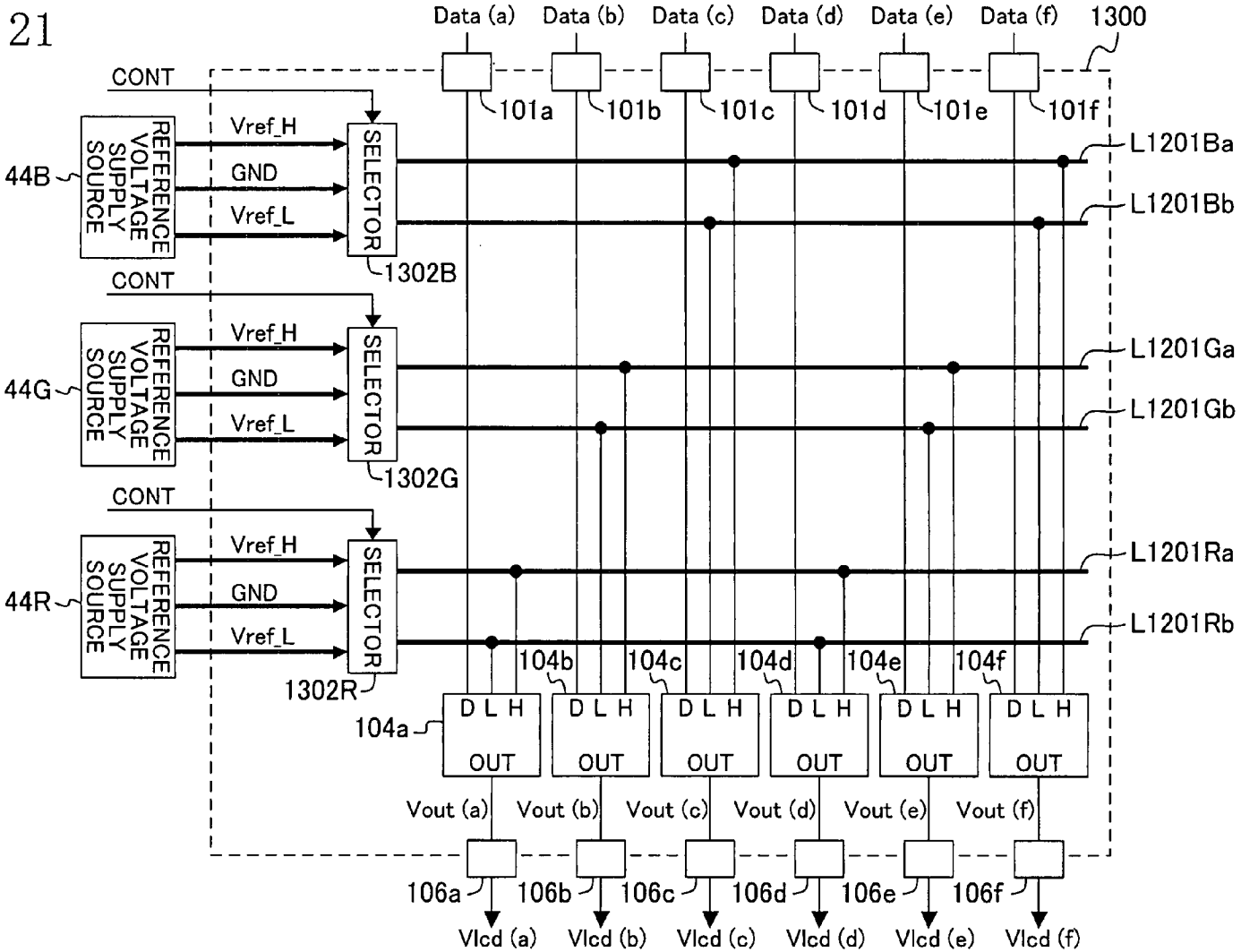
FIG. 21 is a view showing a configuration of a grayscale voltage generation section in Embodiment 13 of the present invention.
Figure 22B:
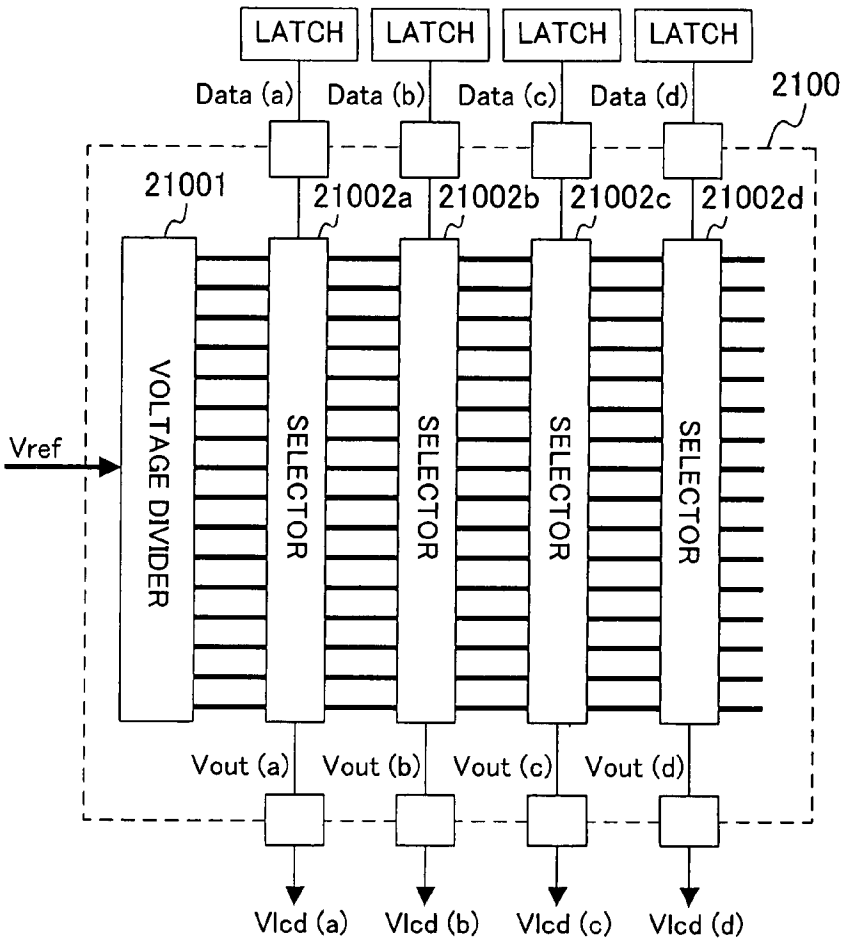
FIG. 22B PRIOR ART
FIGS. 22A and 22B are views showing configurations of LCDs using R-DACs.
Figure 22A:
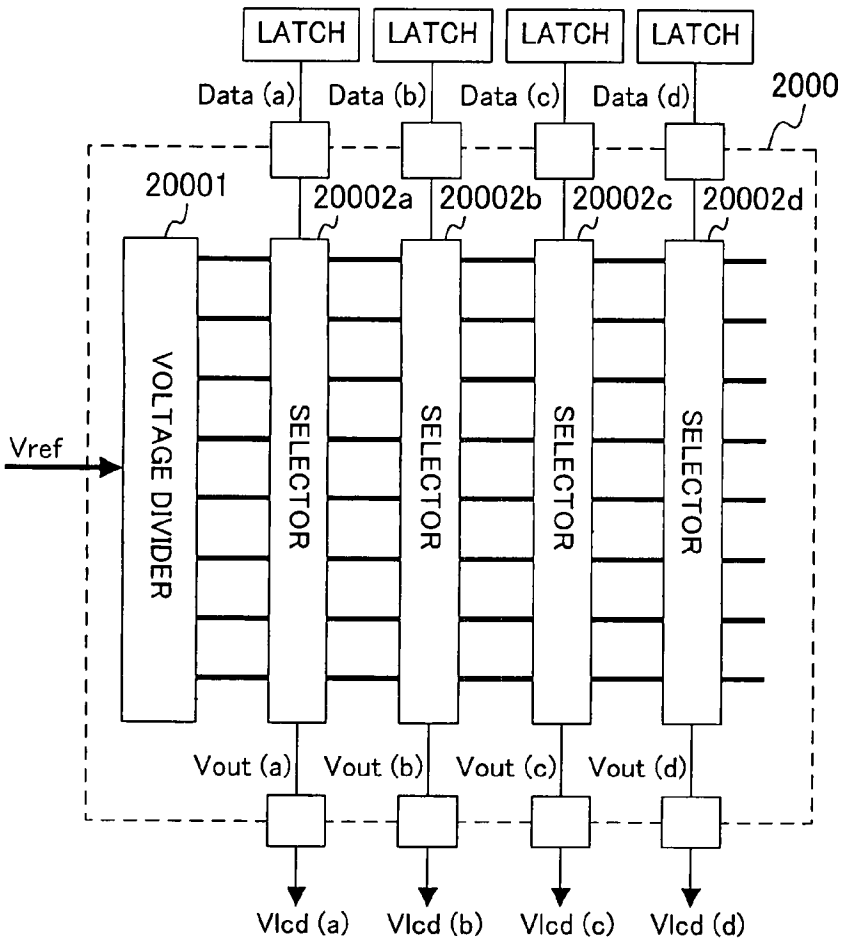
FIG. 22A PRIOR ART
Figure 23:
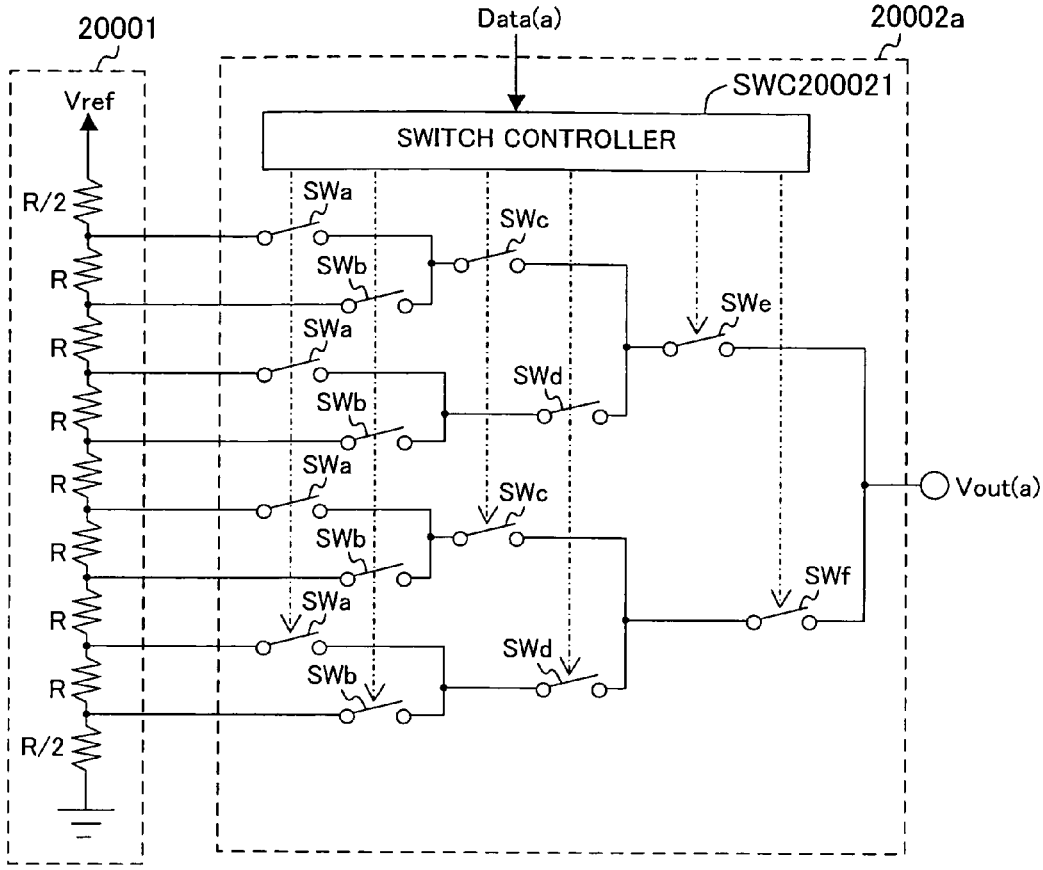
FIG. 23 PRIOR ART
FIG. 23 is a view showing an internal configuration of an R-DAC in FIG. 22A.
Figure 24:
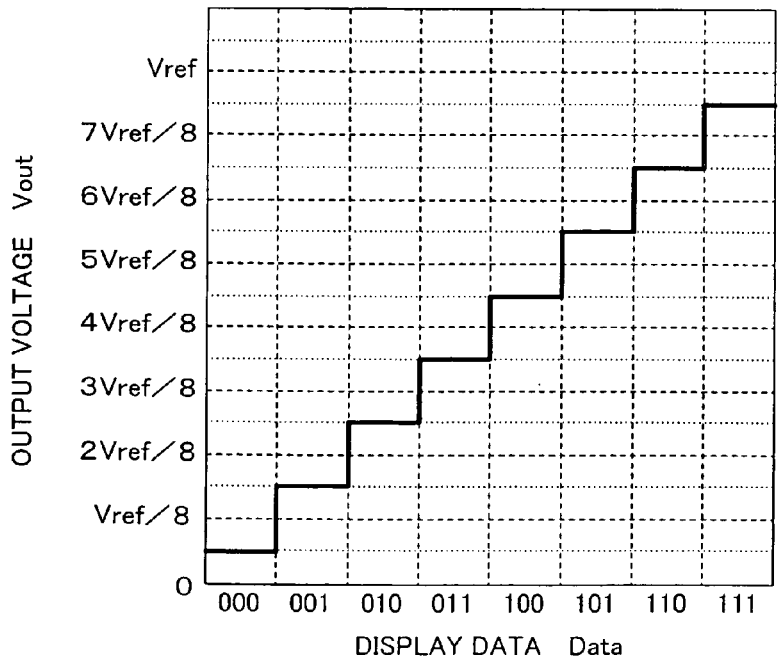
FIG. 24 PRIOR ART
FIG. 24 is a graph showing the relationship between display data input into the R-DAC of FIG. 23 and the output voltage output from the R-DAC.

An LCD of Embodiment 13 of the present invention includes reference voltage supply sources 44R, 44G and 44B and a grayscale voltage generation section 1300 shown in FIG. 21, in place of the reference voltage supply source 14 and the grayscale voltage generation section 100 shown in FIG. 2. The other configuration is substantially the same as that shown in FIGS. 1 and 2.

<Internal Configuration of Grayscale Voltage Generation Section 1300>

The grayscale voltage generation section 1300 shown in FIG. 21 includes selectors 1302R, 1302G and 1302B in place of the selectors 1202R, 1202G and 1202B shown in FIG. 20. The other configuration is substantially the same as that shown in FIG. 20.

The selector 1302R supplies the reference voltages Vref_H, GND and Vref_L received from the reference voltage supply source 44R to the voltage supply lines L1201Ra and L1201Rb according to the control signal CONT from the controller 2. The selector 1302G supplies the reference voltages Vref_H, GND and Vref_L received from the reference voltage supply source 44G to the voltage supply lines L1201Ga and L1201Gb according to the control signal CONT from the controller 2. The selector 1302B supplies the reference voltages Vref_H, GND and Vref_H received from the reference voltage supply source 44B to the voltage supply lines L1201Ba and L1201Bb according to the control signal CONT from the controller 2.

<Operation>

The operation of the grayscale voltage generation section 1300 shown in FIG. 21 will be described. The selectors 1302R, 1302G and 1302B operate substantially the same. Hereinafter, therefore, the operation of the selector 1302R will be described representatively.

[Before Switching of Connection]

The selector 1302R first supplies the reference voltages Vref_H and GND to the voltage supply lines L1201Ra and L1201Rb, respectively. Therefore, the output voltages Vout (a) and Vout(d) generated by the serial DACs 104*a* and 104*d* have positive polarity.

[After Switching of Connection]

Once receiving the control signal CONT from the controller 2, the selector 1302R supplies the reference voltages Vref_L and GND to the voltage supply lines L1201Ra and L1201Rb, respectively. Hence, the output voltages Vout(a) and Vout(d) generated by the serial DACs 104*a* and 104*d* have negative polarity.

<Effect>

As described above, while the supply destinations of a total of four reference voltages HVref_H, HVref_L, LVref_H and LVref_L were switched in the grayscale voltage generation section 1200 shown in FIG. 20, it is only the two reference voltages Vref_H and Vref_L that are involved in the switching of the supply destinations in the grayscale voltage generation section 1300 in this embodiment. Therefore, the number of reference voltages can be reduced.

Although the grayscale voltage generation devices provided in LCDs were described in all of the above embodiments, the present invention is not limited to the application to LCDs. It is needless to mention that the grayscale voltage generation devices of the present invention are applicable to all displays that display images with input grayscale voltages (such as organic EL panels, for example).

The grayscale voltage generation devices of the present invention, which can reduce the areas occupied by circuits, can be effectively used for liquid crystal displays, printers and the like.

While the present invention has been described in preferred embodiments, it will be apparent to those skilled in the art that the disclosed invention may be modified in numerous ways and may assume many embodiments other than that specifically set out and described above. Accordingly, it is intended by the appended claims to cover all modifications of the invention which fall within the true spirit and scope of the invention.

What is claimed is:

1. A grayscale voltage generation device which has first and second modes, comprising:

a first line;

a second line;

a first selector for receiving a first reference voltage having a first voltage value, a second reference voltage having a second voltage value and a third reference voltage having a third voltage value, supplying the first reference voltage to the first line and the second reference voltage to the second line in the first mode, and supplying the third reference voltage to the first line and the second reference voltage to the second line in the second mode; and a plurality of serial digital analog converters (DACs), each of which receives grayscale information representing a grayscale level and generates a grayscale voltage having a voltage value corresponding to the grayscale information using the reference voltages supplied to the first and second lines, wherein, the first reference voltage has negative polarity with respect to the second reference voltage, and the third reference voltage has positive polarity with respect to the second reference voltage.

2. The device of claim 1, further comprising:

third, fourth, fifth and sixth lines to which a voltage is supplied;

a second selector for receiving a fourth reference voltage having a fourth voltage value, a fifth reference voltage having a fifth voltage value and a sixth reference voltage having a sixth voltage value; and a third selector for receiving a seventh reference voltage having a seventh voltage value, an eighth reference voltage having an eighth voltage value and a ninth reference voltage having a ninth voltage value, wherein the plurality of serial DACs include first, second and third serial DACs, the first serial DAC receives first grayscale information representing a first grayscale level and generates a first grayscale voltage having a voltage value corresponding to the first grayscale information using the reference voltages supplied to the first and second lines, the second serial DAC receives second grayscale information representing a second grayscale level and generates a second grayscale voltage having a voltage value corresponding to the second grayscale information using the reference voltages supplied to the third and fourth lines, the third serial DAC receives third grayscale information representing a third grayscale level and generates a third grayscale voltage having a voltage value corresponding to the third grayscale information using the reference voltages supplied to the fifth and sixth lines, in the first mode, the first selector supplies the first reference voltage to the first line and the second reference voltage to the second line, the second selector supplies the fourth reference voltage to the third line and the fifth reference voltage to the fourth line, and the third selector supplies the seventh reference voltage to the fifth line and the eighth reference voltage to the sixth line, in the second mode, the first selector supplies the third reference voltage to the first line and the second reference voltage to the second line, the second selector supplies the sixth reference voltage to the third line and the fifth reference voltage to the fourth line, and the third selector supplies the ninth reference voltage to the fifth line and the eighth reference voltage to the sixth line, the fourth reference voltage has negative polarity with respect to the fifth reference voltage, the sixth reference voltage has positive polarity with respect to the fifth reference voltage, the seventh reference voltage has negative polarity with respect to the eighth reference voltage, and the ninth reference voltage has positive polarity with respect to the eighth reference voltage.

3. A grayscale voltage generation device which has first and second modes, comprising:

a first line;

a second line;

a first selector for receiving a first reference voltage having a first voltage value, a second reference voltage having a second voltage value, a third reference voltage having a third voltage value and a fourth reference voltage having a fourth voltage value, supplying the first reference voltage to the first line and the second reference voltage to the second line in the first mode, and supplying the third reference voltage to the first line and the fourth reference voltage to the second line; and a plurality of serial digital analog converters (DACs), each of which receives grayscale information representing a grayscale level and generates a grayscale voltage having a voltage value corresponding to the grayscale information using the reference voltages supplied to the first and second lines, wherein the first reference voltage has negative polarity with respect to the second reference voltage, and the third reference voltage has negative polarity with respect to the fourth reference voltage.

4. The device of claim 3, further comprising:

third, fourth, fifth and sixth lines to which a voltage is supplied;

a second selector for receiving a fifth reference voltage having a fifth voltage value, a sixth reference voltage having a sixth voltage value, a seventh reference voltage having a seventh voltage value, and an eighth reference voltage having an eighth voltage value; and a third selector for receiving a ninth reference voltage having a ninth voltage value, a tenth reference voltage having a tenth voltage value, an eleventh reference voltage having an eleventh voltage value, and a twelfth reference voltage having a twelfth voltage value, wherein the plurality of serial DACs include first, second and third serial DACs, the first serial DAC receives first grayscale information representing a first grayscale level and generates a first grayscale voltage having a voltage value corresponding to the first grayscale information using the reference voltages supplied to the first and second lines, the second serial DAC receives second grayscale information representing a second grayscale level and generates a second grayscale voltage having a voltage value corresponding to the second grayscale information using the reference voltages supplied to the third and fourth lines, the third serial DAC receives third grayscale information representing a third grayscale level and generates a third grayscale voltage having a voltage value corresponding to the third grayscale information using the reference voltages supplied to the fifth and sixth lines, in the first mode, the first selector supplies the first reference voltage to the first line and the second reference voltage to the second line, the second selector supplies the fifth reference voltage to the third line and the sixth reference voltage to the fourth line, and the third selector supplies the ninth reference voltage to the fifth line and the tenth reference voltage to the sixth line, in the second mode, the first selector supplies the third reference voltage to the first line and the fourth reference voltage to the second line, the second selector supplies the seventh reference voltage to the third line and the eighth reference voltage to the fourth line, and the third selector supplies the eleventh reference voltage to the fifth line and the twelfth reference voltage to the sixth line, the fifth reference voltage has negative polarity with respect to the sixth reference voltage, the seventh reference voltage has negative polarity with respect to the eighth reference voltage, the ninth reference voltage has negative polarity with respect to the tenth reference voltage, and the eleventh reference voltage has negative polarity with respect to the twelfth reference voltage.

5. A grayscale voltage generation device comprising:

a first line to which a first reference voltage having a first voltage value is supplied;

a second line to which a second reference voltage having a second voltage value is supplied;

a third line to which a third reference voltage having a third reference value is supplied; and a plurality of serial digital analog converters (DACs), wherein the plurality of serial DACs include first and second serial DACs, the first serial DAC receives first grayscale information representing a first grayscale level and generates a first grayscale voltage having a voltage value corresponding to the first grayscale information using the reference voltages supplied to the first and second lines, the second serial DAC receives second grayscale information representing a second grayscale level and generates a second grayscale voltage having a voltage value corresponding to the second grayscale information using the reference voltages supplied to the second and third lines, the first reference voltage has negative polarity with respect to the second reference voltage, and the third reference voltage has positive polarity with respect to the second reference voltage.

6. The device of claim 5, further comprising:

a first selector for receiving the first, second and third reference voltages, wherein the grayscale voltage generation device has first and second modes, in the first mode, the first selector supplies the first reference voltage to the first line, the second reference voltage to the second line, and the third reference voltage to the third line, in the second mode, the first selector supplies the third reference voltage to the first line, the second reference voltage to the second line, and the first reference voltage to the third line.

7. The device of claim 6, further comprising:

fourth, fifth, sixth, seventh, eighth and ninth lines to which a voltage is supplied;

a second selector for receiving a fourth reference voltage having a fourth voltage value, a fifth reference voltage having a fifth voltage value, and a sixth reference voltage having a sixth voltage value; and a third selector for receiving a seventh reference voltage having a seventh voltage value, an eighth reference voltage having an eighth voltage value, and a ninth reference voltage having a ninth voltage value, wherein the plurality of serial DACs further include third, fourth, fifth and sixth serial DACs, the third serial DAC receives third grayscale information representing a third grayscale level and generates a third grayscale voltage having a voltage value corresponding to the third grayscale information using the reference voltages supplied to the fifth and sixth lines, the fourth serial DAC receives fourth grayscale information representing a fourth grayscale level and generates a fourth grayscale voltage having a voltage value corresponding to the fourth grayscale information using the reference voltages supplied to the fourth and fifth lines, the fifth serial DAC receives fifth grayscale information representing a fifth grayscale level and generates a fifth grayscale voltage having a voltage value corresponding to the fifth grayscale information using the reference voltages supplied to the seventh and eighth lines, the sixth serial DAC receives sixth grayscale information representing a sixth grayscale level and generates a sixth grayscale voltage having a voltage value corresponding to the sixth grayscale information using the reference voltages supplied to the eighth and ninth lines, in the first mode, the first selector supplies the first reference voltage to the first line, the second reference voltage to the second line and the third reference voltage to the third line, the second selector supplies the fourth reference voltage to the fourth line, the fifth reference voltage to the fifth line and the sixth reference voltage to the sixth line, and the third selector supplies the seventh reference voltage to the seventh line, the eighth reference voltage to the eighth line and the ninth reference voltage to the ninth line, in the second mode, the first selector supplies the third reference voltage to the first line, the second reference voltage to the second line and the first reference voltage to the third line, the second selector supplies the sixth reference voltage to the fourth line, the fifth reference voltage to the fifth line and the fourth reference voltage to the sixth line, and the third selector supplies the ninth reference voltage to the seventh line, the eighth reference voltage to the eighth line and the seventh reference voltage to the ninth line, the fourth reference voltage has negative polarity with respect to the fifth reference voltage, the sixth reference voltage has positive polarity with respect to the fifth reference voltage, the seventh reference voltage has negative polarity with respect to the eighth reference voltage, and the ninth reference voltage has positive polarity with respect to the eighth reference voltage.

8. The device of claim 5, further comprising:

a first selector for receiving the first and second grayscale voltages, wherein the grayscale voltage generation device has first and second modes, in the first mode, the first selector outputs the first grayscale voltage to a first node and the second grayscale voltage to a second node, and in the second mode, the first selector outputs the first grayscale voltage to the second node and the second grayscale voltage to the first node.

9. The device of claim 8, further comprising:

a fourth line to which a fourth reference voltage having a fourth voltage value is supplied;

a fifth line to which a fifth reference voltage having a fifth voltage value is supplied;

a sixth line to which a sixth reference voltage having a sixth voltage value is supplied;

a seventh line to which a seventh reference voltage having a seventh voltage value is supplied;

an eighth line to which an eighth reference voltage having an eighth voltage value is supplied;

a ninth line to which a ninth reference voltage having a ninth voltage value is supplied;

wherein the plurality of serial DACs further include third, fourth, fifth and sixth serial DACs, the third serial DAC receives third grayscale information representing a third grayscale level and generates a third grayscale voltage having a voltage value corresponding to the third grayscale information using the reference voltages supplied to the fifth and sixth lines, the fourth serial DAC receives fourth grayscale information representing a fourth grayscale level and generates a fourth grayscale voltage having a voltage value corresponding to the fourth grayscale information using the reference voltages supplied to the fourth and fifth lines, the fifth serial DAC receives fifth grayscale information representing a fifth grayscale level and generates a fifth grayscale voltage having a voltage value corresponding to the fifth grayscale information using the reference voltages supplied to the seventh and eighth lines, the sixth serial DAC receives sixth grayscale information representing a sixth grayscale level and generates a sixth grayscale voltage having a voltage value corresponding to the sixth grayscale information using the reference voltages supplied to the eighth and ninth lines, the grayscale voltage generation device further comprises:

a second selector for receiving the third and fourth grayscale voltages; and a third selector for receiving the fifth and sixth grayscale voltages, in the first mode, the first selector outputs the first grayscale voltage to the first node and the second grayscale voltage to the second node, the second selector outputs the third grayscale voltage to a third node and the fourth grayscale voltage to a fourth node, and the third selector outputs the fifth grayscale voltage to a fifth node and the sixth grayscale voltage to a sixth node, in the second mode, the first selector outputs the first grayscale voltage to the second node and the second grayscale voltage to the first node, the second selector outputs the third grayscale voltage to the fourth node and the fourth grayscale voltage to the third node, and the third selector outputs the fifth grayscale voltage to the sixth node and the sixth grayscale voltage to the fifth node, the fourth reference voltage has negative polarity with respect to the fifth reference voltage, the sixth reference voltage has positive polarity with respect to the fifth reference voltage, the seventh reference voltage has negative polarity with respect to the eighth reference voltage, and the ninth reference voltage has positive polarity with respect to the eighth reference voltage.

10. A grayscale voltage generation device comprising:

a first line to which a first reference voltage having a first voltage value is supplied;

a second line to which a second reference voltage having a second voltage value is supplied;

a third line to which a third reference voltage having a third reference value is supplied;

a fourth line to which a fourth reference voltage having a fourth reference value is supplied; and a plurality of serial digital analog converters (DACs), wherein the plurality of serial DACs include first and second serial DACs, the first serial DAC receives first grayscale information representing a first grayscale level and generates a first grayscale voltage having a voltage value corresponding to the first grayscale information using the reference voltages supplied to the first and second lines, the second serial DAC receives second grayscale information representing a second grayscale level and generates a second grayscale voltage having a voltage value corresponding to the second grayscale information using the reference voltages supplied to the third and fourth lines, the first reference voltage has negative polarity with respect to the second reference voltage, and the third reference voltage has negative polarity with respect to the fourth reference voltage.

11. The device of claim 10, further comprising:

a first selector for receiving the first, second, third and fourth reference voltages, wherein the grayscale voltage generation device has first and second modes, in the first mode, the first selector supplies the first reference voltage to the first line, the second reference voltage to the second line, the third reference voltage to the third line, and the fourth reference voltage to the fourth line, in the second mode, the first selector supplies the third reference voltage to the first line, the fourth reference voltage to the second line, the first reference voltage to the third line, and the second reference voltage to the fourth line.

12. The device of claim 11, further comprising:

fifth, sixth, seventh, eighth, ninth, tenth, eleventh and twelfth lines to which a voltage is supplied;

a second selector for receiving a fifth reference voltage having a fifth voltage value, a sixth reference voltage having a sixth voltage value, a seventh reference voltage having a seventh voltage value and an eighth reference voltage having an eighth voltage value; and a third selector for receiving a ninth reference voltage having a ninth voltage value, a tenth reference voltage having a tenth voltage value, an eleventh reference voltage having an eleventh voltage value and a twelfth reference voltage having a twelfth voltage value, wherein the plurality of serial DACs further includes third, fourth, fifth and sixth serial DACs, the third serial DAC receives third grayscale information representing a third grayscale level and generates a third grayscale voltage having a voltage value corresponding to the third grayscale information using the reference voltages supplied to the seventh and eighth lines, the fourth serial DAC receives fourth grayscale information representing a fourth grayscale level and generates a fourth grayscale voltage having a voltage value corresponding to the fourth grayscale information using the reference voltages supplied to the fifth and sixth lines, the fifth serial DAC receives fifth grayscale information representing a fifth grayscale level and generates a fifth grayscale voltage having a voltage value corresponding to the fifth grayscale information using the reference voltages supplied to the ninth and tenth lines, the sixth serial DAC receives sixth grayscale information representing a sixth grayscale level and generates a sixth grayscale voltage having a voltage value corresponding to the sixth grayscale information using the reference voltages supplied to the eleventh and twelfth lines, in the first mode, the first selector supplies the first reference voltage to the first line, the second reference voltage to the second line, the third reference voltage to the third line and the fourth reference voltage to the fourth line, the second selector supplies the fifth reference voltage to the fifth line, the sixth reference voltage to the sixth line, the seventh reference voltage to the seventh line and the eighth reference voltage to the eighth line, and the third selector supplies the ninth reference voltage to the ninth line, the tenth reference voltage to the tenth line, the eleventh reference voltage to the eleventh line and the twelfth reference voltage to the twelfth line, in the second mode, the first selector supplies the third reference voltage to the first line, the fourth reference voltage to the second line, the first reference voltage to the third line and the second reference voltage to the fourth line, the second selector supplies the seventh reference voltage to the fifth line, the eighth reference voltage to the sixth line, the fifth reference voltage to the seventh line and the sixth reference voltage to the eighth line, and the third selector supplies the eleventh reference voltage to the ninth line, the twelfth reference voltage to the tenth line, the ninth reference voltage to the eleventh line and the tenth reference voltage to the twelfth line, the fifth reference voltage has negative polarity with respect to the sixth reference voltage, the seventh reference voltage has negative polarity with respect to the eighth reference voltage, the ninth reference voltage has negative polarity with respect to the tenth reference voltage, and the eleventh reference voltage has negative polarity with respect to the twelfth reference voltage.

13. The device of claim 10, further comprising:

a first selector for receiving the first and second grayscale voltages, wherein the grayscale voltage generation device has first and second modes, in the first mode, the first selector outputs the first grayscale voltage to a first node and the second grayscale voltage to a second node, and in the second mode, the first selector outputs the first grayscale voltage to the second node and the second grayscale voltage to the first node.

14. The device of claim 13, further comprising:

a fourth line to which a fourth reference voltage having a fourth voltage value is supplied;

a fifth line to which a fifth reference voltage having a fifth voltage value is supplied;

a sixth line to which a sixth reference voltage having a sixth voltage value is supplied;

a seventh line to which a seventh reference voltage having a seventh voltage value is supplied;

an eighth line to which an eighth reference voltage having an eighth voltage value is supplied;

a ninth line to which a ninth reference voltage having a ninth voltage value is supplied;

a tenth line to which a tenth reference voltage having a tenth voltage value is supplied;

an eleventh line to which an eleventh reference voltage having an eleventh voltage value is supplied;

a twelfth line to which a twelfth reference voltage having a twelfth voltage value is supplied;

wherein the plurality of serial DACs further include third, fourth, fifth and sixth serial DACs, the third serial DAC receives third grayscale information representing a third grayscale level and generates a third grayscale voltage having a voltage value corresponding to the third grayscale information using the reference voltages supplied to the seventh and eighth lines, the fourth serial DAC receives fourth grayscale information representing a fourth grayscale level and generates a fourth grayscale voltage having a voltage value corresponding to the fourth grayscale information using the reference voltages supplied to the fifth and sixth lines, the fifth serial DAC receives fifth grayscale information representing a fifth grayscale level and generates a fifth grayscale voltage having a voltage value corresponding to the fifth grayscale information using the reference voltages supplied to the ninth and tenth lines, the sixth serial DAC receives sixth grayscale information representing a sixth grayscale level and generates a sixth grayscale voltage having a voltage value corresponding to the sixth grayscale information using the reference voltages supplied to the eleventh and twelfth lines, the grayscale voltage generation device further comprises:

a second selector for receiving the third and fourth grayscale voltages; and a third selector for receiving the fifth and sixth grayscale voltages, in the first mode, the first selector outputs the first grayscale voltage to the first node and the second grayscale voltage to the second node, the second selector outputs the third grayscale voltage to a third node and the fourth grayscale voltage to a fourth node, and the third selector outputs the fifth grayscale voltage to a fifth node and the sixth grayscale voltage to a sixth node, in the second mode, the first selector outputs the first grayscale voltage to the second node and the second grayscale voltage to the first node, the second selector outputs the third grayscale voltage to the fourth node and the fourth grayscale voltage to the third node, and the third selector outputs the fifth grayscale voltage to the sixth node and the sixth grayscale voltage to the fifth node, the fifth reference voltage has negative polarity with respect to the sixth reference voltage, the seventh reference voltage has negative polarity with respect to the eighth reference voltage, the ninth reference voltage has negative polarity with respect to the tenth reference voltage, and the eleventh reference voltage has negative polarity with respect to the twelfth reference voltage.

15. A grayscale voltage generation device comprising:

a first line to which a first reference voltage having a first voltage value is supplied;

a second line to which a second reference voltage having a second voltage value is supplied; and a plurality of serial digital analog converters (DACs), wherein each of the plurality of serial DACs receives grayscale information representing a grayscale level and generates a grayscale voltage having a voltage value corresponding to the grayscale information using the reference voltages supplied to the first and second lines, and each of the plurality of serial DACs includes a first input terminal for receiving the first reference voltage;

a second input terminal for receiving the second reference voltage;

a first switch for connecting the first input terminal with a first node or connecting the second input terminal with the first node;

a first capacitor connected between the first node and the second input terminal;

a second switch for connecting/disconnecting the first node with/from a second node; and a second capacitor connected between the second node and the second input terminal.

16. The device of claim 15, wherein the serial DAC further comprises:

a third switch for connecting/disconnecting the second node to/from the second input terminal.

17. The device of claim 15, wherein the serial DAC further comprises:

an operational amplifier connected with a third node at one of its input terminals and receiving a ground voltage at the other input terminal; and a third capacitor connected between the third node and an output terminal of the operational amplifier, wherein the first switch connects the first input terminal with the first node or connects the first node with the third node according to the grayscale information.

18. The device of claim 17, wherein the serial DAC further comprises:

a third switch provided between the third node and the third capacitor;

a fourth switch provided between the third capacitor and the output terminal of the operational amplifier; and a discharge section for connecting the third capacitor to the outside.

19. The device of claim 15, wherein the serial DAC further comprises:

an operational amplifier connected with the second node at one of its input terminals and connected with its output terminal at the other input terminal.

20. The device of claim 15, wherein the serial DAC further comprises:

a third capacitor;

an operational amplifier connected to the second node via a third node at one of its input terminals and to the second input terminal via a fourth node at the other input terminal; and a connection switching section for performing first processing and second processing, wherein in the first processing, the connection switching section connects one terminal of the third capacitor with the fourth node and connects the other terminal of the third capacitor with the third node and with the output terminal of the operational amplifier, and in the second processing, the connection switching section connects one terminal of the third capacitor with the third node and connects the other terminal of the third capacitor with the output terminal of the operational amplifier.

21. The device of claim 15, wherein the serial DAC further comprises:

a third capacitor having a capacitance value smaller than the capacitance value of the second capacitor; and an operational amplifier connected with the second node at one of its input terminals and connected with its output terminal via the third capacitor at the other input terminal.

22. A display panel driver for driving a display panel comprising:

a first line;

a second line;

a selector for receiving a first reference voltage having a first voltage value, a second reference voltage having a second voltage value and a third reference voltage having a third voltage value, supplying the first reference voltage to the first line and the second reference voltage to the second line in a first mode, and supplying the third reference voltage to the first line and the second reference voltage to the second line in a second mode;

a plurality of serial digital analog converters (DACs); and a plurality of output terminals, wherein each of the plurality of serial DACs receives grayscale information representing a grayscale level and generates a grayscale voltage having a voltage value corresponding to the grayscale information using the reference voltages supplied to the first and second lines, and each of the plurality of output terminals outputs either one of the grayscale voltages generated by the plurality of serial DACs.

23. A display comprising:

a first line;

a second line;

a selector for receiving a first reference voltage having a first voltage value, a second reference voltage having a second voltage value and a third reference voltage having a third voltage value, supplying the first reference voltage to the first line and the second reference voltage to the second line in a first mode, and supplying the third reference voltage to the first line and the second reference voltage to the second line in a second mode;

a plurality of serial digital analog converters (DACs); and a display panel, wherein each of the plurality of serial DACs receives grayscale information representing a grayscale level and generates a grayscale voltage having a voltage value corresponding to the grayscale information using the reference voltages supplied to the first and second lines, and the display panel receives the grayscale voltages generated by the plurality of serial DACs.

* * * * *